US012044093B2

(12) United States Patent
Martins et al.

(10) Patent No.: US 12,044,093 B2
(45) Date of Patent: Jul. 23, 2024

(54) APPARATUS AND METHOD RELATING TO MANAGED PRESSURE DRILLING

(71) Applicant: Oil States Industries (UK) Limited, Aberdeen (GB)

(72) Inventors: Miguel Fernandes Martins, Midlothian (GB); Richard Johnston, West Lothian (GB)

(73) Assignee: OIL STATES INDUSTRIES (UK) LIMITED, Aberdeen (GB)

( * ) Notice: Subject to any disclaimer, the term of this patent is extended or adjusted under 35 U.S.C. 154(b) by 213 days.

(21) Appl. No.: 17/601,859

(22) PCT Filed: May 1, 2020

(86) PCT No.: PCT/GB2020/051084

§ 371 (c)(1),
(2) Date: Oct. 6, 2021

(87) PCT Pub. No.: WO2020/225542

PCT Pub. Date: Nov. 12, 2020

(65) Prior Publication Data

US 2022/0205335 A1 Jun. 30, 2022

(30) Foreign Application Priority Data

May 3, 2019 (GB) ..... 1906260
May 6, 2019 (GB) ..... 1906364

(51) Int. Cl.
*E21B 17/01* (2006.01)
*E21B 17/08* (2006.01)
(Continued)

(52) U.S. Cl.
CPC ..... *E21B 33/085* (2013.01); *E21B 17/01* (2013.01); *E21B 17/085* (2013.01); *E21B 21/08* (2013.01)

(58) Field of Classification Search
CPC ..... E21B 17/01; E21B 17/085; E21B 21/08; E21B 33/085
See application file for complete search history.

(56) References Cited

U.S. PATENT DOCUMENTS 4,349,205 A * 9/1982 McGee ..... E21B 33/1216 277/584
4,718,679 A * 1/1988 Vyvial ..... E21B 33/03 277/328

(Continued)

FOREIGN PATENT DOCUMENTS

EP 0202726 2/1986
EP 0202726 4/1992

(Continued)

OTHER PUBLICATIONS

Patent Cooperation Treaty; PCT/GB2020/051084; International Search Report and Written Opinion; Nov. 8, 2020.

(Continued)

*Primary Examiner* — Matthew R Buck
(74) *Attorney, Agent, or Firm* — Morgan, Lewis & Bockius LLP

(57) ABSTRACT

An actuatable sealing mechanism for sealing a fluid channel provided between two co-axially arranged tubular members having a central longitudinal axis. The actuatable sealing mechanism comprises an elastomeric seal, an axially moveable actuating sleeve member (1400; 2400; 3020) and a radially moveable activating member. The activating member is configured to be moveable in a radial direction in use to translate the actuatable sealing mechanism between an unsealed state and a sealed state. When it is in the sealed state, the activating member axially compresses the elastomeric seal sufficiently to expand the elastomeric seal in the said radial direction to seal the fluid channel.

23 Claims, 27 Drawing Sheets

(51) Int. Cl.
*E21B 21/08* (2006.01)
*E21B 33/08* (2006.01)

(56) References Cited

U.S. PATENT DOCUMENTS

| | | | | |
|---|---|---|---|---|
| 4,907,812 | A * | 3/1990 | Meyer | F16J 15/48 277/328 |
| 2003/0213601 | A1 | 11/2003 | Schwendemann et al. | |
| 2008/0105434 | A1 | 5/2008 | Orbell et al. | |
| 2009/0071641 | A1 | 3/2009 | Gaudette et al. | |
| 2009/0315277 | A1 | 12/2009 | Iwamoto et al. | |
| 2010/0148447 | A1 | 6/2010 | Halling | |
| 2015/0218903 | A1 | 8/2015 | Sellers et al. | |
| 2016/0369586 | A1 | 12/2016 | Morehead et al. | |

FOREIGN PATENT DOCUMENTS

| | | |
|---|---|---|
| GB | 2398312 | 8/2004 |
| GB | 2503981 | 1/2014 |
| GB | 2524404 | 9/2015 |
| GB | 2540963 | 2/2017 |
| WO | 0150043 | 7/2001 |
| WO | 2014038956 | 3/2014 |
| WO | 2016186643 | 11/2016 |
| WO | 2018229457 | 12/2018 |
| WO | 2019098993 | 5/2019 |

OTHER PUBLICATIONS

Intellectual Property Office of Singapore; Written Opinion; Appn 11202110467W; Jul. 3, 2023.
European Examination Report; 2Appn 0726520.8; May 30, 2023.
Intellectual Property Office—GB2113150.3; Feb. 17, 2022; Search Report under Section 17.
Intellectual Property Office—GB2113150.3; Feb. 18, 2022; Combined Search and Examination Report under Section 17 & 18(3).
Intellectual Property Office, GB; GB2006478.8; Combined Search and Examination Report under Sections 17 & 18(3); May 4, 2021.
Intellectual Property Office, GB; GB2006478.8; Search Report under Section 17; Oct. 26, 2020.
Intellectual Property Office, GB; GB1906260.3; Aug. 3, 2019.

* cited by examiner

APPARATUS AND METHOD RELATING TO MANAGED PRESSURE DRILLING

BACKGROUND OF THE INVENTION

The present invention relates to an apparatus and method relating to managed pressure drilling and in particular relates to a managed pressure drilling (MPD) integration joint comprising a rotating control device (RCD) and/or an annular seal.

When drilling for offshore hydrocarbons, some target reservoirs are located in difficult formations such as clastic, carbonate or pre-salt formations. Such formations require managed pressure drilling (MPD) in which the drill string is run through a riser and the pressure of the returning drilling fluid is controlled within the annulus between the outside of the drill string and the inner through bore of the riser.

The drilling fluid is typically pumped down the drill string and exists the bottom of the drill string through the BHA and the drill bit and returns up the annulus between the outside of the drill string and the inside of the riser. Deep water MPD systems typically include an integration joint, which typically consists of three or more components all connected in line in the riser system. These three components typically comprise an annular seal within a separate tubular and an RCD located above the annular seal within its own separate tubular, where the integration joint is located in line/in series within the riser string above an MPD flow spool and below a telescopic joint. The RCD, the annular seal and the MPD flow spool along with the other components in the riser system all act together to enable closed loop drilling in deep water environments.

The RCD permits passage of the drill string through the riser but also seals around the drill string whilst permitting rotation of it thereby preventing pressurised drilling fluid from passing further up the annulus in the riser string. Accordingly, the RCD forces the returning drilling fluid to flow out of the annulus in the riser string and through goose necks provided at each side of the MPD flow spool where the goose necks are attached to drilling fluid return hoses.

Additional information and drawings regarding conventional integrated MPD systems can be read in Volume 76, Issue 10 of Offshore magazine and at the time of writing an online version is available at:—https://www.offshore-mag.com/articles/print/volume-76/issue-10/drilling-and-completion/integrated-mpd-system-aids-drillin-operation-offshore-brazil.html The skilled person will understand that because the different components that make up the integration joint (ie the RCD and the annular seal) are all located in line/series in separate tubular joints (each being around 20 feet in length) within the riser system, conventional MPD systems are relatively long/high in length and this carries the disadvantage that the MPD flow spool is relatively low compared to the moon pool of the drilling vessel in question and therefore it can be difficult for the operator to connect the drilling return fluid hoses to the goose neck outlet ports.

Moreover, because the different components that make up the integration joint (ie the RCD and annular seal) are all located in line/series in separate joints within the riser system and each tubular joint is connected to the next by a flange and bolting arrangement, it can be very difficult and very time consuming for an operator to change out for example one of the annular seals (eg if it is worn) for a new annular seal. Moreover, because the riser string needs to be broken out to enable that tubular annular seal to be removed from the string to allow for the new annulus seal to be included in the string, the operator loses the ability to control the pressure within the riser system and indeed the whole drill string must first be removed from the riser string.

It is an object of the present invention to eliminate or ameliorate some or all of the above-noted disadvantages.

SUMMARY OF THE INVENTION

According to a first aspect of the present invention, there is provided an actuatable sealing mechanism for sealing a fluid channel provided between two co-axially arranged tubular members, the actuatable sealing mechanism comprising:— an elastomeric seal, an axially moveable actuating sleeve member; and a radially moveable activating member;

wherein the activating member is configured to be moveable in a radial direction in use to translate the actuatable sealing mechanism from an unsealed state to a sealed state, whereby in the unsealed state the activating member does not move the actuating sleeve member sufficiently in a first axial direction to axially compress the elastomeric seal sufficiently to expand the elastomeric seal in a radial direction to seal the fluid channel, and in the sealed state, the activating member axially compresses the elastomeric seal sufficiently to expand the elastomeric seal in the said radial direction to seal the fluid channel.

Preferably, the activating member is configured to be moveable in a radial inwards direction in use to translate the actuatable sealing mechanism from the unsealed state to the sealed state.

Typically, in the unsealed state the activating member does not move the actuating sleeve member sufficiently in a first axial direction to axially compress the elastomeric seal sufficiently to expand the elastomeric seal in a first radial direction to seal the fluid channel, and in the sealed state, the activating member axially compresses the elastomeric seal sufficiently to expand the elastomeric seal in the first radial direction to seal the fluid channel.

The actuatable sealing mechanism provides a means for selectively sealing a fluid channel whilst allowing the seal to retract from the channel when not required such that the seal will not be in contact with a face which is moving relative to it and could damage it. The elastomeric nature of the seal provides the further advantage that it will inherently return to its original shape of the unsealed state, and in doing so, force the actuating sleeve member to axially move back to its original position in the unsealed state, when the activating member is moved in the second radial direction to return it to the unsealed state.

Preferably, the fluid channel is an annulus. The actuatable sealing mechanism being configured for sealing an annulus is advantageous as it allows an annulus between two types or tubulars, one within the other, to be selectively sealed and then unsealed when it is required to move the tubulars relative to each other, thus not damaging the elastomeric seal during the relative movement of the tubulars.

Preferably, the elastomeric seal is ring-shaped. The elastomeric ring shaped seal allows the actuatable sealing mechanism to provide a seal around the entire annulus.

Preferably, the actuating sleeve member is ring-shaped. The ring shaped actuating sleeve member is advantageous as it allows the elastomeric ring shaped seal to be pressed upon and be forced to move at all points around its circumference, from the unsealed position adopted by the elastomeric ring shaped seal when in the unsealed state to the sealed position adopted by the elastomeric ring shaped seal when in the sealed state. Preferably, the elastomeric ring-shaped seal and the ring-shaped axially moveable actuating sleeve member are arranged such that they share a central axis, the central axis projecting through the centre of the elastomeric ring-shaped seal and the ring-shaped axially moveable actuating sleeve member such that each is radially disposed from the central axis, preferably on the same radius from the central axis. This allows the elastomeric ring shaped seal and ring shaped axially moveable actuating sleeve member to be axially aligned with a substantially matching diameter such that movement of the ring shaped axially moveable actuating sleeve member in a first axial direction will cause compression of the elastomeric ring shaped seal in the same axial direction at all points around its circumference. Furthermore, the alignment of the central axes ensures that the elastomeric ring shaped seal is uniformly compressed axially, which is required for optimum compression in the first axial direction to cause expansion in the first radial direction to perform the sealing function. Preferably, the first axial direction is in a direction of the central axis of the elastomeric ring-shaped seal and ring-shaped actuating sleeve member and more preferably is in a first axial direction parallel to the central longitudinal axis of the elastomeric ring shaped seal and ring shaped actuating sleeve member and most preferably is movement of the actuating sleeve member in an axial direction toward the seal, and the first radial direction is preferably perpendicular to the first axial direction and more preferably is in the direction radially outward from or radially inward towards the central axis. This configuration allows the activating member to move radially outwards or inwards as required to axially compress the elastomeric ring shaped seal (by means of the axial movement of the actuating sleeve member in the first axial direction) such that it radially expands into the fluid channel in the same direction in which the activating member radially moves and therefore expands the elastomeric ring shaped seal radially into the annulus of the fluid channel to be sealed. This arrangement and in particular the presence of the axially moving actuating sleeve member has the further advantage that the elastomeric seal is capable of being radially expanded into the fluid channel by means of being axially compressed, even though that movement is caused by the radially moving activating member, which means that the elastomeric seal will suffer minimal or no degradation by such movement (which would of course not be the case if the radially moveable activating member was arranged to directly axially compress the elastomeric seal whilst also moving radially).

Preferably, the elastomeric ring-shaped seal has one of an internal or external surface which is shaped to register with a surface of the annulus of the fluid channel to be sealed, such that the elastomeric seal is configured to expand radially into the annulus of the fluid channel to be sealed upon axial compression of the elastomeric seal by the axially moveable actuating sleeve member. The registration of the internal or external surface of the elastomeric ring shaped seal with the surface of the annulus of the fluid channel ensures that the elastomeric ring shaped seal will expand radially upon axial compression, thus ensuring that when the axially moveable actuating sleeve member presses on the elastomeric ring shaped seal the elastomeric ring shaped seal will expand enough to sufficiently seal the annulus of the fluid channel.

Preferably, the elastomeric ring shaped seal comprises an elastically deformable resilient seal in accordance with the third aspect of the present invention.

Typically, the radially moveable activating member is configured to be moved from the unsealed state to the sealed state by a movement mechanism and in some embodiments, the movement mechanism further comprises a locking means such that the radially moveable activating member is capable of being pushed from the unsealed state to the sealed state by the movement mechanism and is preferably further capable of being locked in the sealed state by the locking means. This allows the radially moveable activating member to be operated to push or axially compress the elastomeric seal and thereby radially expand the elastomeric into the sealed state, and then to maintain the elastomeric seal locked in the sealed state, when required.

Preferably, the elastomeric seal is of a sufficiently resilient material such that it is configured to bias or push the axially moveable actuating sleeve member from the sealed state to the unsealed state, when permitted to do so. This provides a configuration wherein the elastomeric seal can move the axially moveable actuating sleeve member back to the unsealed state when the radially moveable activating member is moved from the sealed state to the unsealed state. Providing a sufficiently resilient material for the elastomeric seal removes a requirement to provide another means to move the axially moveable actuating sleeve member back to the unsealed state. This reduces the number of components required and the complexity of the system, and also improves ease of manufacture.

In certain embodiments of the present invention, the elastomeric seal is a first elastomeric seal and the axially moveable actuating sleeve member is a first axially moveable actuating sleeve member, the actuatable sealing mechanism further comprising a second elastomeric seal and a second axially moveable actuating sleeve member. The provision of a second elastomeric seal and second axially moveable actuating sleeve member provides redundancy for the first axially moveable actuating sleeve member and first elastomeric seal. This provides a backup should the first axially moveable actuating sleeve member or first elastomeric seal fail to operate. Furthermore, in some industries where embodiments of the invention could be implemented, it may not be permitted to only provide a single seal, particularly where the seal is used to retain high pressure fluid. The use of a second elastomeric seal and second axially moveable actuating sleeve member provides redundancy for the first elastomeric seal and first axially moveable actuating sleeve member.

Preferably, the second elastomeric seal is a seal in accordance with the first elastomeric seal, and second axially moveable actuating sleeve member is an axially moveable actuating sleeve member in accordance with the first axially moveable actuating sleeve member, wherein the second axially moveable actuating sleeve member is configured to move in a second axial direction, preferably opposite to the first axial direction, to compress the second elastomeric seal. The use of the second elastomeric seal and second axially moveable actuating sleeve member being the same as the first elastomeric seal and first axially moveable actuating sleeve member provides reliable redundancy for the first axially moveable actuating sleeve member and first elastomeric seal.

Preferably, the radially moveable activating member is configured to engage the first and second axially moveable actuating sleeve members, and move the first and second axially moveable actuating sleeve members from the unsealed state to the sealed state. Furthermore, the radially moveable activating member being configured to engage both axially moveable actuating sleeve members allows the radially moveable activating member to simultaneously activate both axially moveable actuating sleeve members and as such to actuate both respective elastomeric seals in one movement, simplifying the operation of the actuatable sealing mechanism.

Preferably, the radially moveable activating member comprises one or more tapered face. Preferably, the first (and if present second) axially moveable actuating sleeve member(s) each comprise a tapered face for engagement with the tapered face of the radially moveable activating member. The provision of a tapered face allows the radially moveable activating member to be pushed against the first (and if present second) axially moveable actuating sleeve member(s) such that as it is pushed further, after engagement therewith, it is adapted to move the first (and if present second) axially moveable actuating sleeve member(s) from the unsealed position to the sealed position. The tapered face allows movement in one direction (radial) to be translated into movement in another direction (axial) to move the first axially moveable actuating sleeve member in that direction while simultaneously (if present) moving the second axially moveable actuating sleeve member in a direction opposite to the first axially moveable actuating sleeve member. This greatly simplifies the operation of the actuatable sealing mechanism as the radially moveable activating member has to only make one movement to activate one and if a second is present both axially moveable actuating sleeve member.

Preferably, when both a first and a second axially moveable actuating sleeve members are present, they are configured to be spaced apart such that the radially moveable activating member can be inserted between the said pair of axially moveable actuating sleeve member to move the said pair of axially moveable actuating sleeve member from the unsealed state to the sealed state. This allows for the radially moveable activating member to make one movement to move both the first axially moveable actuating sleeve member and the second axially moveable actuating sleeve member from the unsealed state to the sealed state. Preferably, the radially moveable activating member comprises a first dimension corresponding to a distance the first and second axially moveable actuating sleeve members are spaced apart in the unsealed state, and a second dimension corresponding to a distance the first and second axially moveable actuating sleeve members are spaced apart in the sealed state. This allows the radially moveable activating member to be able to be aligned between the two axially moveable actuating sleeve members such that it can be further inserted to move each of the axially moveable actuating sleeve members from the unsealed state to the sealed state i.e. when the radially moveable activating member is inserted far enough that the second dimension is in line with and pushing against the first and second axially moveable actuating sleeve members.

Typically, the radially moveable activating member is moveable in either radial direction that is perpendicular to the central longitudinal axis of the axially moveable actuating sleeve members, and most preferably is moveable in one radial direction when moving the actuatable sealing mechanism from the unsealed state to the sealed state and may be moveable in the other radial direction when moving the actuatable sealing mechanism from the sealed state to the unsealed state.

Preferably, the tapered face of the radially moveable activating member tapers from the first dimension to the second dimension such that in use the tapered face of the radially moveable activating member engages and pushes the first (and second if present) axially moveable actuating sleeve member(s) from the unsealed state to the sealed state. The use of the tapered face allows the radial movement of the activating member to be translated into axial movement of the first (and second if present) axially moveable actuating sleeve member(s). This allows one motion of the radially moveable activating member to move the actuatable sealing mechanism from the unsealed state to the sealed state. It further provides the advantage of allowing a smooth transition between these two states, which is desirable so as not to overly stress any of the materials which form the component parts of the actuatable sealing mechanism.

Preferably, a first tubular is provided within a second tubular, wherein the annulus of the fluid channel to be sealed is formed between the outer circumferential surface of the first tubular and the inner circumferential surface of the second tubular. The annulus to be sealed being the gap between these two tubulars allows embodiments of the invention to be used in many applications where an annulus of this kind must be sealed. Particularly, embodiments of the invention may be applied to two oil and gas tubulars used within for example a riser configuration or a pipeline. These are just examples of such application where it is often desirable to seal such an annulus. These are also just examples of applications where redundant seals are often required due to legislation or safety requirements.

Preferably, one of the first and second tubulars comprises a first recessed portion for housing the first axially moveable actuating sleeve member and the first elastomeric seal, and if the second axially moveable actuating sleeve member is present the same said one tubular further comprises a second recessed portion for housing the second axially moveable actuating sleeve member and the second elastomeric seal. This allows the first tubular to be run inside of or located at least partially within the second tubular, typically in a co-axial manner, with the first (and if present second) axially moveable actuating sleeve member(s) and first (and if present second) elastomeric seals being in the unsealed state which allows for relative axial movement (which may typically be telescopic movement) of the first and second tubulars to occur without causing damage to either of the first (and if present second) elastomeric seals. The recessed portion effectively hides the first (and if present second) elastomeric seals in a retracted position away from the other of the first and second tubular such that the first (and if present second) elastomeric seals cannot be damaged or otherwise suffer from excessive friction.

The said one of the first and second tubulars comprising a first recessed portion for housing the first axially moveable actuating sleeve member and the first elastomeric seal, and a second recessed portion for housing the second axially moveable actuating sleeve member and the second elastomeric seal when the second seal is present also provides the advantage that the first axially moveable actuating sleeve member and first elastomeric seal can be housed in a first recessed portion which can be separate from a second recessed portion which houses the second axially moveable actuating sleeve member and the second elastomeric seal. Particularly, the first recessed portion and the second recessed portion may be separate recessed portions if each of the first recessed portion and the second recessed portion are formed in or provided in different components (of an integration joint assembly for example). In this regard, the first recessed portion may be located in an RCD, for example, and the second recessed portion may be located in an upper packer cartridge, for example. On the other hand, the first recessed portion and second recessed portion may be the same recessed portion or may be viewed as the same recessed portion within a part of a single component of an integration joint assembly, for example. In this regard, the first recessed portion and second recessed portion may be recessed into a single component of the integration joint assembly, for example it or they may be recessed into an RCD or a lower packer cartridge or upper packer cartridge, for example.

Either of the said one or the other of the first and second tubular may house the radially moveable activating member.

In certain embodiments, the said one of the first and second tubular houses the radially moveable activating member.

Preferably, in all embodiments, the second (outer) tubular houses the radially moveable activating member, typically on its outer surface.

Typically, the radially moveable activating member is positioned on the outer of the first and second tubulars, such that the radially moveable activating member is moveable in the inwardly radial direction (i.e. towards the central longitudinal axis of the axially moveable actuating sleeve members) when moving the actuatable sealing mechanism from the unsealed state to the sealed state and may be moveable in the outwardly radial direction (i.e. away from the central longitudinal axis of the axially moveable actuating sleeve members) when moving the actuatable sealing mechanism from the sealed state to the unsealed state.

The radially moveable activating member may be operated by a powered movement mechanism such as a hydraulic movement mechanism for example, which may be connected to the radially moveable activating member located on the second (outer) tubular.

In some embodiments, the second (outer) tubular comprises both the recessed portion for housing the axially moveable actuating sleeve member(s) and the first elastomeric seal, and also houses the radially moveable activating member typically on its outer surface. Embodiments having this arrangement may find particular utility in, for example, telescoping barrel assemblies for use in pipes and pipelines to accommodate expansion and contraction therein.

In some other embodiments, whilst the radially moveable activating member is housed or mounted on the outer tubular, the first (and if present second) seal is/are located on (ie around the outer circumference of) the inner tubular thus providing an actuatable sealing mechanism capable of remote activation of the elastomeric seals to seal the annulus.

Optionally, in certain embodiments, the locking means can further comprise a first part of a latch mechanism being provided in association with the radially moveable activating member further, and a second part of a latch mechanism being provided in association with the first tubular, wherein the first and second parts can be engaged to provide a lock therebetween, and more preferably provide a lock to prevent movement and most preferably prevent axial movement occurring between the first and second tubulars. The first and second parts of the latch mechanism preferably comprise a latch member and a slot into which the latch member can move. Preferably, the first tubular comprises the slot for receiving the radially moveable activating member therein. Preferably, the slot is formed around the outer circumference of the first tubular and the latch member is provided on a radially innermost end of the radially moveable activating member, such that inwards radial movement of the activating member firstly axially moves the actuating sleeve member(s) to axially compress and thereby radially expand the elastomeric seal(s) and secondly moves the latch member into the said slot to provide the axial lock between the first and second tubulars. Preferably, the slot is sized and configured such that when the radially moveable activating member is received therein, the first and second tubulars cannot move axially relative to each other. This stops relative axial movement of the first and second tubulars and so axially locks the actuatable sealing mechanism when the radially moveable activating member is moved from the unlocked state to the locked state. This provides a configuration wherein the latch member of the radially moveable activating member can be securely engaged within the said slot of the first tubular to effectively arrest the movement of the first tubular with respect to the second tubular.

Such embodiments allow the actuatable sealing mechanism to provide both a locking and sealing function. Preferably, such embodiments of the locking means are configured such that in use in the sealed state the first and second tubulars cannot move relative to each other, and in the unsealed state the first and second tubulars can move relative to each other. This provides such embodiments with the advantage wherein, when the locking means is moved from the unlocked state to the locked state, the two tubulars cannot move relative to each other. This has the further advantage of protecting the elastomeric seal which is moved from the unsealed state to the sealed state as the radially moveable activating member moves from the unlocked state to the locked state. Furthermore, in addition to those advantages, such embodiments of the locking means has a dual function in that it arrests the movement of the two tubulars relative to each other, whilst activating the first (and if present second) axially moveable actuating sleeve member(s) to radially move the elastomeric seals to seal the annulus between the two tubulars.

According to a second aspect of the present invention, there is provided a method of sealing a fluid channel provided between two co-axially arranged tubular members comprising the steps of:—

- providing an actuatable sealing mechanism in accordance with the first aspect; and
- moving the radially moveable activating member radially towards a central longitudinal axis of the tubular members,
- which said radial movement results in axial movement of at least one moveable actuating sleeve member,
- and which said axial movement results in compression of the elastomeric seal in an axial direction,
- and which said axial movement results in expansion of the elastomeric seal in a radial direction such that the actuatable sealing mechanism is translated from the unsealed state to a sealed state to seal the fluid channel.

This provides a method of selectively sealing a fluid channel, and also provides a method of retracting the seal away from the fluid channel when it is not required to be in the sealed position.

Preferably, the step of providing an actuatable sealing mechanism may further comprise providing a second elastomeric seal and a second axially moveable actuating member and which may be similar to the first elastomeric seal and first axially moveable actuating sleeve member. This provides a method wherein the activation of a first and second elastomeric seal causes the sealing of a fluid channel at two points, thus providing sufficient sealing redundancy.

Preferably, the step of moving the first axially moveable actuating sleeve member to compress the first elastomeric seal in the first axial direction such that the first elastomeric seal is expanded in a radial direction to seal the channel may further comprise moving the second axially moveable actuating sleeve member in a second axial direction (which is preferably opposite to the first axial direction) to axially compress the second elastomeric seal. This allows the movement of one component in the form of the radially moveable activating member between the two axially moveable actuating sleeve members to move the axially moveable actuating sleeve members in opposite axial directions which will in turn move each of the respective first and second elastomeric seals radially to seal the fluid channel.

Preferably, the method further comprises the step of inserting a radially moveable activating member between the first axially moveable actuating sleeve member and the second axially moveable actuating sleeve member to push the first and second axially moveable actuating sleeve member from the unsealed state to the sealed state. The use of a radially moveable activating member being inserted between the first and second axially moveable actuating sleeve member allows just one component to be inserted and the resultant effect is that both elastomeric seals are activated by this one component (the radially moveable activating member). This provides a method which is simple but effective to operate both elastomeric seals. The simplicity of the design improves reliability, ease of manufacturing and simplifies and reduces the cost of maintenance.

Preferably, the method further comprises the step of moving the first tubular relative to the second tubular with the actuatable sealing mechanism in the unsealed state. This allows the first and second tubular members to be moved without damaging the elastomeric seal, thus ensuring that the elastomeric seal is in working order when required and reducing the maintenance required on the elastomeric seal. Reducing the wear on the elastomeric seal in this way helps to improve the reliability of the actuatable sealing mechanism, and reduces failures.

According to a third aspect of the invention, there is provided an elastically deformable resilient annular seal for installation into an annular groove, wherein in cross-section the seal comprises:

- a substantially flat tubular surface for contact with a circumferential and flat surface of the annular groove;
- a convex sealing surface opposite the said flat surface; and
- a first convex connecting surface and a second convex connecting surface;
- wherein each of the first and second connecting surfaces connect the convex sealing surface to the said flat surface.

Optionally the said substantially flat tubular surface is an inner circumferential surface of the seal.

Alternatively, the said substantially flat tubular surface is an outer circumferential surface of the seal.

Typically, the first convex connecting surface comprises:—

- a first end which connects it to a first end of the said flat surface; and
- a second end which connects it to a first end of the convex sealing surface.

Typically, the second convex connecting surface comprises:—

- a first end which connects it to a second end of the said flat surface; and
- a second end which connects it to a second end of the convex sealing surface.

Preferably, the junction between the first end of the said flat surface and the first end of the first convex connecting surface comprises a rounded corner having a radius thereon. This has the advantage of reducing the shear stress experienced at that junction.

Preferably, the junction between the second end of the said flat surface and the first end of the second convex connecting surface comprises a rounded corner having a radius thereon. This also has the advantage of reducing the shear stress experienced at that junction particularly during axial compression of the seal.

Preferably, the first convex connecting surface comprises a curved surface which gradually arcs from its first end to its second end toward a radius plane (i.e. the plane that is perpendicular to the longitudinal central axis of the seal) such the second end of the first convex connecting surface lies on the radius plane in a direction parallel to the radius plane.

Preferably, the second convex connecting surface comprises a curved surface which gradually curves from its first end to its second end toward the radius plane (i.e. the plane that is perpendicular to the longitudinal central axis of the seal) such the second end of the second convex connecting surface lies on the radius plane in a direction parallel to the radius plane.

The convex sealing surface comprises a semi-circular or more preferably, a semioval shape, where the first end preferably curves from the midpoint of the convex sealing surface (which is preferably parallel to the longitudinal central axis of the seal) towards its first end in a gradually reducing radius until the first end lies on the radius plane in a direction parallel to the radius plane at which point it meets the first end of the first convex connecting surface, such that there is no corner nor otherwise angled junction between the said two ends. This has the advantage of reducing the shear stress experienced at that area of the seal particularly during axial compression of the seal.

Preferably, the second end of the convex sealing surface curves from the midpoint of the convex sealing surface towards its second end in a gradually reducing radius until the second end lies on the radius plane in a direction parallel to the radius plane at which point it meets the second end of the second convex connecting surface, such that there is no corner nor otherwise angled junction between the said two ends. This also has the advantage of reducing the shear stress experienced at that area of the seal particularly during axial compression of the seal.

According to a fourth aspect of the present invention there is provided an integration joint assembly for use in drilling operations, the integration joint assembly comprising:—

- an integration joint body comprising:—
  - a through bore;
  - an upper end adapted for connection with an upper portion of a riser system; and
  - a lower end adapted for connection with a lower portion of a riser system;
  - the integration joint assembly being adapted to permit a tubular work string to pass there through such that there is an annulus created between the inner through bore of the integration joint body and the outer surface of the tubular work string;
  - wherein the integration joint assembly further comprises at least one sealing device adapted in use to provide a seal within the said annulus; and
  - wherein the said at least one sealing device and the integration joint body are adapted such that the said at least one sealing device is capable of being located within the through bore of the integration joint body such that there is a fluid channel located between the inner surface of the through bore of the integration joint body and the outer surface of the said at least one sealing device; and at least one actuatable sealing mechanism in accordance with the first aspect of the present invention, being arranged to selectively seal said fluid channel.

According to a fifth aspect of the present invention there is provided a method of drilling comprising the step of:— installing an integration joint body according to the fourth aspect of the present invention in a riser string and running a tubular work string through the through bore thereof.

Preferably the integration joint assembly is for use in managed pressure drilling operations and typically the tubular work string is a drill string.

Preferably the said at least one sealing device is adapted to be located co-axially within the through bore of the integration joint body and more preferably the longitudinal length of the integration joint body is longer than the longitudinal length of the said at least one sealing device and more preferably the inner diameter of the integration joint body is greater than the outer diameter of the said at least one sealing device such that the said at least one sealing device is adapted to be wholly located co-axially within the integration joint body and most preferably the said at least one sealing device is adapted to be wholly located co-axially within the through bore of the integration joint body.

Preferably, the said at least one sealing device comprises at least one of:— a rotation control device (RCD); and at least one annular seal device;

wherein at least one of the rotation control device and the annular seal device are adapted to be located within the through bore of the integration joint body. Preferably, the integration joint body is adapted to be able to house both of a rotation control device (RCD) and two annular seal devices within its through bore, preferably in series/in line along its longitudinal length.

Preferably, at least one of the rotation control device and the annular seal device can be:— i) run into the through bore of the integration body, typically through an upper portion of the riser string which typically includes a telescopic joint; and ii) locked to the integration joint body within the through bore of the integration joint body.

Preferably at least one of the rotation control device and the annular seal device are capable of being unlocked from and more preferably retrieved from the through bore of the integration joint body, typically by pulling it upwards through the through bore of the integration joint body and further pulling it upwards through the through bore of the upper portion of the riser system (which may include the telescopic joint).

Preferably the rotation control device is arranged to be located above the annular seal device within the through bore of the integration joint body.

Preferably there are two annular seal devices and more preferably there is an upper annular seal device and a lower annular seal device.

Preferably the rotation control device and the one or more annular seal devices are locked within the through bore by at least one locking device. More preferably, each of the rotation control device and the one or more annular seal devices comprise their own respective locking device.

Typically, the radially moveable activating member according to the first aspect of the present invention comprises the locking device according to the fourth aspect of the present invention.

Preferably the respective locking device of each of the rotation control device and the one or more annular seal devices can be separately locked and unlocked as required.

The rotation control device may be retrieved and run into the through bore on its own by a running/retrieval tool or alternatively, may be retrieved and run into the through bore with at least one of the annular sealing devices.

One or both of the rotation control device and the at least one annular seal device may be located within the through bore of and locked to the integration joint body when the integration joint body is installed within the riser string; or one or both of the rotation control device and the at least one annular seal device may be run into the through bore of the integration body through the through bore of an upper portion of the riser string (which could include the telescopic joint) and be locked to the integration joint body within the through bore of the integration joint body after the integration joint body has been installed within riser string.

Typically, suitable seals such as (but not limited to) O-ring seals, pressure activated seals or mechanically activated seals are provided to act between the outer surface of the RCD and the inner through bore of the integration joint body. Preferably said seals are provided on and/or around the outer circumferential surface of the RCD such that they act to seal the gap between the outer surface of the RCD and the inner through bore of the integration joint body.

Additionally, further suitable seals such as (but not limited to) O-ring, pressure activated seals or mechanically activated seals are typically provided to act between the outer surface of the said at least one annular seal and the inner through bore of the integration joint body. Preferably said seals are provided on and/or around the outer circumferential surface of the said at least one annular seal such that they act to seal the gap between the outer surface of the said at least one annular seal and the inner through bore of the integration joint body.

Typically, suitable seals such as (but not limited to) O-ring, pressure activated seals or mechanically activated seals are provided to act between the adjoining ends of the RCD and the said at least one annular seal.

Preferably the integration joint body comprises a seat or other formation formed on its inner through bore preferably at a location on its inner diameter and which prevents the rotation control device and the one or more annular seal devices from moving any lower through the integration joint body than said seat. Typically, the said seat is a formation formed on the inner diameter of the integration joint body and more preferably said formation comprises a narrower inner diameter load bearing shoulder than the outer diameter of at least a portion of the rotation control device and the one or more annular seal devices such that the said portion seats upon said shoulder and thus any further downward movement of the rotation control device and the one or more annular seal devices is arrested. Typically, the said formation comprises a narrower inner diameter load bearing shoulder than the outer diameter of at least a portion of a lowermost annular seal device.

Typically, the RCD comprises an RCD body member and at least one and preferably two seals which more preferably are rotatable with respect to the RCD body member. Typically, the RCD further comprises a bearing to couple each respective seal to the RCD body member such that the said each respective seal is rotatable on the bearing with respect to the stationary RCD body member such that the said each respective seal seals against and is rotatable with the drill string which passes through the through bore of the integration joint body. Preferably the RCD comprises a pair of longitudinally spaced apart rotatable seals such that the RCD comprises an in use upper most rotatable seal and a lowermost rotatable seal. Preferably each of the upper and lower rotatable seals is formed from a resilient material such as rubber or polyurethane or any other suitable material and has an inner diameter which is a friction fit or comprises a smaller inner diameter that the outer diameter of the drill string such that each of the upper and lower rotatable seals elastically stretches to accommodate the drill string and seals against the outer surface of the drill string such that it does not permit drilling fluid located in the annulus to pass through the through bore of the RCD in the upwards direction from downhole to up-hole.

Typically, each of the said annular seals comprises an in use de-energised or deflated inner diameter which is greater than the outer diameter of the drill string which passes there through such that when each of the said annular seals in use is de-energised it allows the free movement of the drill string there through and therefore does not impede the movement there through and therefore does not seal against the outer diameter of the drill string.

In addition, each of the said annular seals typically comprises an in use energised or inflated inner diameter which is smaller than the outer diameter of the drill string which passes there through such that when each of the said annular seals in use is energised it seals against the outer diameter of the drill string and therefore does not permit drilling fluid located in the annulus to pass through the through bore of the annular seal in the upwards direction from downhole to up-hole. Preferably each annular seal can be selectively energised or de-energised by the respective introduction or removal of fluid from a cavity in fluid communication with a surface of the said annular seal and more preferably said cavity is in fluid communication with an outer surface of the said annular seal such that when fluid is pumped into said cavity, the said annular seal is forced inwards into contact with tubular work string passing through the integration joint body to thereby form a seal in the annulus between the outer surface of the tubular work string and the inner through bore of the integration joint body.

The embodiments of the present invention have many advantages including great flexibility due to the modular nature of the sealing devices and the skilled person will understand that the RCD may be omitted if the riser system in question requires to be run in a conventional mode (not managed pressure drilling) but be able to maintain the ability to operate as a gas handling joint.

Embodiments of the present invention have the great advantage that the riser string does not need to be pulled up and taken apart in order to replace any one or more than one of the rotation control device and the at least one annular seal device because they can be run into and retrieved from the through bore of the integration joint body.

According to a sixth aspect of the present invention there is provided a pipe sealing mechanism for sealing an annular fluid channel between an inner pipe and an outer pipe, the pipe sealing mechanism comprising:— an actuatable sealing mechanism in accordance with the first aspect of the present invention, being arranged to selectively seal said fluid channel.

Preferably, outer tubular comprises both a recessed portion for housing the axially moveable actuating sleeve member and the first elastomeric seal, and also houses the radially moveable activating member, typically on its outer surface. Preferably, the actuatable sealing mechanism is arranged such that inwards radial movement of the activating member firstly axially moves the actuating sleeve member to axially compress and thereby radially expand the elastomeric seal inwards towards the inner tubular until the elastomeric seal seals against the outer circumference of the inner tubular.

According to a seventh aspect of the present invention there is provided a method of sealing an annular fluid channel between an inner pipe and an outer pipe, the method comprising the steps of:— providing a pipe sealing mechanism according to the sixth aspect of the present invention; and actuating the pipe sealing mechanism to seal the said annular fluid channel.

The accompanying drawings illustrate presently exemplary embodiments of the disclosure and together with the general description given above and the detailed description of the embodiments given below, serve to explain, by way of example, the principles of the disclosure.

In the description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments of the present invention are shown in the drawings and herein will be described in detail, with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string. Reference to up or down will be made for purposes of description with the terms "above", "up", "upward", "upper" or "upstream" meaning away from the bottom of the wellbore along the longitudinal axis of a work string toward the surface and "below", "down", "downward", "lower" or "downstream" meaning toward the bottom of the wellbore along the longitudinal axis of the work string and away from the surface and deeper into the well, whether the well being referred to is a conventional vertical well or a deviated well and therefore includes the typical situation where a rig is above a wellhead and the well extends down from the wellhead into the formation, but also horizontal wells where the formation may not necessarily be below the wellhead. Similarly, 'work string' refers to any tubular arrangement for conveying fluids and/or tools from a surface into a wellbore. In the present invention, drill string is the preferred work string.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention.

Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features and advantages of the present invention are readily apparent from the entire description thereof, including the figures, which illustrates a number of exemplary embodiments and aspects and implementations. The invention is also capable of other and different embodiments and aspects and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein including (without limitations) components of the assembly are understood to include plural forms thereof and vice.

BRIEF DESCRIPTION OF AND INTRODUCTION TO THE DRAWINGS

Embodiments of the present invention will now be described, by way of example only and with reference to the accompanying drawings, in which:—

FIG. 1 is a cross-sectional view of a first example of an integration joint tubular body (which is not in accordance with the present invention) and which would be located in line in a riser string below a suitable telescopic joint and above a suitable MPD flow spool (both of which are not shown in FIG. 1) and prior to installation therein of a pair of annular packer seals and a rotating control device (RCD) bearing assembly;

FIG. 2 is a cross-sectional view of the integration joint tubular body of FIG. 1 but where a drill pipe string has been run through the through bore of the integration joint body and into the lower portion of the riser string and conventional (ie non-MPD) drilling can be conducted;

FIG. 3 shows a cross-sectional view of the integration joint body of FIG. 2 but shows the next stage of operation of the integration joint body following on from that of FIG. 2, where a running tool has been included in the drill pipe string and a lower packer annular seal, upper annular packer seal and RCD bearing assembly are run into the inner through bore of the integration joint body and thus the through bore of the riser string in order to form the integration joint assembly of FIG. 1;

FIG. 4 shows the next stage of operation of the integration joint body following on from the previous stage of FIG. 3, where FIG. 4 shows the running tool having fully run in the lower annular packer seal, upper annular packer seal and RCD bearing assembly into the through bore of the integration joint body until the lower end of the lower annular packer seal has landed on a load shoulder of the integration joint body such that the lower annular packer seal, upper annular packer seal and RCD bearing assembly are now located in their in-use position but prior to locking into that in-use position;

FIG. 5 shows the next stage of operation of the integration joint body following on from that shown in FIG. 4, where FIG. 5 shows all locking dogs of the integration joint body have been extended into the through bore of the integration joint body such that they lock the lower annular packer seal, upper annular packer seal and RCD bearing assembly in their locked in-use position and FIG. 5 also shows that the running in tool has been pulled up out of the through bore of the integration joint body to leave the rest of the drill string located therein, such that managed pressure drilling operations can now be conducted;

FIG. 6 follows on from the stage of operation of FIG. 5 if the operator needs to replace one, more than one or all of the RCD bearing assembly, upper and lower annular packer seal cartridges, where the locking dogs of the integration joint body for the RCD bearing assembly have been retracted and a RCD retrieval tool has been included at the upper end of the drill string and has been run in through the RCD bearing assembly and is ready to retrieve the RCD bearing assembly (the retrieval thereof being shown in FIGS. 7 and 8);

FIG. 7 follows on from the stage of operation of FIG. 6 and shows the drill string and the retrieval tool have been raised such that the retrieval tool has picked up and lifted the RCD bearing assembly from its in-use position within the integration joint body;

FIG. 8 shows the next stage on from FIG. 7 where the RCD bearing assembly has been retrieved from and pulled out of the through bore of the integration joint body;

FIG. 9 shows the stage on from FIG. 8 with the RCD bearing assembly having been pulled out of the riser and further shows an upper annular packer seal retrieval tool having been included in the drill string at the upper end thereof and having been lowered into the through bore of the integration joint body and having been locked in to the retrieval profile of the upper annular packer seal, and this stage of operation is utilised if the upper annular packer seal needs to be retrieved and replaced;

Figure 3:
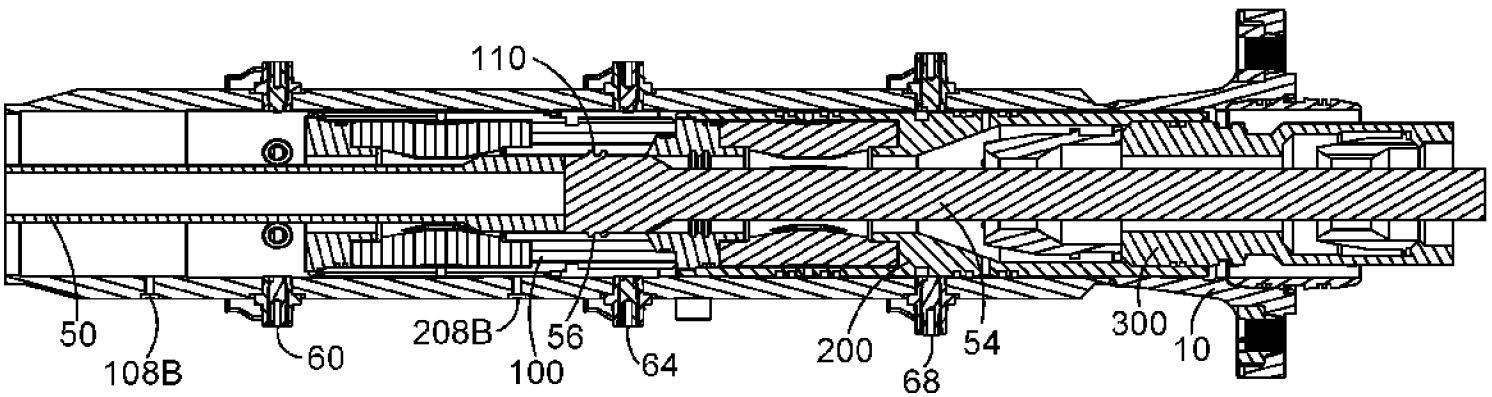
Figure 18:
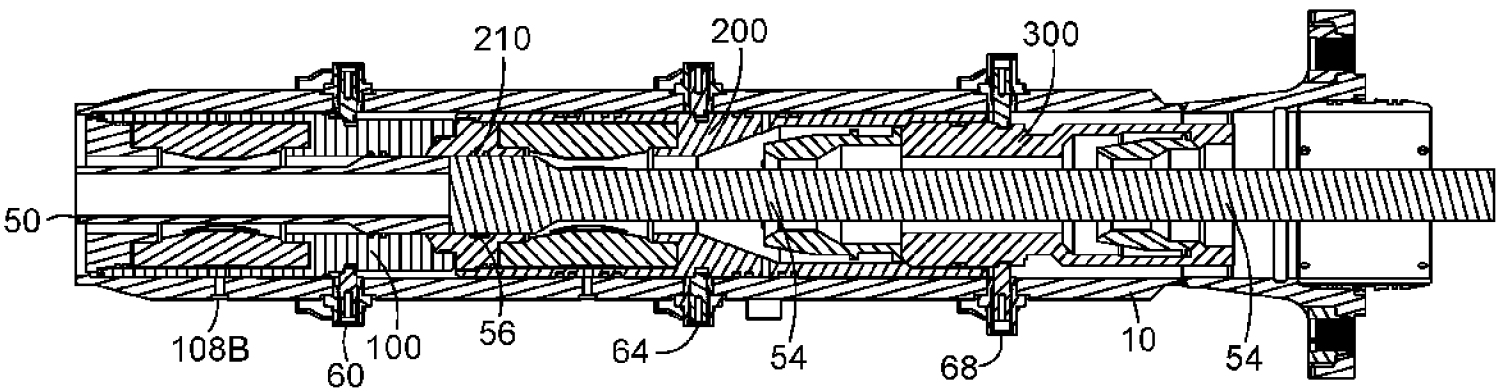
Figure 19:
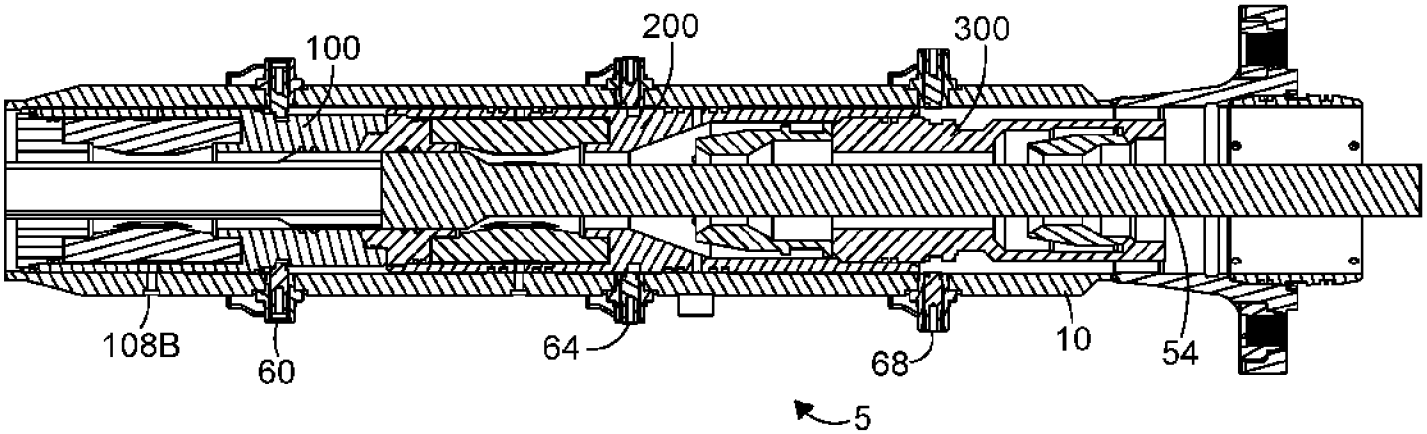
Figure 20:
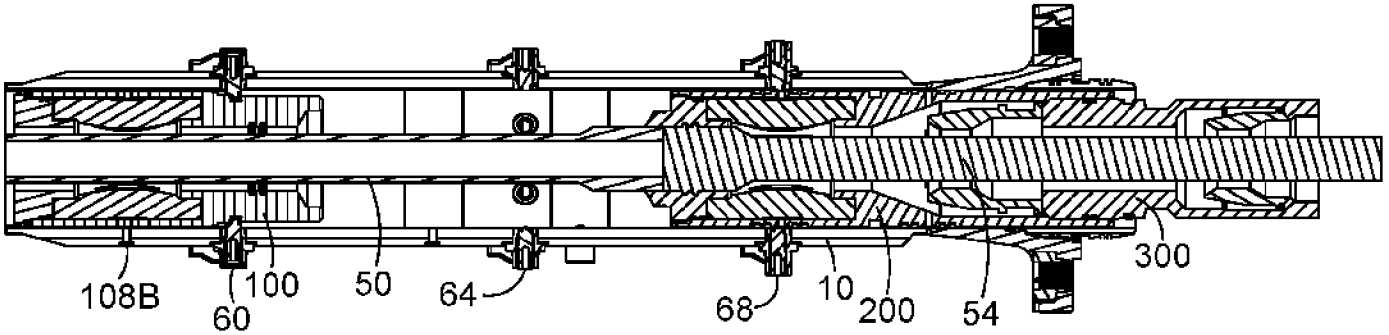
Figure 21:
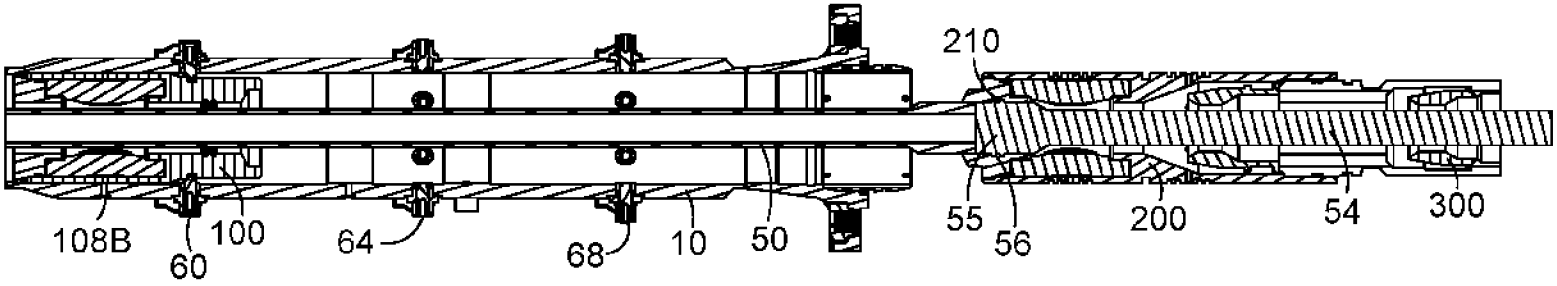
Figure 22:
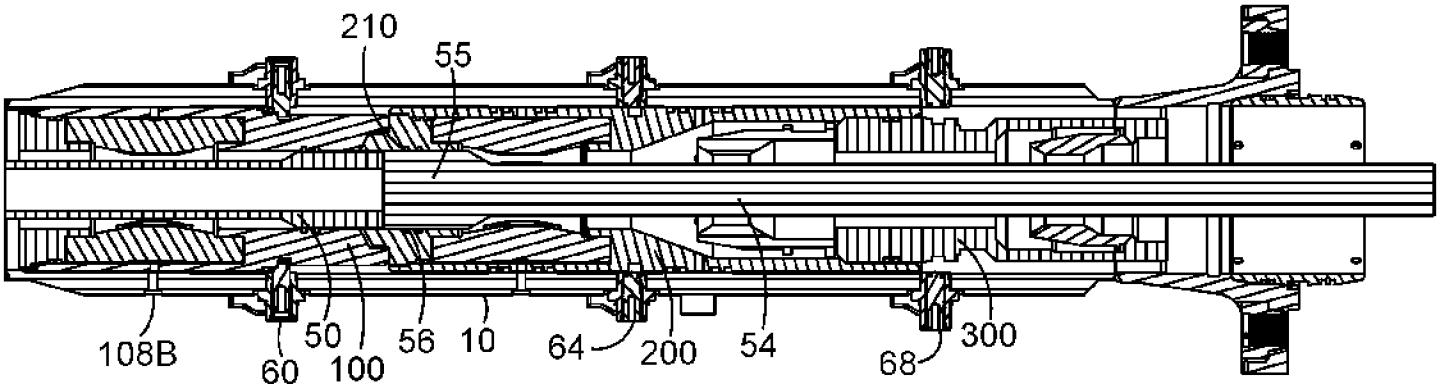
Figure 23:
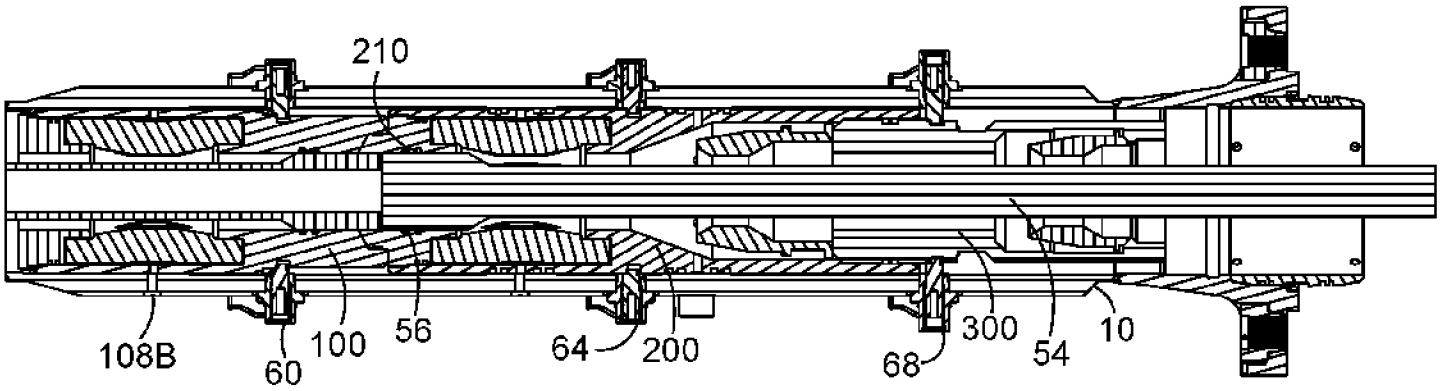
Figure 24:
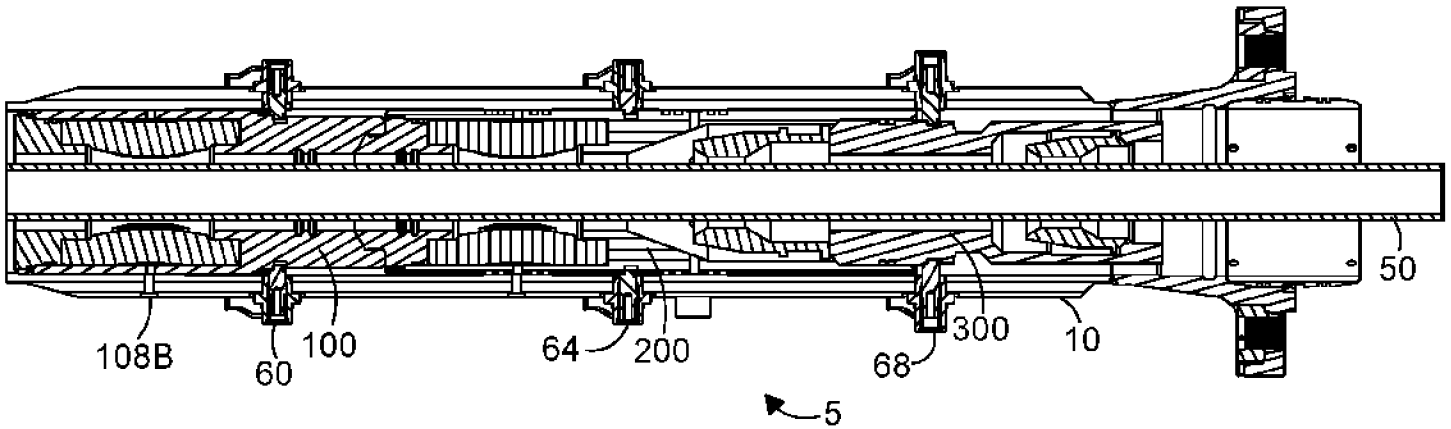
Figure 25A:
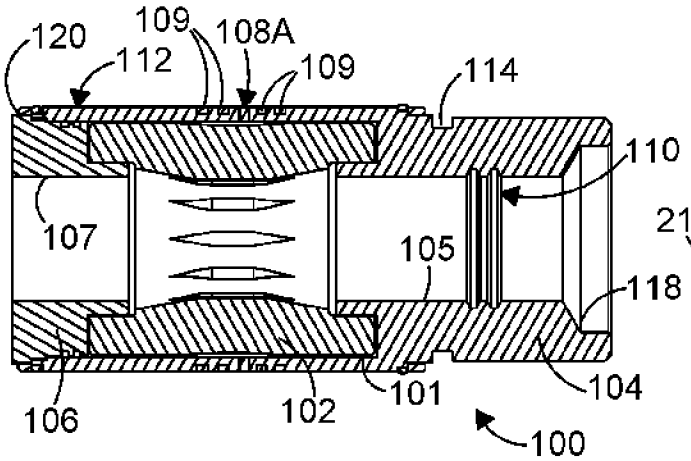
Figure 25B:
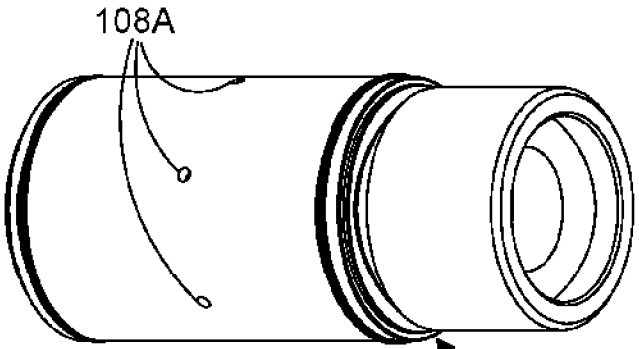

FIG. 18 shows an optional stage that can be commenced if an operator wishes to retrieve the RCD bearing assembly and the upper annular packer seal at the same time but also wishes to leave the lower annular packer seal locked in place within the integration joint body through bore and therefore shows a retrieval tool having been run on the top of the drill string into the through bore of the integration joint body and having been locked into a retrieval profile of the upper annular packer seal;

FIG. 19 shows the next stage on from that of FIG. 18 of the retrieval of the RCD bearing assembly and upper annular packer seal, where the RCD bearing assembly locking dogs and the upper annular packer seal cartridge locking dogs have both been retracted;

FIG. 20 shows the next stage on from that of FIG. 19 of the retrieval of the RCD bearing assembly and upper annular packer seal where the RCD bearing assembly and the upper annular packer seal cartridge are unseated from the lower annular packer seal cartridge and have been lifted by the retrieval tool from the through bore of the integration joint body;

FIG. 21 shows the next stage on from that of FIG. 20 where the RCD bearing assembly and upper annular packer seal cartridge have been completely pulled out of the through bore of the integration joint body;

FIG. 22 shows the next stage on from that of FIG. 21 where a new RCD bearing assembly and new upper annular packer seal cartridge have been run-in on a running tool into the through bore of the integration joint body and have been landed on top of the lower annular packer sealed cartridge;

FIG. 23 shows the next stage on from that of FIG. 22 where the locking dogs for both of the RCD bearing assembly and the upper annular packer seal cartridge have been extended in order to lock the RCD bearing assembly and the upper annular packer seal cartridge in place within the through bore of the integration joint body but the running in tool is still located within the through bore of the integration joint body;

FIG. 24 shows the next stage on from that of FIG. 23 where the running in tool has been pulled from the through bore of the integration joint body to leave the rest of the drill string located therein and thus the integration joint body and the RCD bearing assembly are operating in normal conditions where the RCD bearing assembly is sealing the annulus of the integration joint body;

FIG. 25*a* shows a cross-sectional view of the lower annular packer seal cartridge as used in the integration joint assembly of FIG. 3;

FIG. 25*b* shows a side view of the lower annular packer seal cartridge of FIG. 25*a;*

Figure 26A:
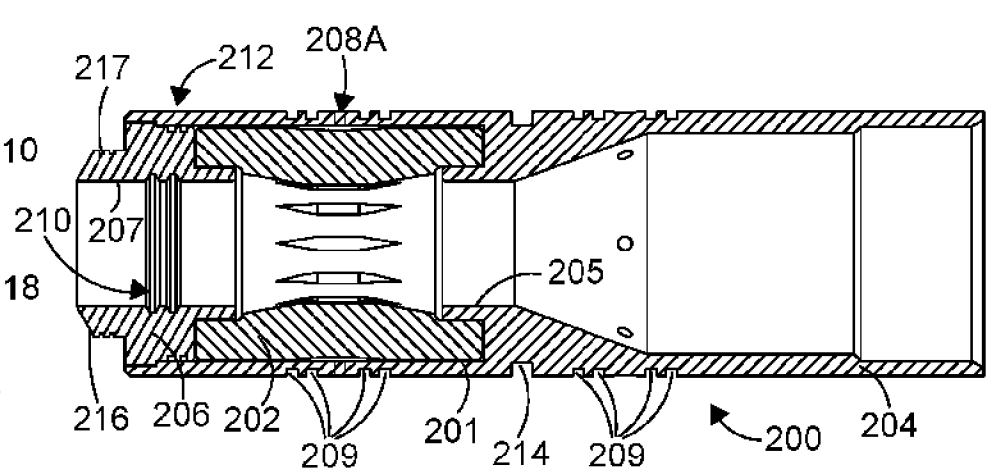
Figure 26B:
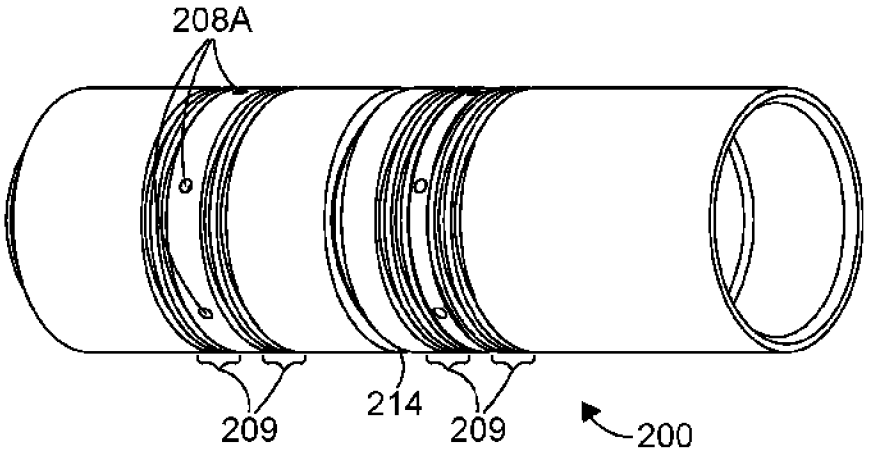

FIG. 26*a* shows a cross-sectional view of the upper annular packer seal cartridge as used in the integration joint assembly of FIG. 3;

FIG. 26*b* shows a side view of the upper annular packer seal cartridge of FIG. 26*a;*

Figure 27A:
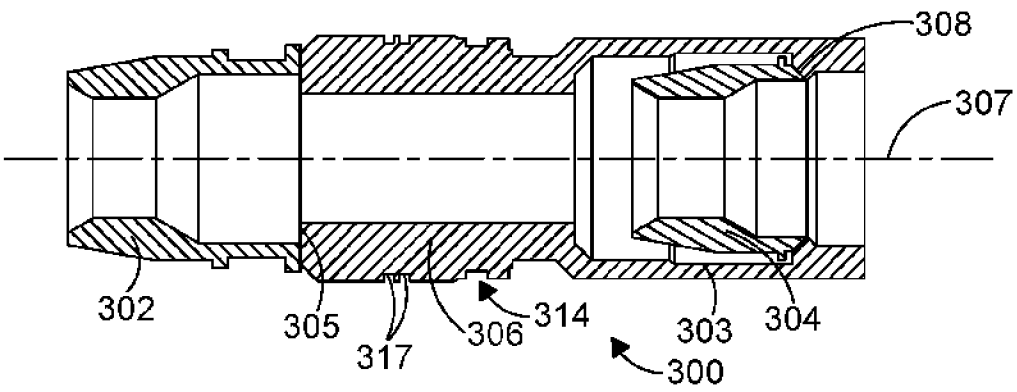
Figure 27B:
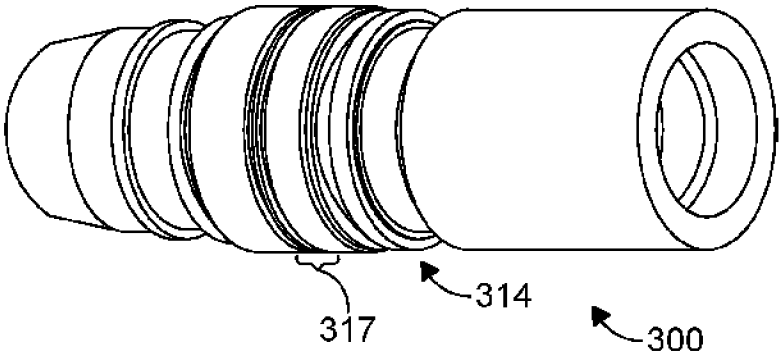

FIG. 27*a* shows a cross-sectional view of the RCD bearing assembly as used in the integration joint assembly of FIG. 3;

FIG. 27*b* shows a side view of the RCD bearing assembly of FIG. 27*a;*

Figure 4:
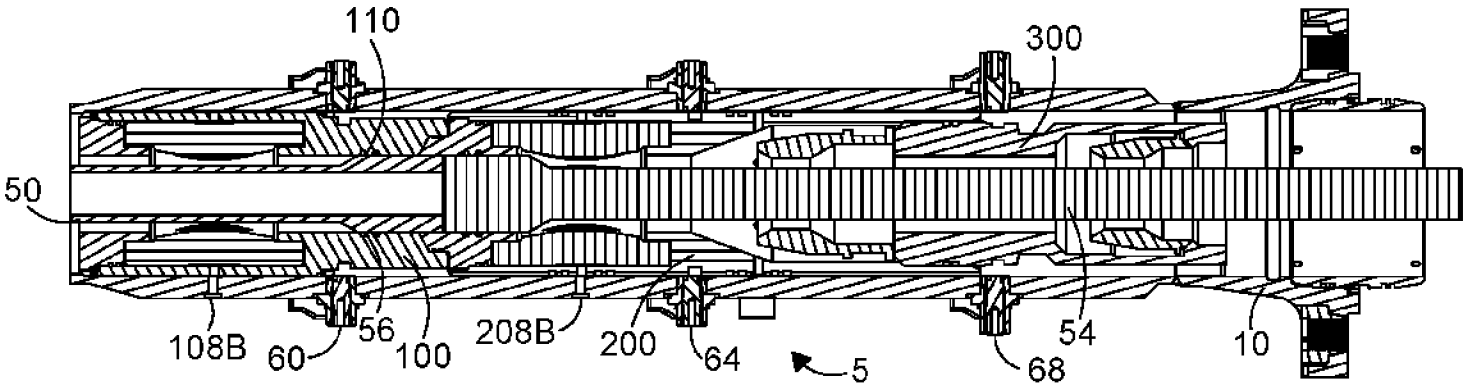
Figure 28:
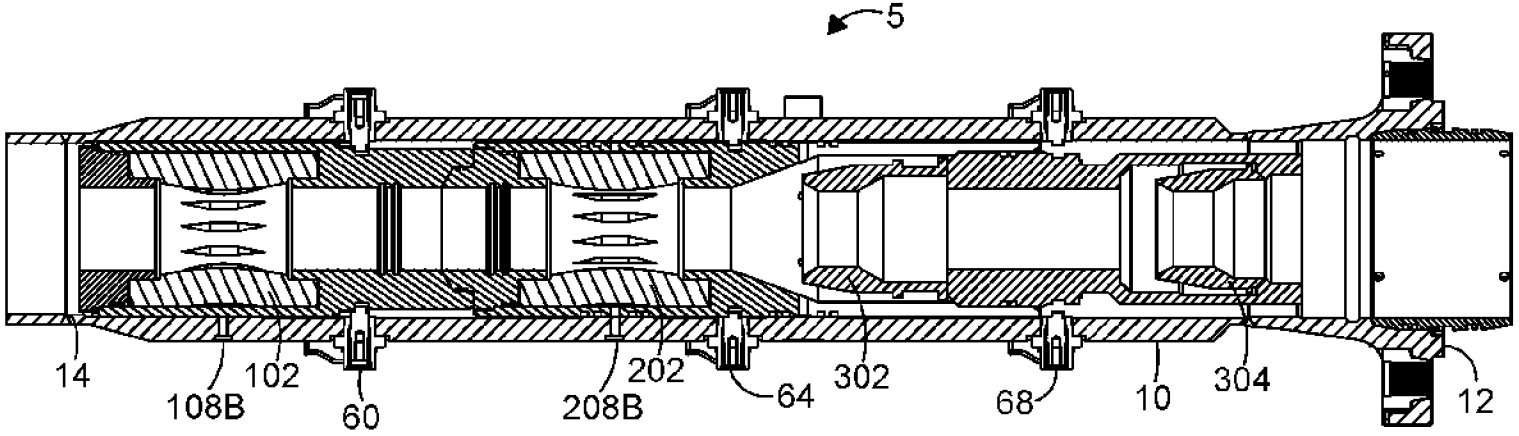
Figure 29:
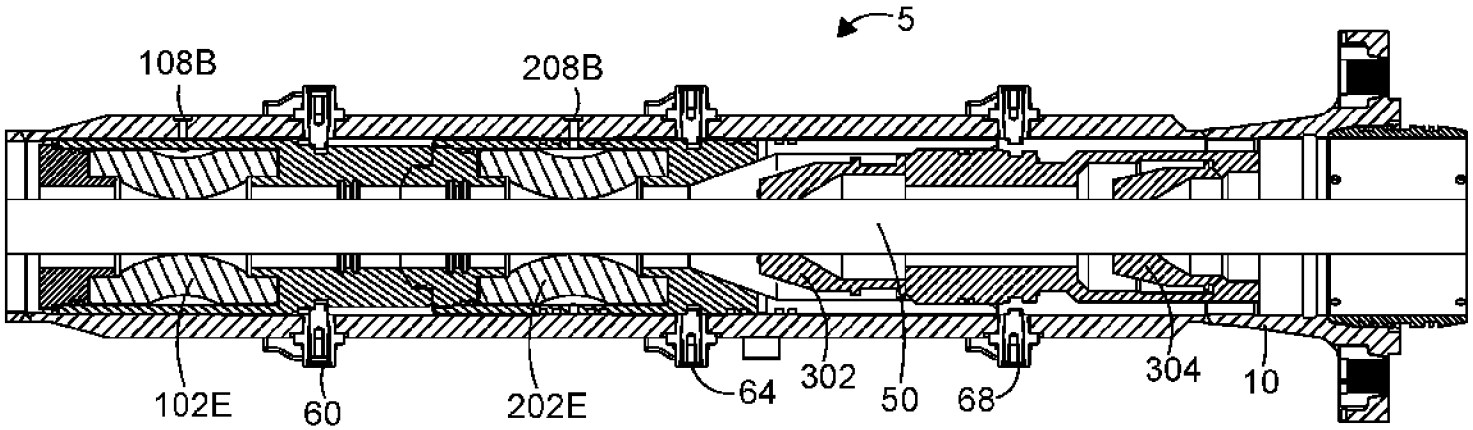
Figure 30:
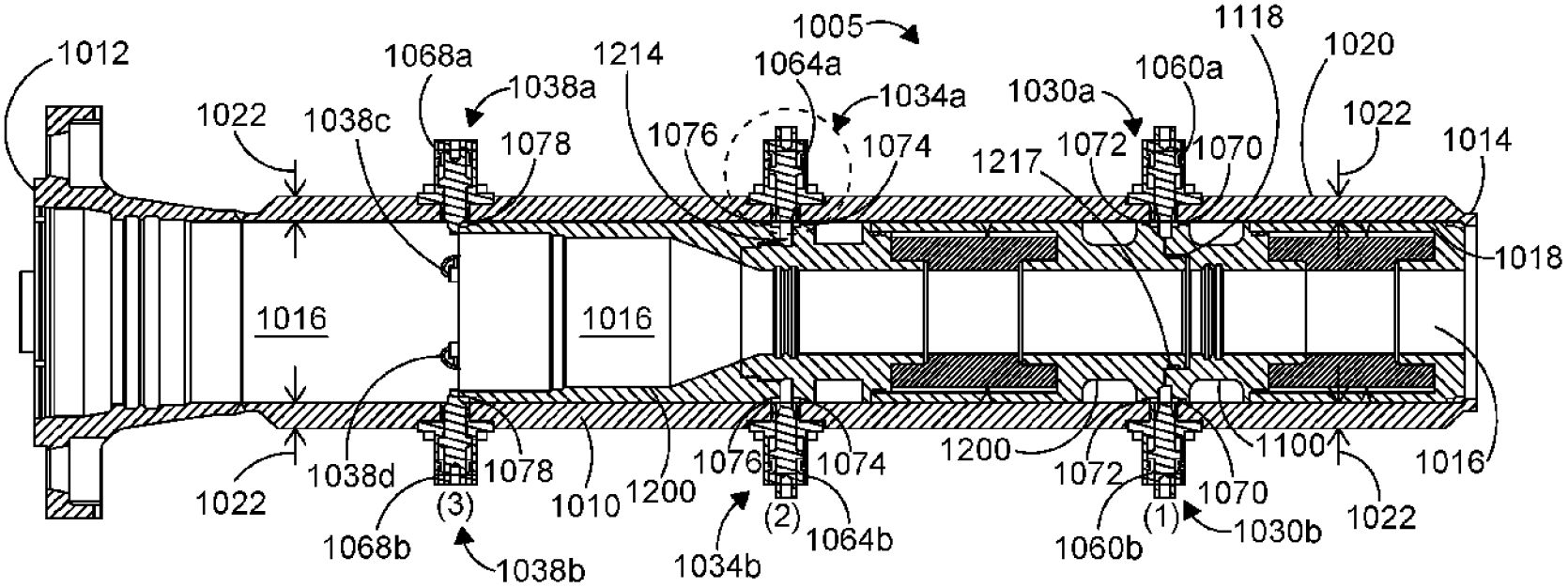
Figure 31:
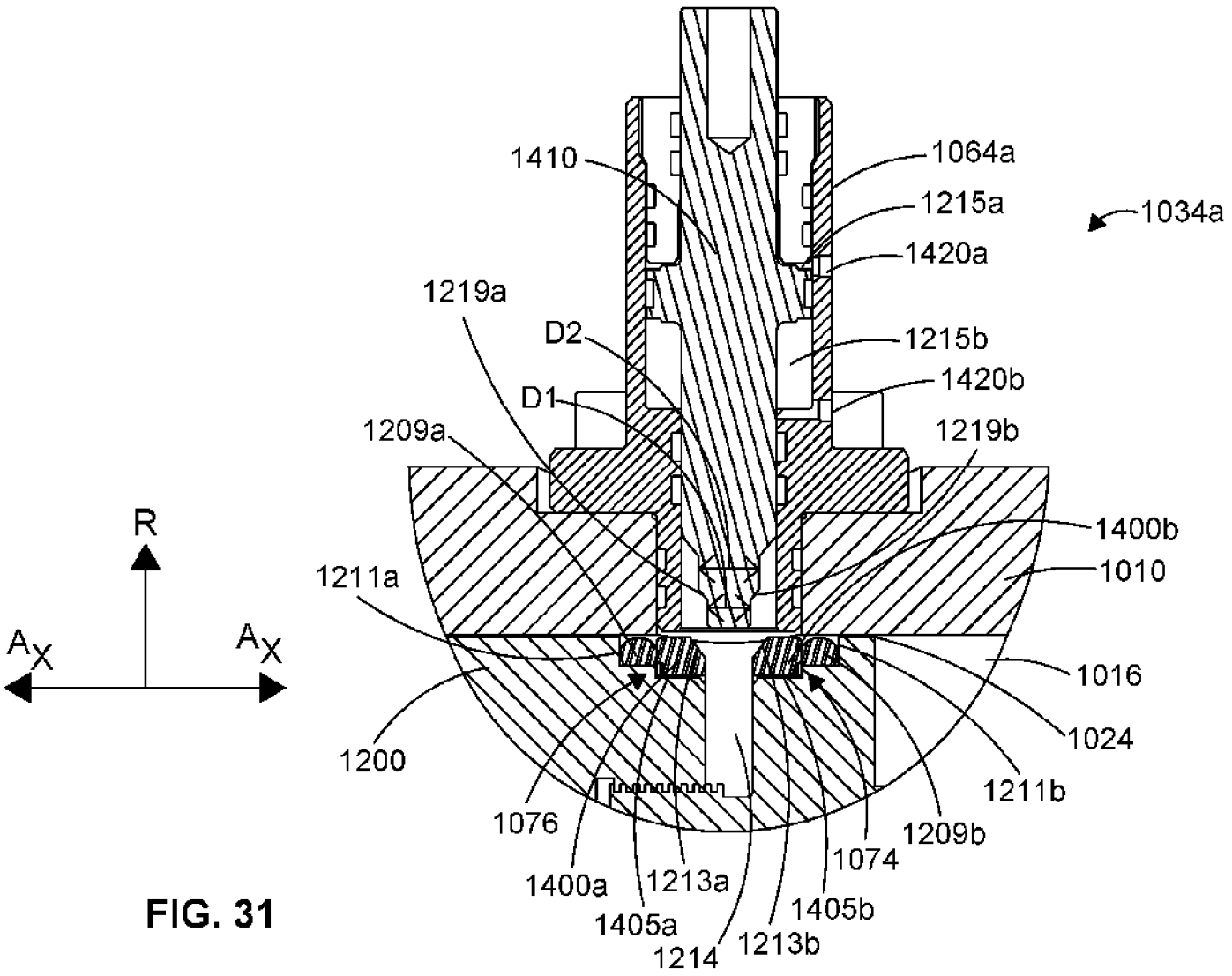
Figure 32C:
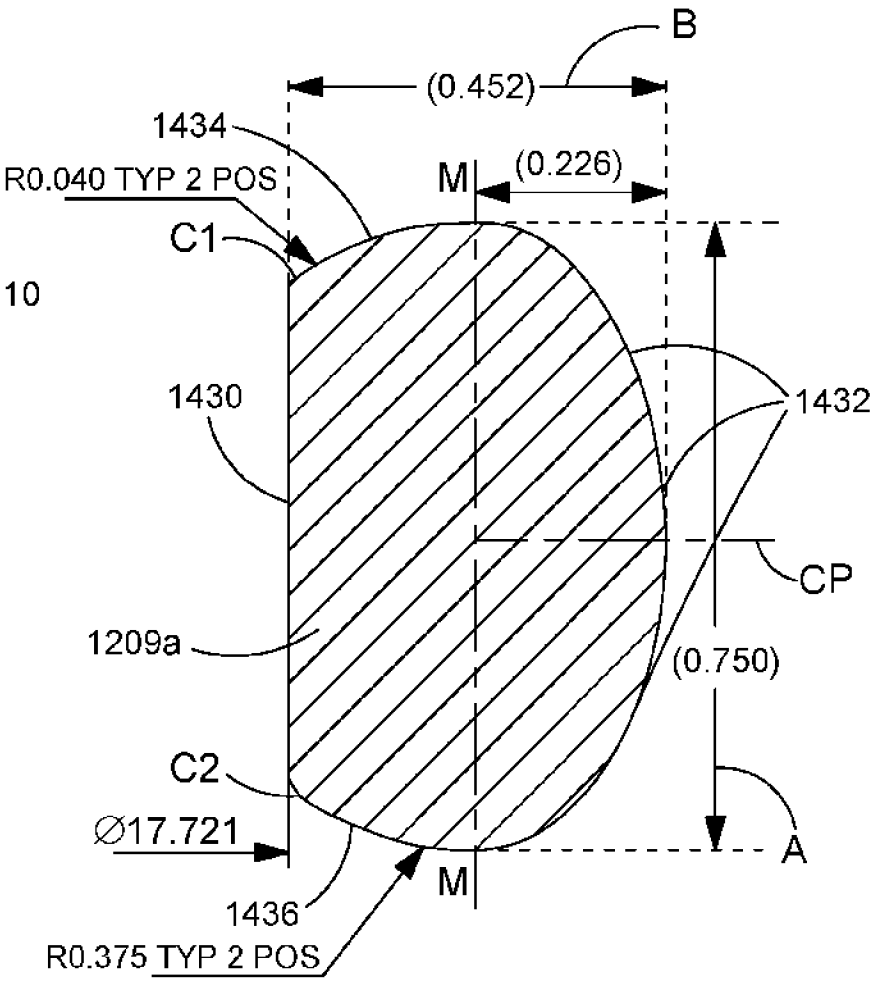
Figure 31B:
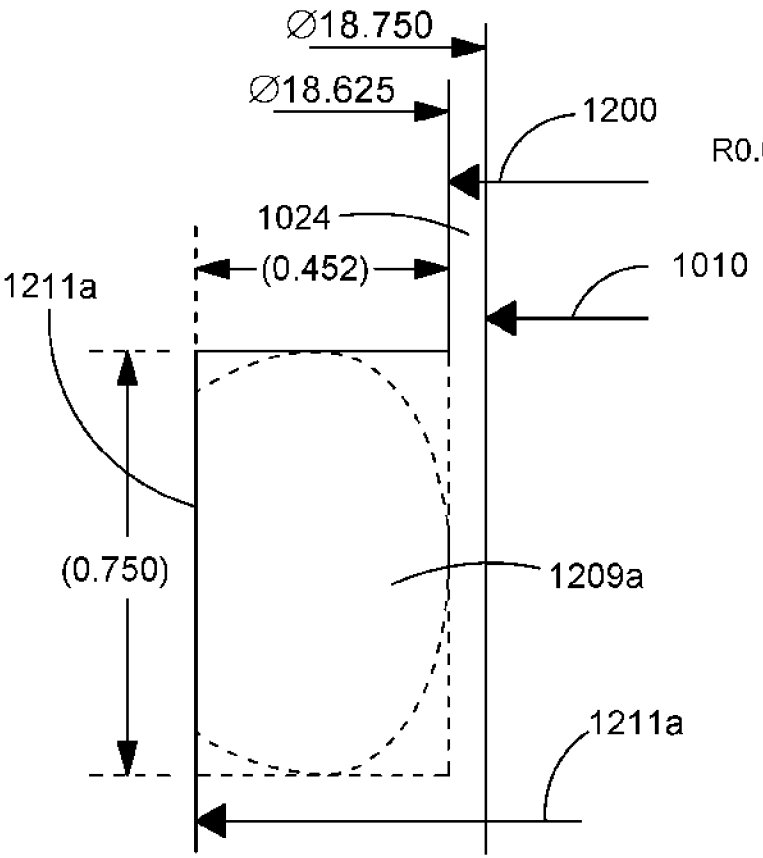
Figure 32B:
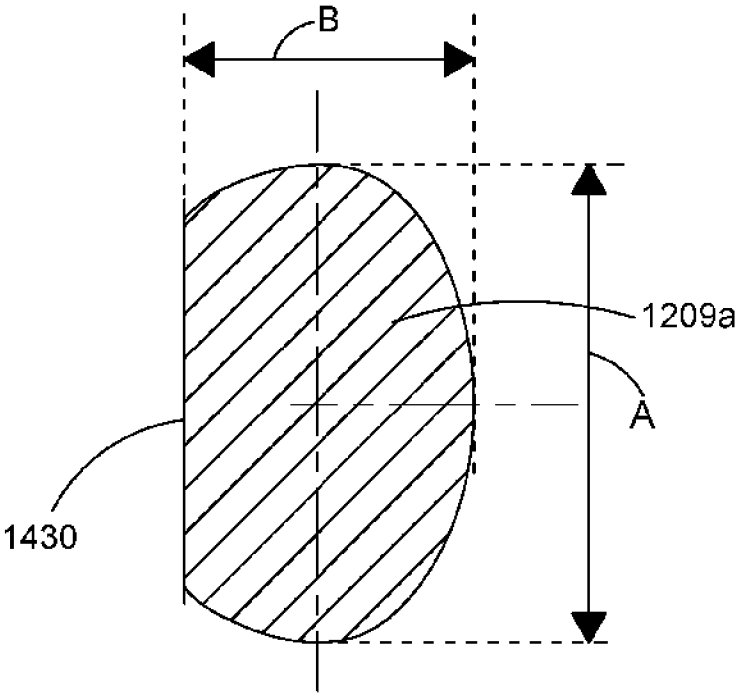
Figure 32A:
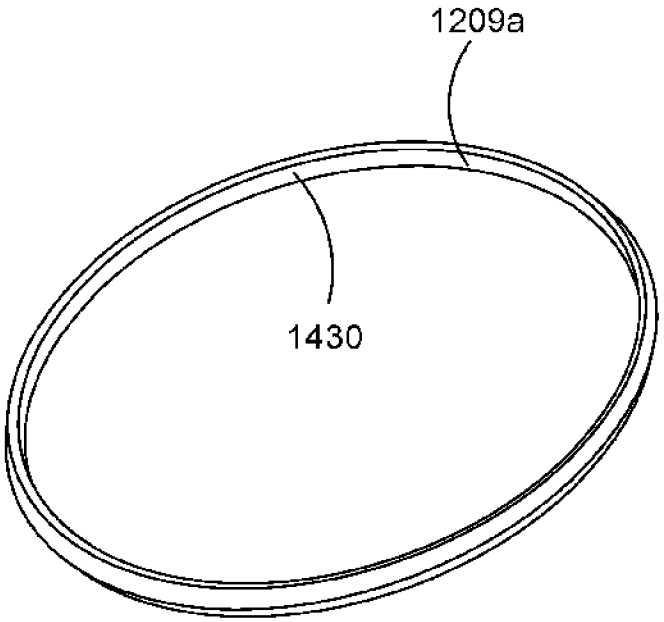
Figure 33B:
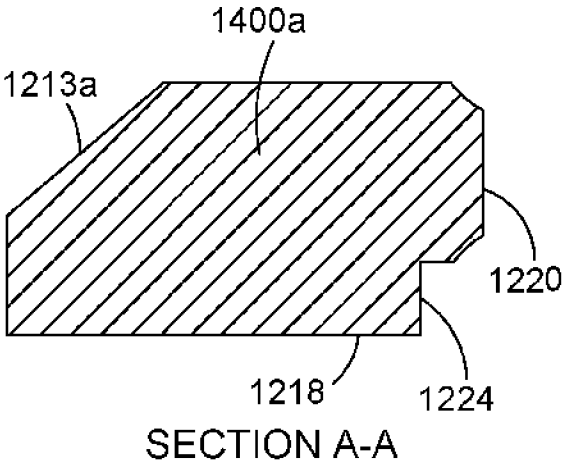
Figure 33C:
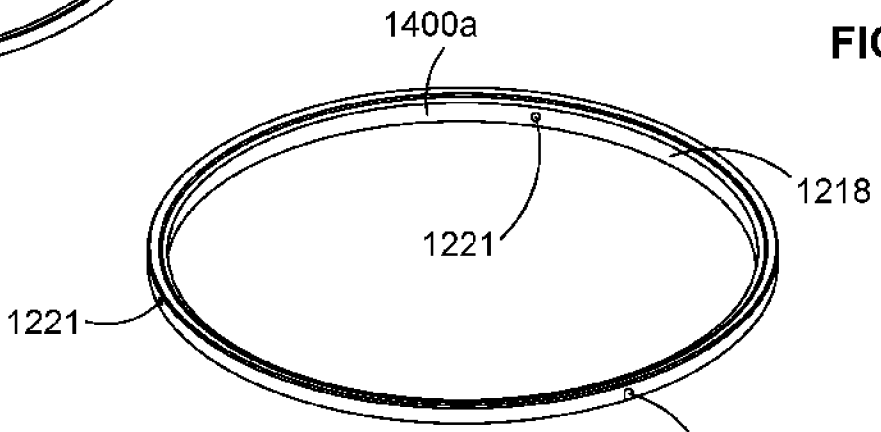
Figure 33A:
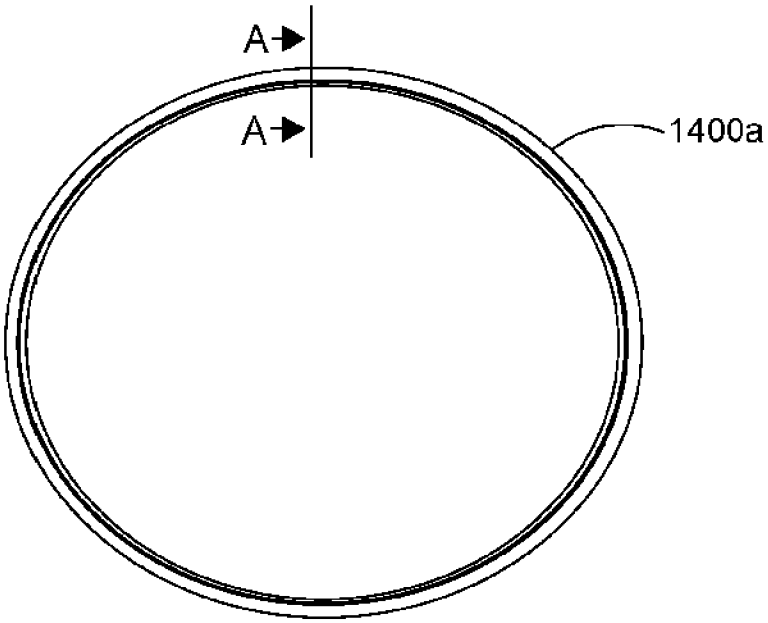
Figure 34:
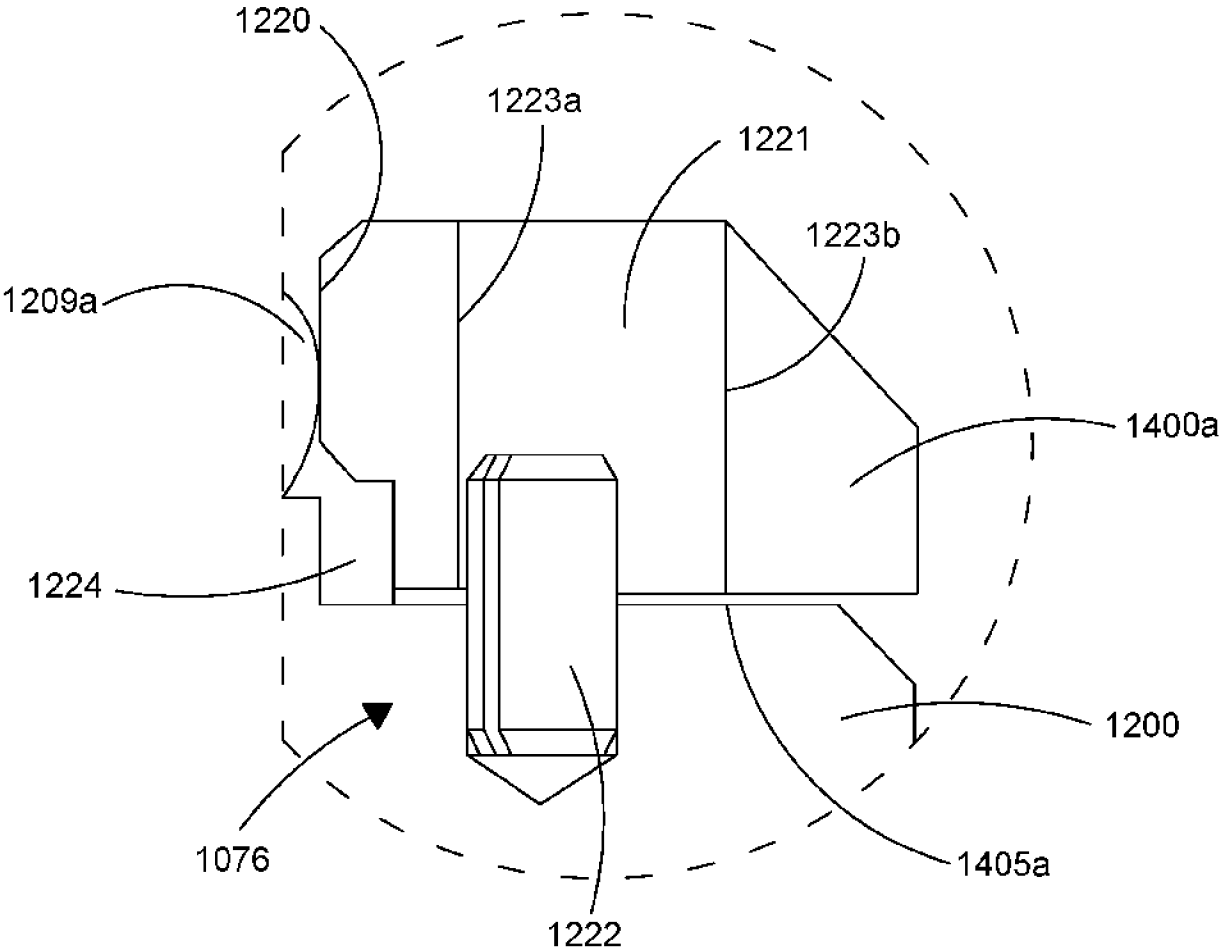
Figure 35:
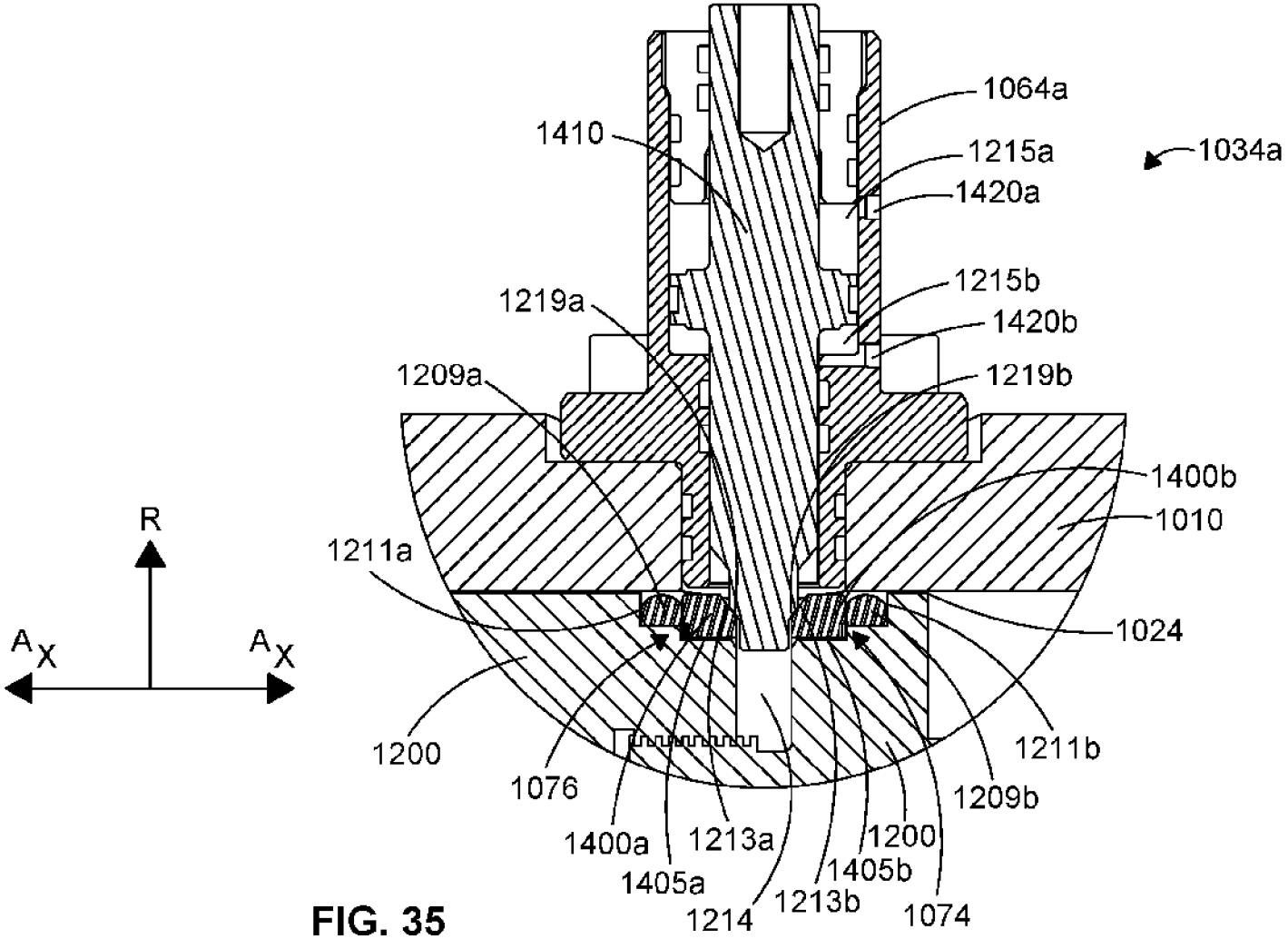
Figure 36:
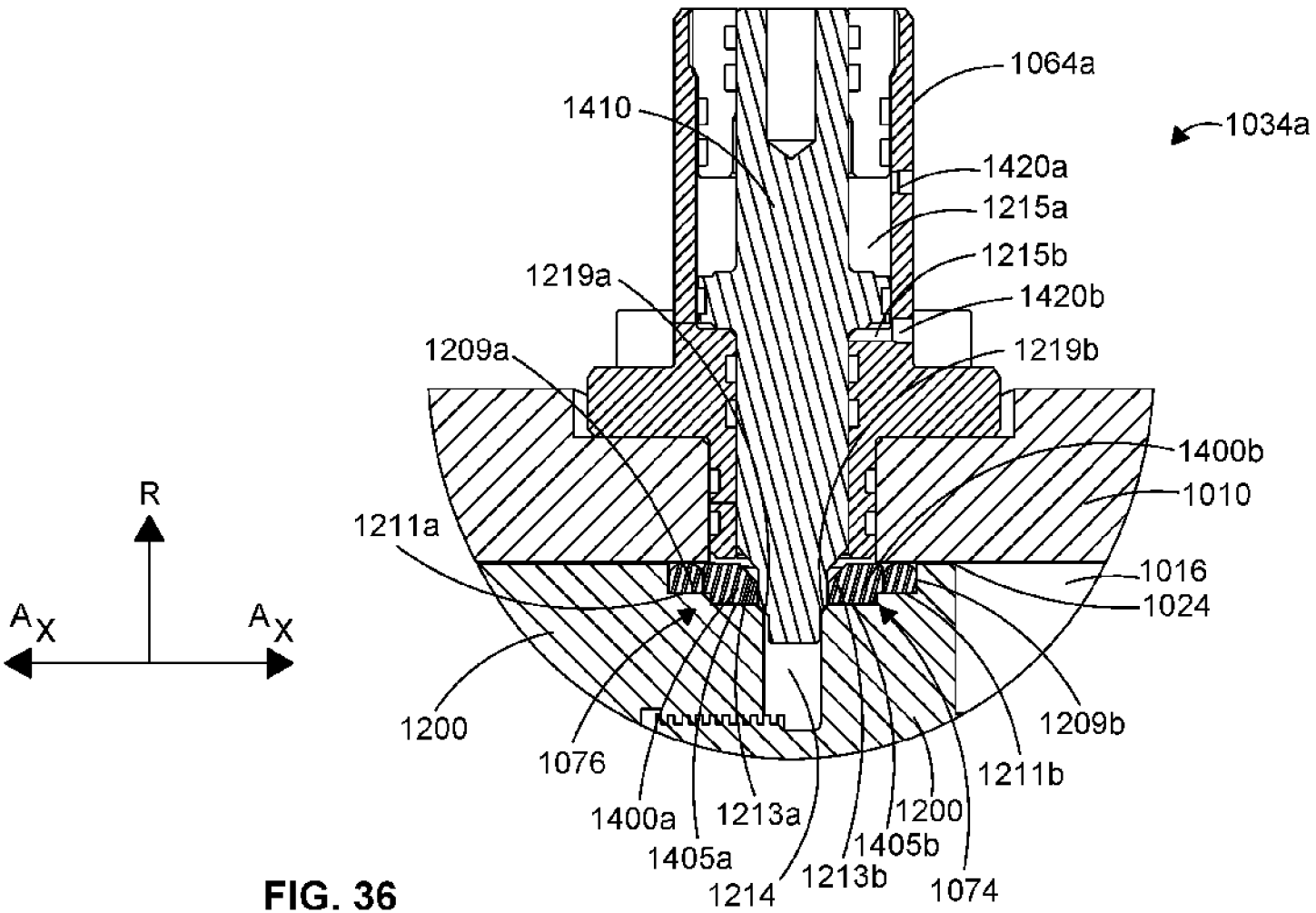
Figure 37:
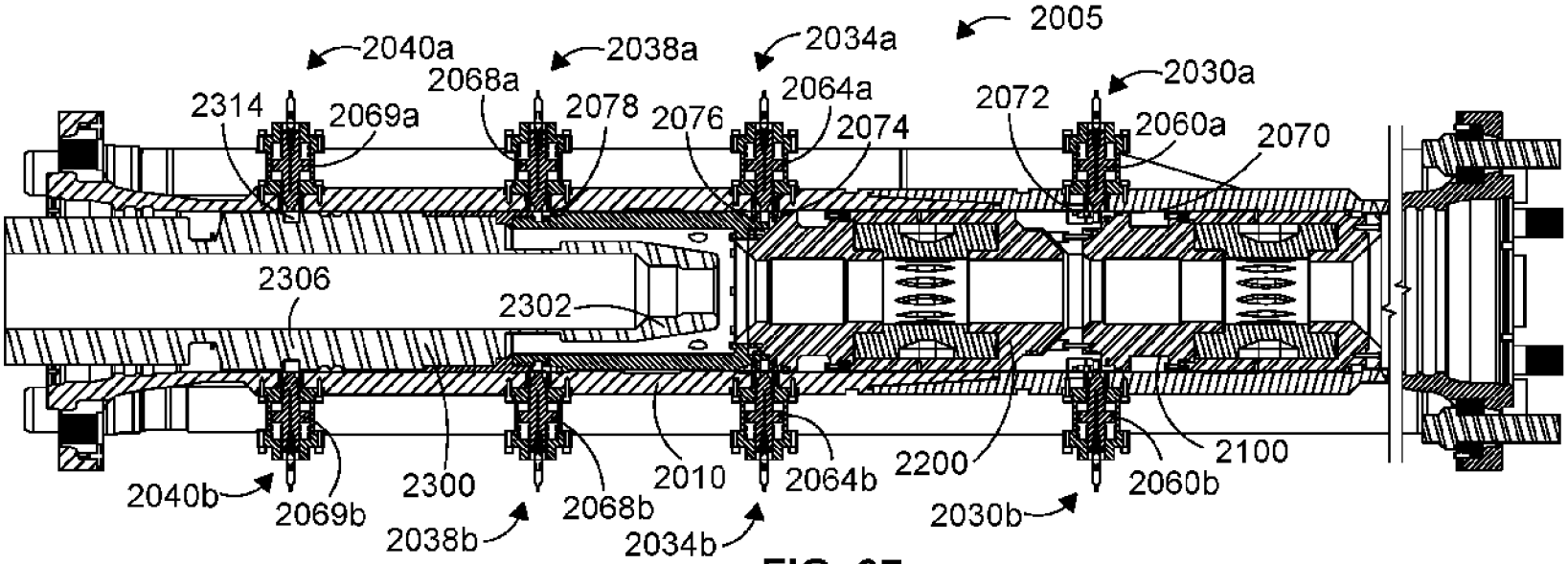
Figure 38:
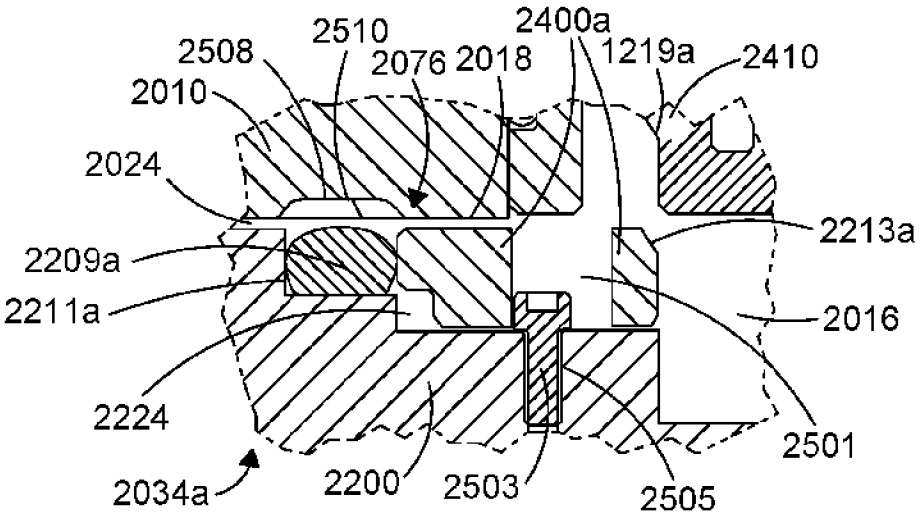
Figure 40A:
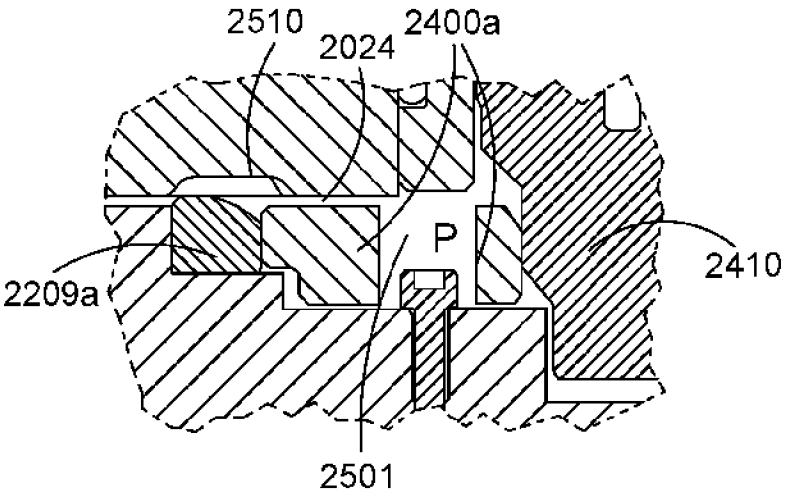
Figure 40B:
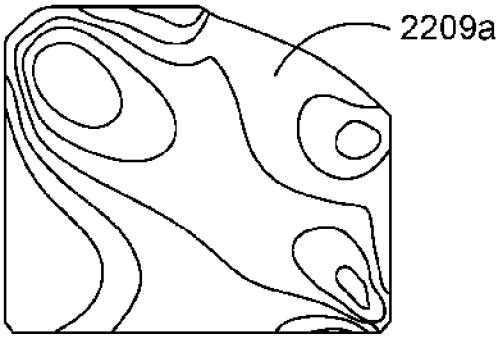
Figure 39A:
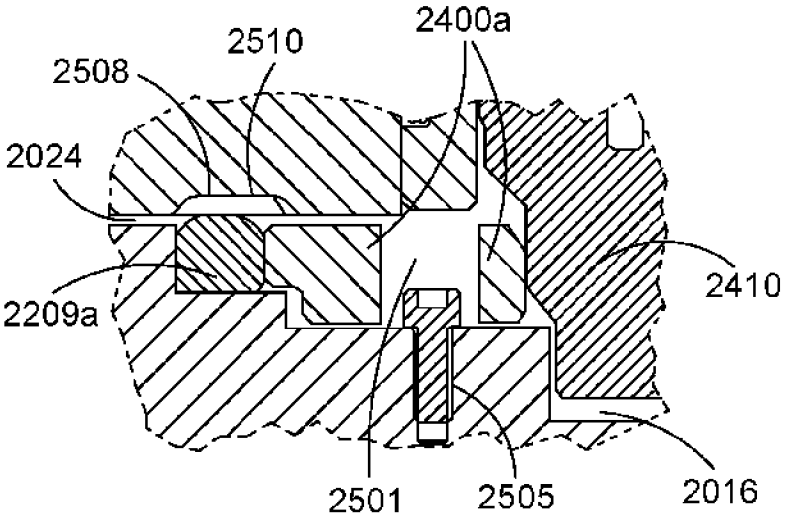
Figure 39B:
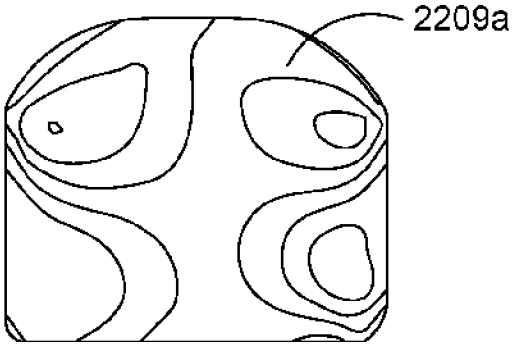
Figure 41C:
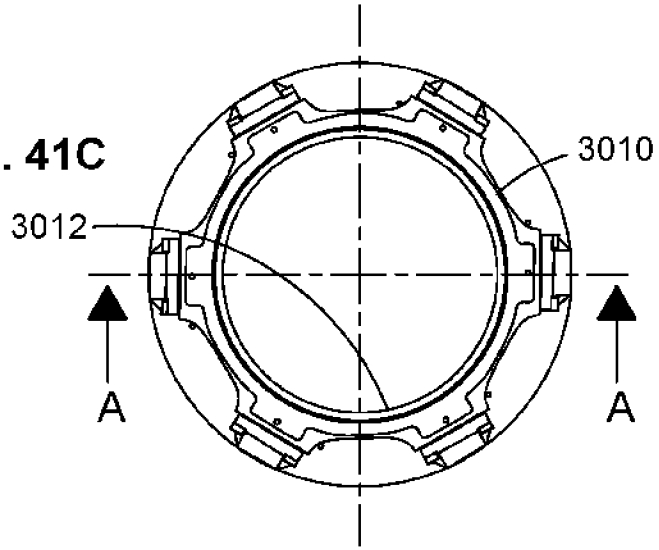
Figure 41B:
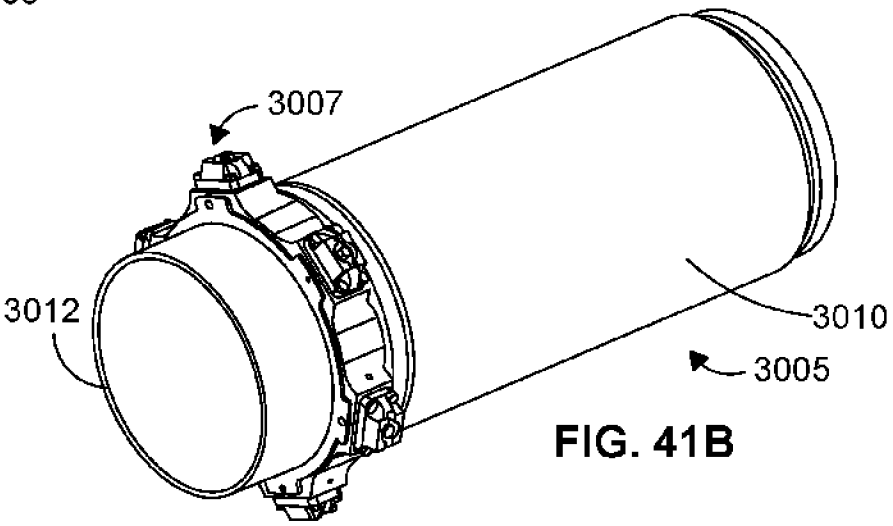
Figure 41A:
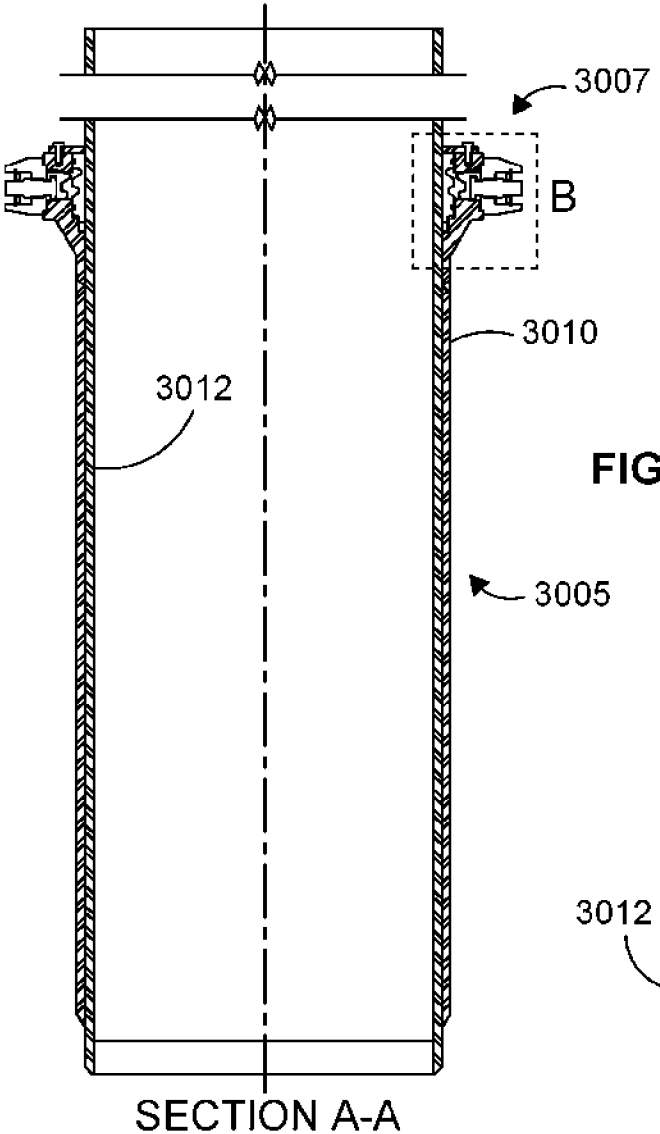

FIG. 28 shows a cross-sectional view of the integration joint assembly of FIG. 4 but without the running in tool nor the drill string being present and where the locking dogs of the RCD bearing assembly are retracted and where the upper and lower annular packer seals are de-energised;

FIG. 29 shows the integration joint assembly of FIG. 28 but where the drill string is present and the upper and lower annular packer seals have been energised around the outer surface of the drill string in order to further seal the annulus of the integration joint assembly;

FIG. 30 shows a first embodiment of several actuatable sealing mechanisms for sealing a fluid channel provided between two co-axially arranged tubular members in accordance with the first aspect of the present invention, which each utilise an elastically deformable resilient seal in accordance with the third aspect of the present invention, and which are provided in an integration joint assembly according to the fourth aspect of the present invention, where the actuatable sealing mechanisms are shown in an unlocked and unsealed state;

FIG. 31 shows a detailed view of the first embodiment of a first actuatable sealing mechanism (in accordance with the first aspect of the present invention) of the integration joint assembly of FIG. 30, where the first actuatable sealing mechanism is in the unlocked and unsealed state and is therefore shown prior to actuation to move the first actuatable sealing mechanism from the unsealed and unlocked state to a sealed and locked state;

FIG. 31*b* shows a simplified cross-sectional but more detailed view of the elastomeric seal 1209*a* of FIG. 31 being located wholly within the groove recess 1211*a* when in the unlocked and unsealed state;

FIG. 32*a* shows a perspective view of a first embodiment of a first seal in accordance with the third aspect of the present invention and which is utilised in the first actuatable sealing mechanism of FIGS. 30 and 31;

FIG. 32*b* shows a cross-sectional view of the first seal of FIG. 32*a*, showing the cross-sectional shape of the first seal and particularly an inner wall of the first seal;

FIG. 32*c* shows a more detailed cross-sectional view of the first seal of FIG. 32*a*, showing the cross-sectional shape of the first seal and particularly the various exemplary dimensions thereof;

FIG. 33*a* shows a plan view of a first actuating sleeve of the first actuatable sealing mechanism of FIGS. 30 and 31;

FIG. 33*b* shows a cross-sectional view of the first actuating sleeve of FIG. 33*a*, showing a stepped configuration and tapered face;

FIG. 33*c* shows a perspective view of the first actuating sleeve of FIG. 33*a*, showing slots for engagement of pins positioned on the upper packer cartridge assembly;

FIG. 34 shows a cross-sectional view of the first actuatable sealing mechanism of FIGS. 30 and 31, the cross-section taken through a slot in the first actuating sleeve such that the slot and respective pin are shown;

FIG. 35 shows a detailed view of the first actuatable sealing mechanism of the integration joint assembly of FIG. 30, as the first actuatable sealing mechanism is transitioning from the unsealed and unlocked state to the sealed and locked state;

FIG. 36 shows a detailed view of the first actuatable sealing mechanism of the integration joint assembly of FIG. 30 in the sealed and locked state;

FIG. 37 shows a second embodiment of several actuatable sealing mechanisms for sealing a fluid channel provided between two co-axially arranged tubular members in accordance with the first aspect of the present invention, which each utilise an elastically deformable resilient seal in accordance with the third aspect of the present invention, and which are provided in an integration joint assembly according to the fourth aspect of the present invention, where the actuatable sealing mechanisms are shown in an unlocked and unsealed state;

FIG. 38 shows a detailed view of the second embodiment of an actuatable sealing mechanism (in accordance with the first aspect of the present invention) of the integration joint assembly of FIG. 37, where the second embodiment of actuatable sealing mechanism is in the unlocked and unsealed state and is therefore shown prior to actuation to translate the actuatable sealing mechanism from the unsealed and unlocked state to a sealed and locked state;

FIG. 39(*a*) shows a detailed view of the second embodiment of the actuatable sealing mechanism of the integration joint assembly of FIG. 37 but after the actuatable sealing mechanism has transitioned or translated from the unsealed and unlocked state to the sealed and locked state and thus shows the actuatable sealing mechanism of the integration joint assembly of FIG. 37 in the sealed and locked state, but prior to the application of bore pressure against the upstream facing side of the elastomeric seal of the second actuatable sealing mechanism;

FIG. 39*b* is a cross-sectional view of the elastomeric seal of the second embodiment of the actuatable sealing mechanism of FIG. 39*a*, showing the shear strain experienced by the elastomeric seal when in the sealed and locked state prior to the application of bore pressure against the upstream facing side of the elastomeric seal; FIG. 40*a* shows a detailed view of the second embodiment of the actuatable sealing mechanism of the integration joint assembly of FIG. 37, after the actuatable sealing mechanism has transitioned to the sealed unlocked state as shown in FIG. 39*a* and also after the application of bore pressure against the upstream facing side of the elastomeric seal;

FIG. 40*b* is a cross-sectional view of the elastomeric seal of the second embodiment of the actuatable sealing mechanism of FIG. 40*a*, showing the shear strain experienced by the elastomeric seal when it is in the configuration shown in FIG. 40*a* and thus shows the shear strain experienced by the elastomeric seal when a significant level of bore pressure such as 3000 psi is applied against the upstream facing side of the elastomeric seal;

FIG. 41*a* shows a third embodiment of severable actuatable sealing mechanisms for sealing a fluid channel provided between two axially arranged tubular members in accordance with the first aspect of the present invention and which each utilise an elastically deformable resilient seal in accordance with the third aspect of the present invention and which are provided in a pipe sealing mechanism for sealing an expansion barrel having an annular fluid channel between an inner pipe and an outer pipe according to the sixth aspect of the present invention, where the actuatable sealing mechanisms are shown in FIG. 41*a* in an unlocked and unsealed state;

FIG. 41*b* is a perspective side view of the expansion barrel of FIG. 41*a;*

FIG. 41*c* is an end/plan view of the expansion barrel of FIG. 41*a;*

Figure 43:
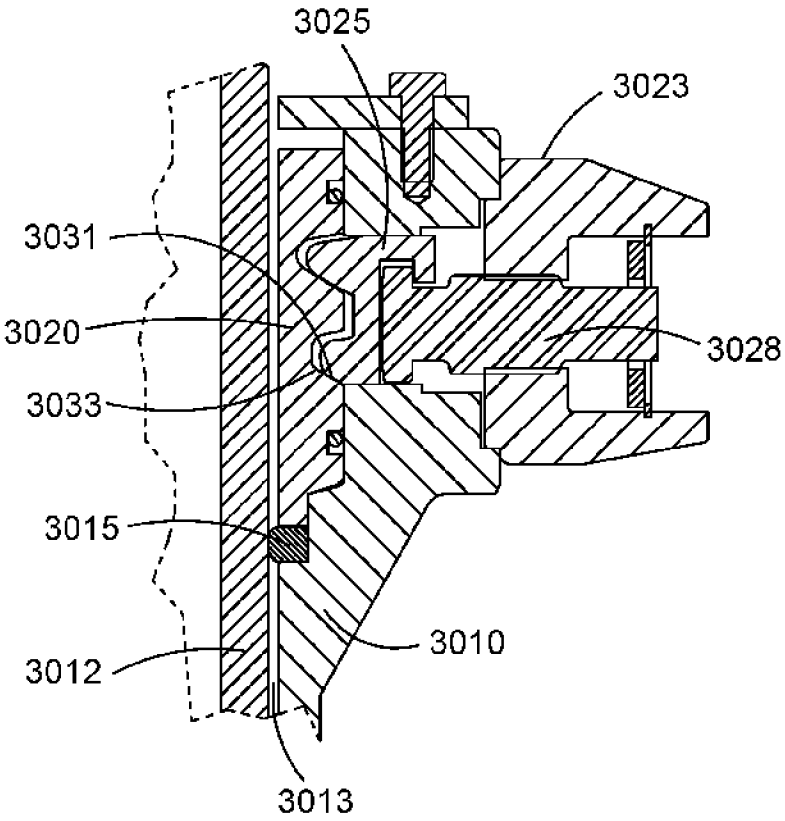
Figure 42:
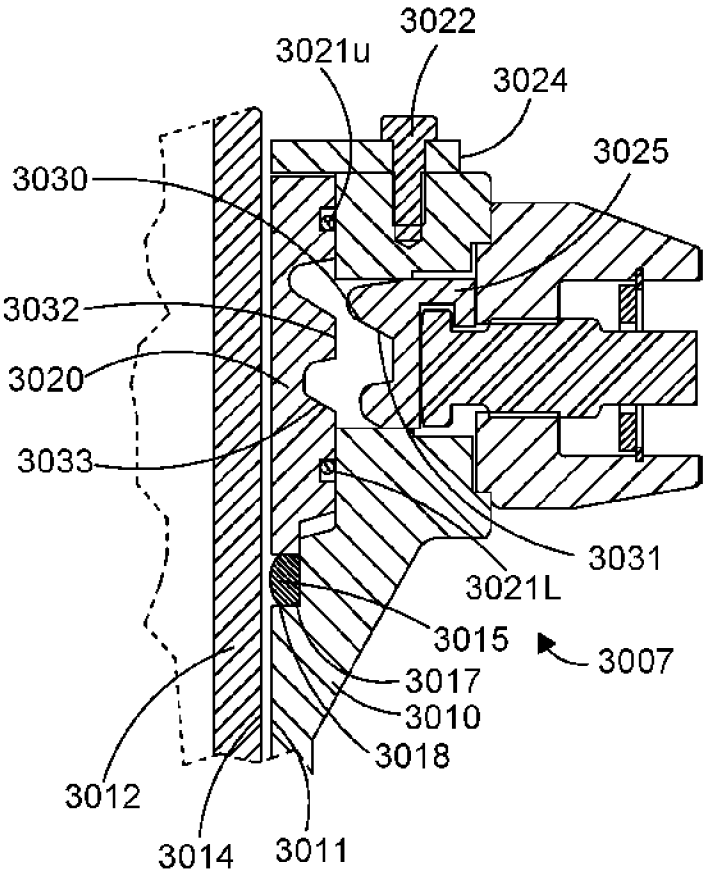

FIG. 42 is a cross-sectional view showing, in much greater detail, detail B of FIG. 41*a* and which shows the actuatable sealing mechanism from detail B of FIG. 42 in an unlocked and unsealed state; and FIG. 43 is a cross-sectional view of the actuatable sealing mechanism shown in detail B of FIG. 41*a*, but the actuatable sealing mechanism is now in the sealed and locked state.

DETAILED DESCRIPTION OF AN EXAMPLE OF AN INTEGRATION JOINT BODY

Figure 1:
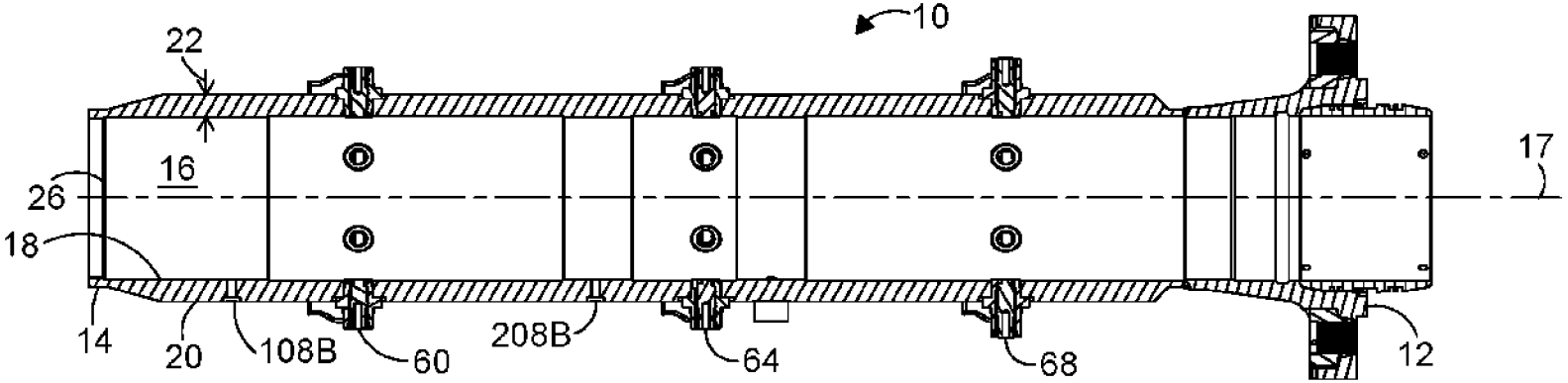

FIG. 1 shows a first example of an integration joint body 10 (which is not in accordance with the present invention) which in-use will be included in a riser string by means of an upper end connection 12 which will permit the integrated joint body 10 to be connected to an upper portion of the riser string, typically being the lower end of a suitable telescopic joint (not shown). Additionally, the integration joint body 10 is further provided with a lower end connection 14 which is adapted to be connected to the upper end of a suitable MPD flow spool (not shown) and which is in turn connected to a lower portion of the riser string. The telescopic joint therefore forms an upper part of the riser string such that the telescopic joint is located above the integration joint body 10 which in turn is located above the MPD flow spool within the riser string. The lower end connection 14 is suitably secured to the upper end of the MPD flow spool (not shown) by any suitable means such as welding or other suitable means such as screw threaded connection, etc.

Moreover, the integration joint body 10 comprises a through bore 16 having an inner through bore surface 18, an outer diameter surface 20 and a side wall 22 such that the integration joint body 10 is generally tubular along its longitudinal length.

The side wall 22 is generally sealed along its length such that pressurised fluids located within the integration joint body 10 and thus the rest of the riser string are safely contained by and within the side wall 22 of the integration joint body 10.

Figure 2:
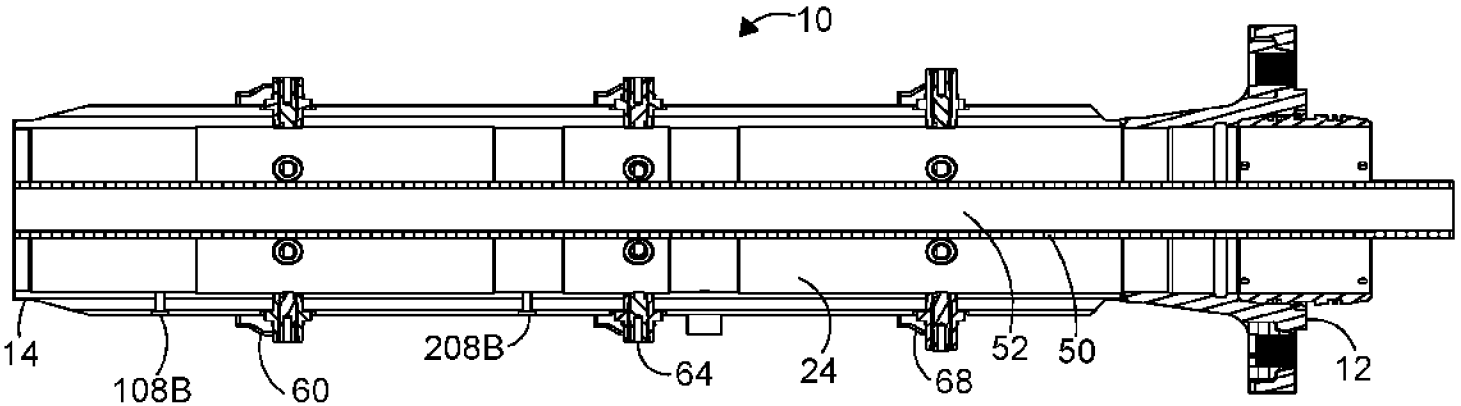

FIG. 2 shows the next stage of operation of the riser string and in particular the integration joint body 10, whereby a drill string 50 consisting of multiple lengths of drill pipe suitably connected together (and with a BHA (not shown) and a drill bit (not shown) provided at the bottom thereof) having been run or lowered through the integration joint body 10 and down through the lower portion of the riser string located below the integration joint body 10.

FIG. 2 therefore shows the configuration for conventional drilling (ie with no managed pressure drilling equipment being required nor operated). Accordingly, drilling operations can be conducted from the floating drilling vessel at the surface of the sea (from which the riser string is hung below), where drilling fluid or mud is pumped down through the through bore 52 of the drill string 50 and will exit the drill string 50 at the bottom thereof through the drill bit and the drilling fluid or mud plus drill cuttings will return to the surface of the floating drilling vessel via the annulus 24 located or provided between the outer surface of the drill string 50 and the inner through bore surface 18 of the integration joint body 10 (and the inner through bore surface of the rest of the riser string).

However, if MPD is required then the system shown in FIG. 2 is the starting point to enable a marine drilling riser to switch to managed pressure drilling and in order to do so, the first few joints of drill pipe are lifted up (such that the drill string is lifted up) and the first few joints of drill pipe are replaced by a running tool 54 such that the running tool 54 is now connected at the very upper end of the drill string 50.

Next, an operator attaches a lower packer cartridge assembly 100, with an upper packer cartridge assembly 200 located above the lower packer cartridge assembly 100 and also attaches an RCD bearing assembly 300 just above the upper packer cartridge assembly 200 to the running tool 54, such that the running tool 54 (and the drill string 50 located below it) are lowered into the through bore 16 of the integration joint body 10 such that the lower packer cartridge assembly 100, upper packer cartridge assembly 200 and RCD bearing assembly 300 are run into the through bore of the telescopic joint and rest of upper portion of the riser system and then into the through bore of the integration joint body 10 in order to form the integration joint assembly 5 in accordance with the present invention and this point in the operation is shown in FIG. 3.

Lower Packer Cartridge Assembly 100—FIG. 25*a*

The lower packer cartridge assembly 100 is shown in more detail in FIG. 25*a* and comprises a lower packer cartridge body 104 being in the form of a substantially tubular body 104 and having a recess 101 provided on its inner through bore surface 105. A lower annular packer seal 102 is located in that recess 101 and a lower packer end cap 106 is securely attached to the lower end of the lower packer cartridge body 104 in order to trap the lower annular packer seal 102 within the recess 101. Accordingly, the lower annular packer seal 102 cannot move longitudinally within the recess 101 but can be forced to move radially inwardly if required by the operator by the operator pumping hydraulic fluid (from a pressurised hydraulic fluid source via lower packer hydraulic fluid extend port 108B formed through the side wall 22 of the integration joint body 10 and which is arranged to align in a sealed manner with hydraulic fluid port 108A when the lower packer cartridge assembly 100 is installed and locked in place in the integration joint body 100) into hydraulic fluid port 108A formed in the side wall of the lower packer cartridge body 104 at approximately the mid-longitudinal point of the lower annular packer seal 102.

The inner through bore surface 105 of the lower packer cartridge body 104 is further provided with a retrieval profile 110 formed therein and which in use can be latched into by the running tool 54 having a suitably configured and co-operating retrieval profile 56 (seen in FIG. 3) latching into the retrieval profile 110. Suitable seals 112 such as O-ring seals 112 are provided on the outer surface of the end cap 106 such that the O-ring seals 112 act against the inner surface 105 of the lower end of the lower packer cartridge body 104 in order to prevent the hydraulic fluid from leaking out of the lower end of the lower packer cartridge assembly 100.

The lower packer cartridge assembly 100 further comprises a groove 114 formed circumferentially around the outer surface of the lower packer cartridge body 104 where, in use, an operator can extend lower packer cartridge locking dogs 60 through the side wall 22 of the integration joint body 10 into the groove 114 in order to longitudinally lock the lower packer cartridge assembly 100 in place at the lower end within the through bore 16 of the integration joint body 10 as will be described subsequently.

Lower packer cartridge seals 109 (see FIG. 25(*a*)) are provided on the outer diameter of the lower packer cartridge assembly 100 to seal against the inner diameter 18 of the integration joint body 10, to seal the annulus 24 between the outer diameter of the lower packer cartridge assembly 100 and the inner diameter 18 of the integration joint body 10 and thereby prevent any fluid in the riser string from leaking past the outer surface of the lower packer cartridge assembly 100.

Upper Packer Cartridge Assembly 200—FIG. 26*a*

The upper packer cartridge assembly 200 is broadly speaking relatively similar to the lower packer cartridge assembly 100, and thus similar components and features of the upper packer cartridge assembly 200 to those of the lower packer cartridge assembly 100 are indicated with the same reference numeral but with the addition of 100.

In general terms though, the upper packer cartridge assembly 200 is slightly longer along the longitudinal axis than the lower packer cartridge assembly 100 and the retrieval profile 210 is formed on the inner through bore surface 207 of the upper packer end cap 206 (instead of being formed on the inner through bore surface 205). In addition, the very lower end of the upper packer end cap 206 is provided with a spigot 216 which further comprises seals such as O-ring seals 217 formed about its outer circumferential surface and which is arranged to project into and therefore seal against (by means of the seals 217) against the inner surface of socket joint 118 provided at the upper end of the lower packer cartridge body 104.

Upper packer cartridge seals 209 (see FIGS. 26(*a*) and 26(*b*)) are provided on the outer diameter of the upper packer cartridge assembly 200 to seal against the inner diameter 18 of the integration joint body 10 to seal the annulus 24 between the outer diameter of the upper packer cartridge assembly 200 and the inner diameter 18 of the integration joint body 10 and thereby prevent any fluid in the riser string from leaking past the outer surface of the upper packer cartridge assembly 200.

RCD Bearing Assembly 300—FIG. 27*a*

The RCD bearing assembly 300 is best seen in FIG. 27*a* and comprises an RCD bearing body 306 which is substantially tubular along its longitudinal length and which comprises a lower RCD seal 302 projecting downwards from its lower end and which is connected to the RCD bearing body 306 by a rotatable bearing 305 such that the lower RCD seal 302 can rotate about its longitudinal axis 307 (and therefore the longitudinal axis 17 of the integration joint 10) with respect to the stationary RCD bearing body 306.

The RCD bearing assembly 300 further comprises an upper RCD seal 304 arranged within a recess 303 within the RCD bearing body 306 where the upper RCD seal 304 is further connected to the RCD bearing body 306 at its upper end by means of a rotatable bearing 308 such that the upper RCD seal 304 can rotate about the longitudinal axis 307 with respect to the stationary RCD bearing body 306. The RCD bearing assembly 300 further comprises a groove or recess 314 formed circumferentially about or around the outer surface of the RCD bearing body 306 where, in use, an operator can extend RCD assembly locking dogs 68 through the side wall 27 of the integration joint body 10 into the groove 314 in order to longitudinally lock the RCD bearing assembly 300 in place at the upper end of the through bore 16 within the integration joint body 10 as will be described subsequently.

RCD bearing assembly seals 317 are provided on the outer diameter of the RCD bearing assembly 300 to seal against the inner diameter 18 of the integration joint body 10 to seal the annulus 24 between the outer diameter of the RCD bearing assembly 300 and the inner diameter 18 of the integration joint body 10 and thereby prevent any fluid in the riser string from leaking past the outer surface of the RCD bearing assembly 300.

Lower Packer Cartridge Seals 109, Upper Packer Cartridge Seals 209 and RCD Bearing Assembly Seals 317.

In the first example of an integration joint described with reference to FIGS. 1 to 29, the lower packer cartridge seals 109, upper packer cartridge seals 209 and RCD bearing assembly seals 317 are provided on the outer diameter of the respective assemblies 100, 200, 300. The said seals 109, 209, 317 are o-ring seals, wherein each o-ring is formed of a sufficiently resilient material, such as rubber or polyurethane or any other suitable material, such that the o-ring may be compressed or be impinged upon by other components and then rebound sufficiently to perform the sealing function. The lower packer cartridge 100, upper packer cartridge 200, and RCD bearing assembly 300 can move either or both of axially and/or rotationally relative to the telescopic joint or integration joint body 10 preferably without damaging the o-ring or dislodging it from its desired position. This relative movement may however create friction between the o-ring and a wall of the telescopic joint or integration joint body 10. The o-ring may be of a suitable material such that the friction preferably does not damage the o-ring and the compression preferably does not hamper the ability to subsequently create a tight seal when the lower packer cartridge 100, upper packer cartridge 200 and RCD 300 are seated in their desired positions within the integration joint assembly 5

DETAILED DESCRIPTION OF EMBODIMENTS OF THE PRESENT INVENTION

An embodiment of an improved integration joint assembly 1005 in accordance with the fourth aspect of the present invention and utilising at least one actuatable sealing mechanism in accordance with the first aspect of the present invention, and which therefore utilises at least one elastically deformable resilient seal in accordance with the third aspect of the invention, is now described. This embodiment of the integration joint assembly 1005 is broadly speaking in some respects relatively similar to the first integration joint assembly 5 of the first example described above with reference to FIGS. 1 to 29, and thus similar components and features to those of the first example of an integration joint assembly 5 are indicated with the same reference numeral, but with the addition of 1000.

Referring now to FIG. 30, the first embodiment of integration joint assembly 1005 in accordance with the present invention comprises an integration joint body 1010, a lower packer cartridge assembly 1100, an upper packer cartridge assembly 1200 and eighteen actuatable sealing mechanisms or assemblies in accordance with the first aspect of the present invention, of which eight 1030*a*, 1030*b*, 1034*a*, 1034*b*, 1038*a*, 1038*b*, 1038*c*, 1038*d* are shown in the cross-sectional view in FIG. 30. The cross-section is taken through six of the sealing assemblies 1030*a*, 1030*b*, 1034*a*, 1034*b*, 1038*a*, 1038*b* with the other two sealing assemblies 1038*c*, 1038*d* shown being behind the cross-section line. The eighteen sealing assemblies are arranged in three sets (1), (2), (3) of six equally circumferentially spaced sealing assemblies. Each sealing assembly 1030*a*, 1030*b*, 1034*a*, 1034*b*, 1038*a*, 1038*b*, 1038*c*, 1038*d* comprises a respective radially moveable activating member in the form of a locking dog 1060*a*, 1060*b*, 1064*a*, 1064*b*, 1068*a*, 1068*b* (not visible for sealing assemblies 1038*c*, 1038*d*) which forms part of a respective actuatable sealing mechanism 1070, 1072. 1074, 1076, 1078. As can be seen in the cross-sectional view shown in FIG. 30, locking dogs of the same set of sealing assemblies are arranged to act upon the same actuatable sealing mechanisms. In this regard, locking dogs 1060*a*, 1060*b* of the first set (1) both act upon actuatable sealing mechanisms 1070, 1072; locking dogs 1064*a*, 1064*b* of the second set (2) both act upon actuatable sealing mechanisms 1074, 1076; and locking dogs 1068*a*, 1068*b* of the third set (3) both act upon actuatable sealing mechanism 1078. Each of the sealing assemblies 1030*a*, 1030*b*, 1034*a*, 1034*b*, 1038*a*, 1038*b* are in accordance with the first aspect of the present invention.

The sets of sealing assemblies (1), (2), (3) are arranged as follows:

(1) The first set of sealing assemblies 1030*a*, 1030*b* are positioned between the lower packer cartridge assembly 1100 and the upper packer cartridge 1200, and are capable of locking the lower packer cartridge assembly 1100 in place within the integration joint body 1010.

The locking dogs 1060*a*, 1060*b* are for longitudinally locking (i.e. stopping the relative axial (and optionally also relative rotational) movement of) the lower packer cartridge assembly 1100 and the integration joint body 1010. The locking dogs 1060*a*, 1060*b* are also for actuating the actuatable sealing mechanisms 1070, 1072 to provide a fluid tight seal between the outer surface of the lower packer cartridge assembly 1100 and the inner surface 1018 of the integration joint body 1010, and to provide a fluid tight seal between the outer surface of the upper packer cartridge assembly 1200 and the inner surface 1018 of the integration joint body 1010.

(2) The second set of sealing assemblies 1034*a*, 1034*b* are positioned at the approximate midpoint of the upper packer cartridge assembly 1200, and are capable of locking the upper packer cartridge assembly 1200 in place within the integration joint body 1010.

The locking dogs 1064*a*, 1064*b* are for longitudinally locking (i.e. stopping the relative axial (and optionally also relative rotational) movement of) the upper packer cartridge assembly 1200 and the integration joint body 1010, and for actuating the actuatable sealing mechanisms 1074, 1076 to provide a fluid tight seal between the outer surface of the upper packer cartridge assembly 1200 and the inner surface 1018 of the integration joint body 1010.

(3) The third set of sealing assemblies 1038*a* and 1038*b* are positioned at the upper end of the upper packer cartridge assembly 1200 and the approximate midpoint of the RCD bearing assembly 1300, in such a way that the sealing assemblies 1038*a*, 1038*b* are capable of locking the RCD bearing assembly 1300 in place within the integration joint body 1010.

The locking dogs 1068*a*, 1068*b* are for longitudinally locking (i.e. stopping the relative axial (and optionally also relative rotational) movement of) the RCD bearing assembly 1300 and the integration joint body 1010 by locating into a groove 1314 (not shown) provided around the outer surface of the RCD bearing assembly 1300. The locking dogs 1068*a*, 1068*b* are also for actuating the actuatable sealing mechanism 1078 to provide a fluid tight seal between the outer surface of the upper packer cartridge assembly 1200 and the inner surface 1018 of the integration joint body 1010, and for actuating an actuatable sealing mechanism (not shown) provided on the circumference of the RCD bearing assembly 1300 to provide a fluid tight seal between the outer surface of the RCD bearing assembly 1300 and the inner surface 1018 of the integration joint body 1010. Components of the locking dogs 1060*a*, 1060*b*, 1064*a*, 1064*b*, 1068*a*, 1068*b* will be described in more detail with reference to FIG. 31.

The actuatable sealing mechanisms or assemblies 1030*a*, 1030*b*, 1034*a*, 1034*b*, 1038*a*, 1038*b* in accordance with the present invention provide advantages over the seals 109, 209, 317 used in the first example, and may be implemented in an integration joint assembly preferably instead of, or at least together with, one or more of the seals 109, 209, 317 of the first example, as will be further described.

A detailed view of the sealing assembly 1034*a* is shown in FIG. 31, but the skilled reader will understand that all of the other sealing assemblies 1030*a*, 1030*b*, 1034*b*, 1038*a*, 1038*b* are arranged and are operated in a similar manner. The sealing assembly 1034*a* and components thereof, can move between two main states of operation—1) an unlocked and unsealed state, and 2) a locked and sealed state. FIG. 31 shows the sealing assembly 1034*a* in the unlocked and unsealed state, such that the upper packer cartridge assembly 1200 and the integration joint body 1010 are free to move relative to each other (i.e. unlocked state) and an annulus 1024 between the inner surface 1018 (ie the through-bore 1016) of the integration joint body 1010 and the outer surface of the upper packer cartridge assembly 1200 is not sealed (ie unsealed state).

The first actuatable sealing mechanism 1076 shown in FIG. 31 comprises an annular ring-shaped first elastomeric seal 1209*a* and an annular ring-shaped first actuating sleeve 1400*a*, and the second actuatable sealing assembly 1074 comprises a ring-shaped second elastomeric seal 1209*b* and a ring-shaped second actuating sleeve 1400*b*.

As shown in FIG. 31, the first and second elastomeric seals 1209*a*, 1209*b* are positioned within respective first and second seal grooves 1211*a*, 1211*b* formed around the outer circumference of the upper packer cartridge assembly 1200. The first and second seal grooves 1211*a*, 1211*b* are radial circumferential recesses within and around the outer surface of the upper packer cartridge assembly 1200, wherein each groove 1211*a*, 1211*b* is formed with two orthogonal walls. The grooves 1211*a*, 1211*b* are sized such that when the actuatable sealing assemblies 1076, 1074 are in the unlocked and unsealed state, the respective elastomeric seals 1209*a*, 1209*b* are housed or located entirely within the grooves 1211*a*, 1211*b* such that the elastomeric seals 1209*a*, 1209*b* do not protrude out of the groove 1211*a* beyond the outer diameter of the upper packer cartridge assembly 1200 and thus do not protrude into the annulus 1024 nor contact the integration joint body 1010, and are thus protected within the respective grooves 1211*a*, 1211*b* (see FIG. 31*b* for a detailed view of the elastomeric seal 1209*a* within the groove recess 1211*a* when in the unlocked and unsealed state). FIG. 31*b* shows that for a specific example of the presently described embodiment, the outer diameter of the upper packer cartridge assembly 1200 is 18.625 inches, the depth of the groove recess 1211*a* is 0.452 inches and which is the same distance as the depth of the elastomeric seal 1209*a*. Accordingly, the elastomeric seal 1209*a* does not protrude out of the groove 1211*a* beyond the outer diameter of the upper packer cartridge assembly 1200 but rather is in line with it. It should be noted that the outer diameter of the elastomeric seal 1209*a* could be less than the depth of the groove 1211*a* and so it would be even further away from protruding beyond the outer diameter of the upper packer cartridge assembly 1200 and therefore it would be even more protected during e.g. running in but that would have the disadvantage that the elastomeric seal 1209*a* would need to be radially expanded even further in order to seal against the inner diameter of the integration joint 1010. Accordingly, it is preferred that the outer diameter of the elastomeric seal 1209*a* is substantially aligned with (i.e. is aligned with or is just slightly shorter than) the depth of the groove 1211*a* Furthermore, FIG. 31*b* shows that the width of the groove recess 1211*a* is 0.750 inches and the inner diameter of the integration joint 1010 is 18.750 inches. Accordingly, FIG. 31*b* also shows that the annulus 1024 is 0.125 inches. Other suitable dimensions for the various components could of course be used as will be recognised by the skilled person. As discussed above, the skilled person will also realise that the depth of the elastomeric seal 1209*a* could be slightly less than the depth (which is 0.452 inches) of the groove or recess 1211*a* as that will also have the advantage that the elastomeric seal 1209*a* will be even more protected by being more than wholly located within the recess or groove 1211*a* whilst the upper packer cartridge assembly 1200 is being run into the integration joint body 1010.

The first and second actuating sleeves 1400*a*, 1400*b* are positioned within respective first and second actuating sleeve grooves 1405*a*, 1405*b*, which are also radial circumferential recesses within and around the outer surface of the upper packer cartridge assembly 1200. The first and second actuating sleeve grooves 1405*a*, 1405*b* are shaped and sized such that the actuating sleeves 1400*a*, 1400*b* can move axially (ie in the direction of Ax to Ax as shown in FIG. 31) within the respective grooves 1405*a*, 1405*b* when the sealing assemblies 1076, 1074 move between unlocked/unsealed and locked/sealed states. When the sealing assembly 1034*a* is in the unlocked/unsealed state, a gap 1224 (as shown in FIG. 34) is formed between the first actuating sleeve 1400*a* and the upper packer cartridge assembly 1200. This gap 1224 allows the first actuating sleeve 1400*a* to move to impinge upon the first seal 1209*a* when the sealing assembly 1034*a* is moved toward/into the locked/sealed state. The gap 1224 may be filled with air, or it may be filled with a lubricating fluid such as hydraulic oil.

The first and second elastomeric seals 1209*a*, 1209*b* are in accordance with the third aspect of the present invention and are substantially compressible in the axial directions (Ax) and have a suitable poisson's ratio such that compression in the axial direction (Ax) will cause a substantially large enough expansion in the radial direction (R) to provide a fluid tight seal between the outer surface of the upper packer cartridge assembly 1200 and the inner surface 1018 of the integration joint body 1010 to thereby seal the annulus 1024 there between.

The first and second actuating sleeves 1400*a*, 1400*b* are for contacting and compressing, respectively the first and second seals 1209*a*, 1209*b*. The first actuating sleeve 1400*a* is aligned with the first seal 1209*a* such that they share a central axis, the central axis projecting through the centre of the first seal 1209*a* and the first actuating sleeve 1400*a*, thus allowing the first actuating sleeve 1400*a* to axially move (ie in the direction Ax to Ax) and impinge upon the first seal 1209*a* equally at all points around the circumference of the first seal 1209*a*.

The first and second actuating sleeves 1400*a*, 1400*b* are substantially non-compressible and substantially non-deformable and are configured to move axially (Ax) with respect to the upper packer cartridge assembly 1200. The first and second actuating sleeves 1400*a*, 1400*b* are typically made from a suitable grade of steel, however any suitable material may be selected.

Still referring to FIG. 31, the locking dog 1064*a* is seated within an aperture formed through the side wall 1022 of the integration joint body 1010 and extends through the integration joint body 1010. The locking dog 1064*a* comprises a radially moveable activating member in the form of a hydraulically operated latch 1410. In the unlocked position shown in FIG. 31, the latch 1410 does not protrude into the annulus 1024, allowing the integration joint body 1010 and the upper packer cartridge 1200 to be free to move relative to each other. The locking dog 1064*a* is configured to allow hydraulic fluid to be pumped into and out of a first piston reservoir 1215*a* and a second piston reservoir 1215*b* via locking dog hydraulic fluid ports 1420*a*, 1420*b*, respectively. Such a configuration allows hydraulic lines from the drilling vessel located above the riser string to be connected to the locking dog 1064*a* such that it can be operated from the drilling vessel. When the latch 1410 is in the locked position the first piston reservoir 1215*a* can be sealed to create a hydraulic lock, holding the latch 1410 in the locked position.

The first and second actuating sleeves 1400*a*, 1400*b* are spaced apart such that the latch 1410 can be inserted between the actuating sleeves 1400*a*, 1400*b* to move the actuating sleeves 1400*a*, 1400*b* axially in the direction Ax from the unsealed state to the sealed state. It will be understood with reference to FIG. 31 that when the latch 1410 is inserted between the first and second actuating sleeves 1400*a*, 1400*b*, the first actuating sleeve 1400*a* moves axially in a first direction (up hole in this embodiment), and the second actuating sleeve 1400*b* moves in a second direction opposite to the first direction (downhole in this embodiment).

Still referring to FIG. 31, the latch 1410 has a first dimension D1 corresponding to the distance the first and second actuating sleeves 1400*a*, 1400*b* are spaced apart in the unsealed state, and a second dimension D2 corresponding to the distance the first and second actuating sleeves 1209*a*, 1209*b* are spaced apart in the sealed state. The upper packer cartridge assembly 1200 is configured to receive the latch 1410 in a slot 1214 which allows the latch 1410 to lock the upper packer cartridge assembly 1200 and integration joint body 1010 together such that they are prevented from being able to move relative to each other (i.e. the sealed and locked state of FIG. 36).

FIG. 32*a* shows a perspective view of the first seal 1209*a*, and FIG. 32*b* shows a cross-sectional view of the first seal 1209*a*. The first seal 1209*a* comprises an inner surface 1430 which is flat in cross sectional view (FIG. 32*b*). The inner surface 1430 is registered with the cylindrical shape of the first seal groove 1211*a*, such that the inner surface 1430 of the first seal 1209*a* can be positioned and seat in the first seal groove 1211*a* in the upper packer cartridge assembly 1200.

The flat inner surface 1430 assists in ensuring that compression of the first seal 1209*a* axially causes radial expansion, radially outwards, to seal the annular gap 1024 between the outer surface of the upper packer cartridge assembly 1200 and the inner surface 1018 of the integration joint body 1010.

In the described embodiment, the first elastomeric seal 1209*a* is made from a sufficiently elastic and resilient material, such as rubber or polyurethane or any other suitable material, with an inner surface 1430 diameter of around 17 inches, an axial dimension (A) of around 0.75 inches and a radial dimension (B) of around 0.452 inches, when in the unlocked and unsealed position. This larger axial dimension (A) than radial dimension (B) also assists in ensuring that the first seal 1209*a* is configured to sufficiently expand radially when compressed axially, so as to seal the annulus 1024 between the upper packer cartridge assembly 1200 and the integration joint body 1010. FIG. 32*c* shows further geometry and dimension details of the embodiment of the first elastomeric seal 1209*a* in accordance with the present invention. In very simplistic terms, the elastomeric seal 1209*a* can be considered to be "D"-shaped in cross section.

The elastomeric seal 1209*a* comprises a substantially flat tubular inner circumferential surface or throughbore 1430 for contact with the circumferential and flat outer surface of the annular groove 1211*a*. It also comprises a convex sealing surface 1432 opposite the said flat surface 1430, where the convex sealing surface 1432 is preferably semioval in shape, curving through 180 degrees on a gradually reducing radius from one end to the other. The elastomeric seal 1209*a* also comprises a first convex connecting surface 1434 which is preferably of constant radius such as 0.375 inches and a second convex connecting surface 1436 which is also preferably of constant radius such as 0.375 inches. Each of the first 1434 and second 1436 connecting surfaces connect the convex sealing surface 1432 to the said flat surface 1430.

The mid-point M-M of the depth of the first seal 1209*a* is shown as having the depth of 0.226 inches and is therefore half of the depth of the first seal 1209*a* that being 0.452 inches. The mid-point M-M also serves as the transition or juncture between the curvature of the semioval convex sealing surface 1432 which extends all the way round from the first mid-point M (the upper mid-point M shown in FIG. 32*c*) to the lower mid-point M shown in FIG. 32*c*. The first convex connecting surface 1434 connects (at its second end) the upper end of the convex sealing surface 1432 at upper mid-point M to a first transition corner C1 (at its first end) which in turn is connected to the upper end of the flat inner surface 1430. The lower mid-point M of the convex sealing surface 1432 forms the second end of the second convex connecting surface 1436 where the other end (the first end) of the second convex connecting surface 1436 comprises a second transition corner C2 which in turn forms the lower end of the flat inner surface 1430. FIG. 32*c* also shows that the inner diameter of the flat inner surface 1430 is 17.721 inches and the first transition corner C1 and second transition corner C2 each have relatively small radii being 0.040 inches. These rounded transition corners C1 and C2 ensure that there are no sharp corners around the circumference of the elastomeric seal 1209*a* and therefore the embodiments of the elastomeric seal 1209*a* have the advantage of having reduced shear stress experienced than otherwise would be the case if that junction had a sharp corner.

In addition, the convex sealing surface 1432 comprises a varying radius which starts out relatively large at the centre point CP of the convex sealing surface 1432 but starts to reduce in diameter toward each end of the convex sealing surface 1432 as it approaches the junction with each of the first 1434 and second 1436 convex connecting surfaces. In other words, the first convex connecting surface 1434 comprises a curved surface which curves or arcs from its first end (at the junction with C1) to its second end (at its flat or seamless join with the first end of the convex sealing surface 1432) toward a radius plane (i.e. the plane that is perpendicular to the longitudinal central axis of the seal 1209*a*) such the second end of the first convex connecting surface 1434 lies on the radius plane in a direction parallel to the radius plane. In addition, the second convex connecting surface 1436 comprises a curved surface which curves or arcs from its first end (at the junction with C2) to its second end (at its flat or seamless join with the second end of the convex sealing surface 1432) toward the radius plane (i.e. the plane that is perpendicular to the longitudinal central axis of the seal) such the second end of the second convex connecting surface 1436 lies on the radius plane in a direction parallel to the radius plane.

The semioval shape of the convex sealing surface 1432 means that the first end thereof preferably curves from the midpoint CP of the convex sealing surface 1432 (which is preferably parallel to the longitudinal central axis of the seal 1209*a*) towards its first end in a gradually reducing radius until the first end lies on the radius plane in a direction parallel to the radius plane at which point it meets the first end of the first convex connecting surface in a seamless manner, such that there is no corner nor otherwise angled junction between the said two ends. This has the advantage of reducing the shear stress experienced at that area of the seal 1209*a* particularly during axial compression of the seal 1209*a*.

Preferably, the second end of the convex sealing surface 1432 curves from the midpoint CP of the convex sealing surface 1432 towards its second end in a gradually reducing radius until the second end lies on the radius plane in a direction parallel to the radius plane at which point it meets the second end of the second convex connecting surface 1436 in a seamless manner, such that there is no corner nor otherwise angled junction between the said two ends. This also has the advantage of reducing the shear stress experienced at that area of the seal 1209*a* particularly during axial compression of the seal 1209*a*.

This geometric arrangement of the first seal 1209 has the advantage that it increases the ability of the first seal 1209*a* to expand radially as the first seal 1209*a* is compressed axially. In addition, the geometry also assists in enhancing the seal and indeed the movement of the first seal 1209*a* into the corners of the groove recess 1211*a* as will be shown subsequently. It will be understood that different dimensions may be used, and may be required with different materials. The first seal 1209*a* is shown in FIGS. 32*a* and 32*b*, however it will be appreciated that the first and second seals 1209*a*, 1209*b* are substantially identical.

Similarly, to the flat inner surface 1430 of the first seal 1209*a* being registered with the shape of the first seal groove 1211*a*, the first actuating sleeve 1400*a* comprises a flat inner surface 1218 which is registered with the cylindrical shape of the first actuating sleeve groove 1405*a*, such that the first actuating sleeve 1400*a* can be positioned and seat in the first actuating sleeve groove 1405*a* in the upper packer cartridge assembly 1200. The corresponding flat inner surface 1218 and first actuating sleeve groove 1405*a* assist in ensuring that the first actuating sleeve 1400*a* can move axially within the upper packer cartridge assembly 1200.

Referring to FIG. 33*b* (and also shown in FIG. 31), the first actuating sleeve 1400*a* comprises a tapered shoulder 1213*a* for engaging with a similarly tapered face 1219*a* of the latch 1410 of the locking dog 1064*a*. The tapered face 1219*a* tapers from the first dimension D1 to the second dimension D2, such that when the latch 1410 is inserted radially into the slot 1214 of the upper packer cartridge assembly 1200 between the first and second actuating sleeves 1400*a*, 1400*b* the first and second actuating sleeves 1400*a*, 1400*b* will be moved axially from the unsealed and unlocked position or state to the sealed and locked position or state.

Furthermore, the first actuating sleeve 1400*a* comprises a stepped configuration, wherein registration of the shape of the first actuating sleeve 1400*a* and the first actuating sleeve groove 1405*a* allows axial movement of the first actuating sleeve 1400*a*, and provides a gap 1224 (see FIG. 34) to allow the first actuating sleeve 1400*a* to move to close that gap 1224 such that a protruding face 1220 will press against the first seal 1209*a* (not shown).

Referring now to FIG. 33*c*, which shows the inner surface 1218 of the first actuating sleeve 1400*a* further comprising slots 1221 for receiving pins (not shown). FIG. 34 shows a cross-sectional view of the first actuating sleeve 1400*a* through one of the slots 1221 and a corresponding pin 1222. The pin 1222 is mounted in the upper packer cartridge assembly 1200, although it will be understood that it could also be an integral part of the upper packer cartridge assembly 1200. The pin 1222 is configured to be smaller than the corresponding slot 1221, to allow the slot 1221, and so the first actuating sleeve 1400*a* to move with respect to the pin 1222.

The slot 1221 comprises a first wall 1223*a* and a second wall 1223*b*, each wall 1223*a*, 1223*b* being for arresting the axial movement of the first actuating sleeve 1400*a*. In the unsealed and unlocked position, the first actuating sleeve 1400*a* is arrested from moving further by the pin 1222 contacting the first wall 1223*a*. In the sealed and locked position, the first actuating sleeve 1400*a* is arrested from moving further by the pin 1222 contacting the second wall 1223*b*. The sizing of the pin 1222 and corresponding slot 1221 determines the allowable movement between the unsealed and unlocked position, and the sealed and locked position, and ensures that the first actuating sleeve 1400*a* cannot fall out of the first actuating sleeve groove 1405*a*.

It will be appreciated that, as described with reference to FIG. 30, more than one locking dog 1060*a*, 1060*b*, 1064*a*, 1064*b*, 1068*a*, 1068*b* may act on a single activating sleeve. For example, in the integration joint assembly 1005 shown in FIG. 30, two locking dogs 1064*a*, 1064*b* act on the first actuating sleeve 1400*a* but there are preferably six locking dogs 1064 equally spaced around the circumference of the integration joint body 1010 in each of sets (1), (2) and (3). In other embodiments, any number of locking dogs may be positioned to act on a single activating sleeve, although typically they will be spaced equally around the circumference of the integration joint body 1010.

In the unlocked and unsealed state, the upper packer cartridge assembly 1200 can be run within the integration joint body 1010, thus allowing the upper packer cartridge assembly 1200 to either be installed within or removed from the integration joint body 1010, without any contact between the seals 1209*a*, 1209*b* and the integration joint body 1010.

This ensures the integrity of the seals 1209*a*, 1209*b* and ensures that the seals 1209*a*, 1209*b* are not damaged or worn by being run into or pulled from the integration joint body 1010. The same advantage is accorded to the lower packer cartridge assembly 1100 and RCD bearing assembly 1300 for the same reasons.

Installation and Retrieval of Cartridge Assemblies 100, 200 and RCD Bearing Assembly 300 into and from Through Bore 16 of the Integration Joint Body 10

FIG. 3 shows the running tool 54 being lowered on the drill string 50 in order to run in the lower 100, upper 200 packer cartridge assemblies and the RCD bearing assembly 300 until such a point that a seat 120 provided at the very lower most end of the lower packer cartridge assembly 100 lands on a lower most integration joint load shoulder 26, at which point the lower packer cartridge assembly 100, upper packer cartridge assembly 200, RCD bearing assembly 300 and indeed the running tool 54 can move no further down the integration joint body 10 and thus their movement is arrested and they are thus now wholly contained and individually each located co-axially within the through bore 16 of the integration joint body 10. It should be noted that this landing or load shoulder 26 as shown in FIG. 1 is a fixed shoulder on the inner diameter at the lower end of the integration joint body 10 but alternatively it could be provided by for example any other suitable means such as an additional set of retractable dogs (not shown). In any event, the lower packer cartridge assembly 100 is now located in its operative position/location within the through bore 16 of the integration joint body 10. The skilled person will note from FIGS. 3, 2 and 1 that the integration joint body 10 is provided with a series of locking dogs 60, 64, 68 formed through its side wall 22 at longitudinally spaced apart lengths along the integration joint body 10. With respect to the lower most locking dogs 60, these are arranged in use to be aligned with the groove 114 formed around the lower packer cartridge body 104, as shown in FIG. 4. The skilled person will note that in FIGS. 1, 2, 3 and 4, the various locking dogs 60, 64, 68 are arranged to be retracted such that they do not interfere with the running in of the running tool 54.

Once the lower seat 120 of the lower packer cartridge assembly 100 has landed on the load shoulder 26, the integration joint assembly 5 is complete in that it now comprises the integration joint body 10 and within its through bore are now located the lower and upper packer cartridge assemblies 100, 200 and the RCD bearing assembly 300.

Indeed, the seals 109, 209 on the outer diameter of the upper 200 and lower 100 packer cartridge assemblies are engaged on the inner diameter 18 of the integration joint body 10 and seals 317 provided on the outer diameter of the RCD bearing assembly 300 are also engaged on the inner diameter 18 of the integration joint body 10 in order to seal the annulus there between.

The upper RCD seal 304 and lower RCD seal 302 are generally formed of a resilient material such as rubber or polyurethane or any other suitable material and in use will act as a relatively tight sealing ring through which the operator (when conducting MPD operations) will physically push the drill pipe string in order to have the drill pipe string pass through the RCD bearing assembly 300. Accordingly, the lower RCD seal 302 and upper RCD seal 304 are adapted to stretch in the radially outwards direction as the drill pipe string 50 is pushed through them and indeed are adapted to always seal via their respective inner surfaces to the outer surface of the drill pipe string up to the point where the drill pipe string is removed from within their through bore or ultimately up until the point that the upper or lower RCD seals 302, 304 fail. Moreover, because each of the upper 304 and lower 302 RCD seals are provided with their respective bearings 305, 308, the lower 302 and upper 304 RCD seals will rotate with the drill pipe string when it rotates relative to the stationary riser string and integration joint body 10.

Figure 5:
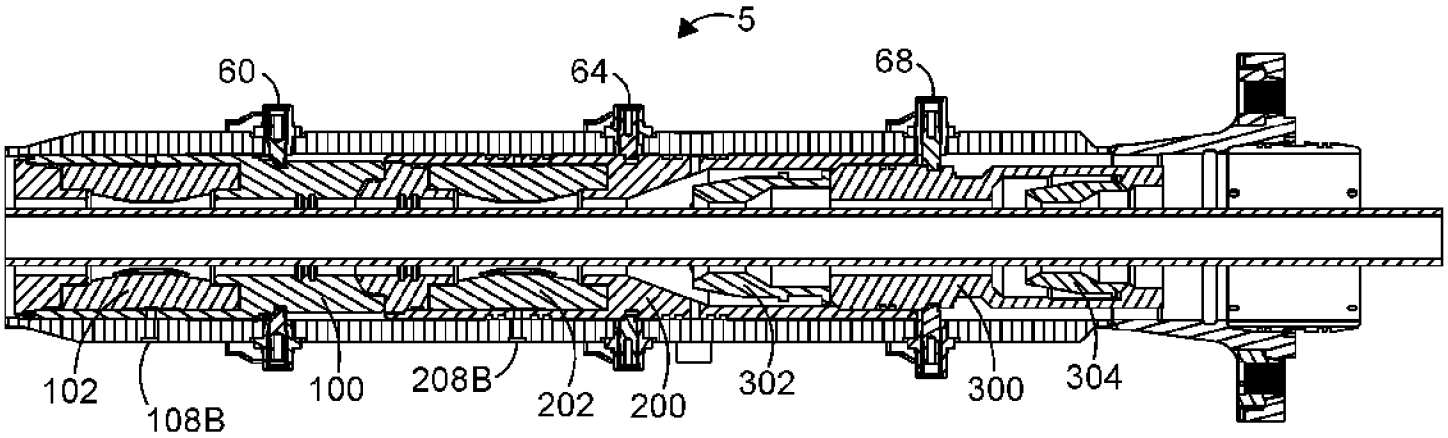

In order to prepare for MPD, the operator will lock the lower packer cartridge assembly 100, upper packer cartridge assembly 200 and RCD bearing assembly 300 in the position as shown in FIG. 5 by actuating at least the RCD assembly locking dogs 68 such that they project inwards through the side wall 22 and into the recess 314 of the RCD bearing assembly 300. In order to increase the safety factor however, the operator will also likely actuate the upper packer cartridge locking dogs 64 such that they project through the side wall 22 and into the recess 201 of the upper packer cartridge assembly 200. In addition, to further increase the safety factor, the operator will also likely actuate the lower packer cartridge locking dogs 60 such that they project through the side wall 22 and into the recess 101 of the lower packer cartridge assembly 100.

Accordingly, the integration joint assembly 5 is now in the configuration as shown in FIG. 5 and indeed is now ready to commence MPD operations. In this configuration, the lower RCD seal 302 is providing the main annular barrier to drill fluid and cuttings flowing back to surface via the goose necks of the MPD flow spool (not shown) up the annulus 24 such that the drilling fluid cannot flow past the lower RCD seal 302 and therefore the drilling fluid is forced out of the MPD flow spool located immediately below the integration joint assembly 5 in accordance with MPD operations. The upper RCD seal 304 is therefore mainly providing redundancy in case the lower RCD seal 302 fails and indeed legislation in many parts of the world requires there to be such redundancy or back up in terms of an additional or back up barrier or seal to the high pressure drilling fluid. In the arrangement shown in FIG. 5, the lower annular packer seal 102 and the upper annular packer seal 202 are not energised and therefore are deflated such that they are not sealing against the outer surface of the drill pipe string 50. However, the upper 202 and/or lower 102 annular packer seals can be actuated/energised in order to seal against the outer surface of the drill pipe string 50 and therefore to seal the annulus 24 if the operator requires/wishes that to happen particularly if for example the operator wishes to pull/change out the RCD bearing assembly 300 and such an operation is shown in FIGS. 6-8; the operator could then run in a new RCD bearing assembly 300 on a suitable running tool.

Figure 6:
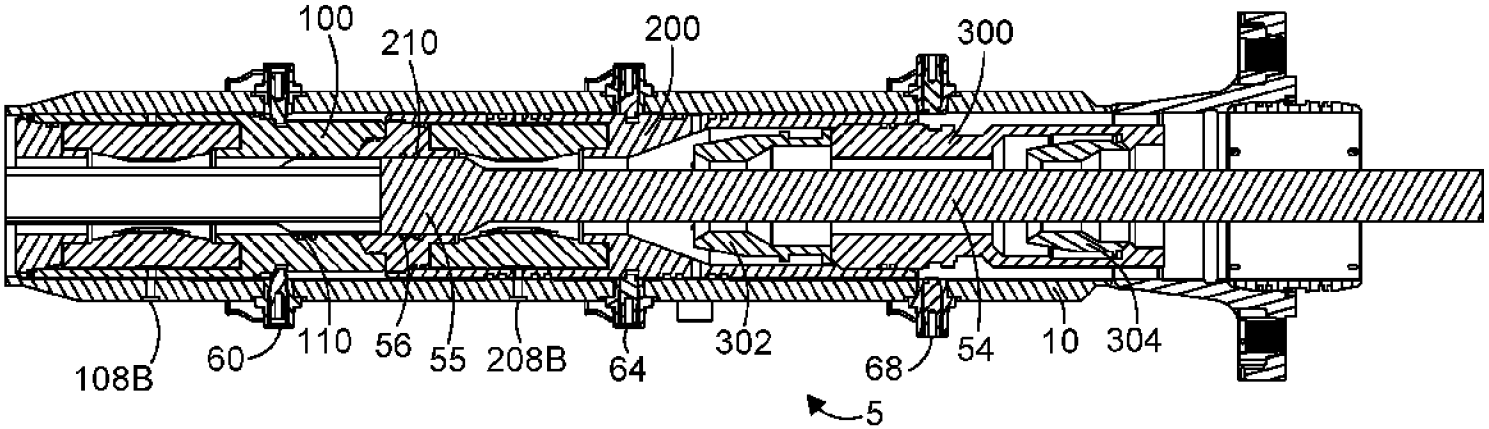
Figure 7:
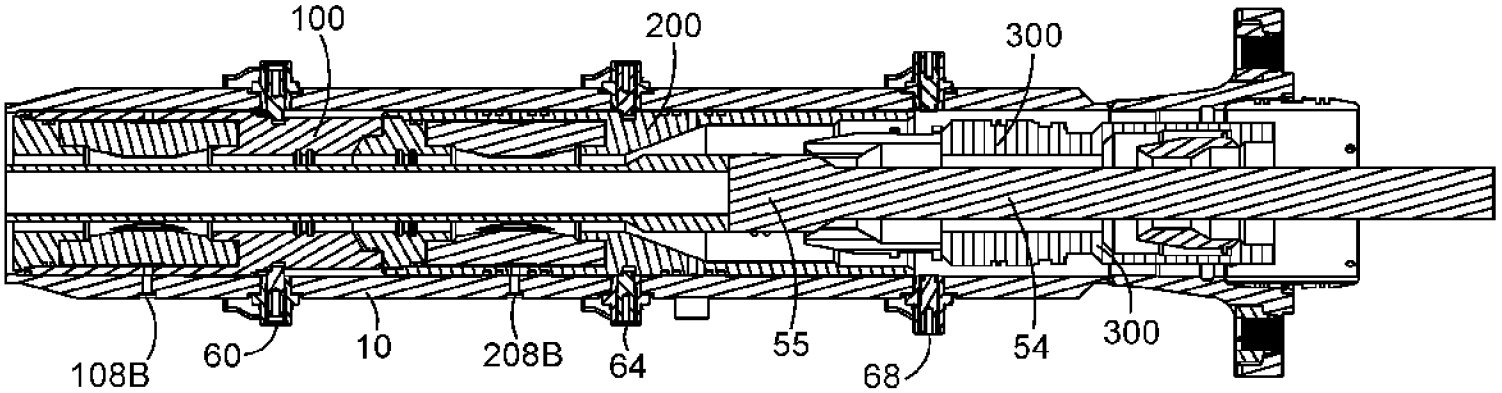

FIG. 6 therefore shows the start of an operation to change out the RCD bearing assembly 300 on its own (with both the upper 200 and lower 100 packer cartridges being left locked in place in the through bore of the integration joint body 10). In order the start such an operation as shown in FIG. 6, the RCD bearing assembly locking dogs 68 are retracted and this can be done whilst maintain full sealing operation of the energised upper 202 and/or lower 102 annular packer seals. Accordingly, as shown in FIG. 6, the running/retrieval tool 54 is run down into the integration joint body 10 until its enlarged lower end 55 passes and squeezes firstly through the upper RCD seal 304 and then through the lower RCD seal 302. The RCD assembly locking dogs 68 are then retracted from their locking engagement with the groove or recess 314 by remote actuation thereof by the operator and this position is now shown in FIG. 6. FIG. 7 shows the RCD bearing assembly 300 as having been unseated from the upper packer cartridge assembly 200. It should also be noted that the RCD bearing assembly 300 can be lifted either using the dedicated running/retrieval tool 54 or indeed could be lifted back to the floating vessel (not shown) at the surface using the drill pipe collar because the lower RCD seal 302 and indeed the upper RCD seal 304 will seat against the upper surface of a drill pipe collar and because the RCD bearing assembly 300 is unlatched, only the weight of the RCD bearing assembly 300 need be overcome in order to lift the RCD bearing assembly 300 back to the surface through the through bore of the riser string. In any event, the running/retrieval tool 54 is then picked back up until the enlarged lower end 55 seats up against the lower end of the lower RCD seal 302. Because the RCD bearing assembly 300 is no longer locked in place (because the RCD assembly locking dogs 68 have been retracted) the enlarged lower end 55 therefore picks up the RCD bearing assembly 300 and further lifting of the running/retrieval tool 54 will raise the RCD bearing assembly 300 upwards until it exits the upper end of the through bore 16 of the integration joint body 10 and further lifting will lift it through the through bore of the telescopic joint located above the integration joint body 10 until the RCD bearing assembly 300 can be removed from the running/retrieval tool 54 by the operator at the surface of the moon pool (not shown). FIG. 8 shows the RCD bearing assembly 300 as having exited the through bore 16 of the integration joint body 10. At this point, the upper 202 and/or lower 102 annular packer seal(s) can continue to be energised or can be de-energised after the RCD bearing assembly 300 has been removed depending on operational requirements and in particular if MPD is concluded, the lower 100 and upper 200 packer cartridge assemblies can be de-energised and pulled from the integration joint body 10 as is now shown in FIGS. 9-16.

Figure 8:
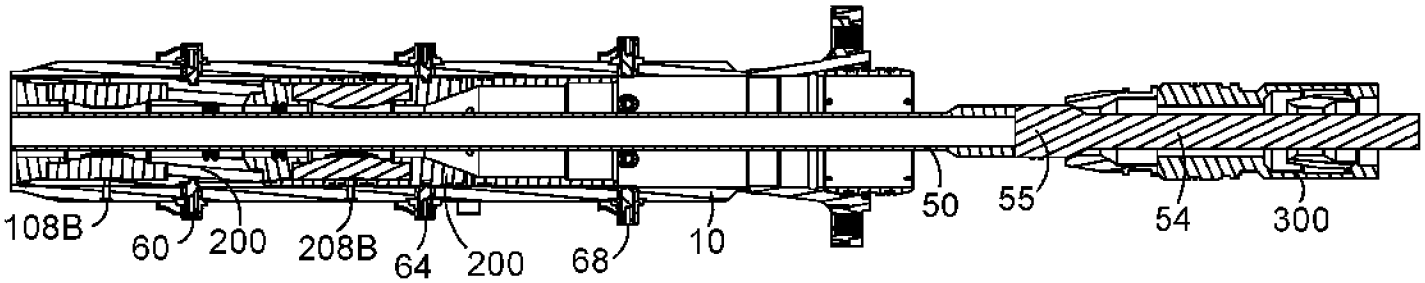
Figure 9:
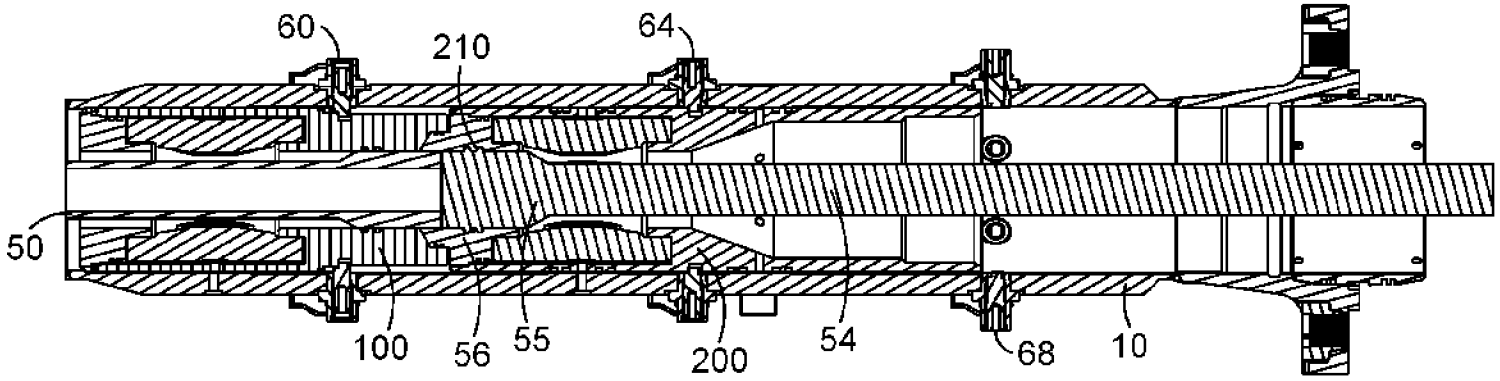

FIG. 9 shows the next stage of operations on from that of FIG. 8 if the operator wishes to remove the upper packer cartridge assembly 200. In such a case, the operator attaches a suitable running/retrieval tool 54 having a suitably shaped retrieval profile 56 arranged to co-operate and engage with the retrieval profile 210 formed on the inner through bore 207 of the upper packer cartridge assembly 200. The running/retrieval tool 54 is run initially through the through bore of the telescopic joint (not shown) positioned immediately above the integration joint assembly 5 and into the through bore of the integration joint body 10 and can be run in on the upper end of the drill pipe string 50. The running tool 54 is run in until it locks onto the retrieval groove profile 210 of the upper packer cartridge assembly 200. This stage is shown in FIG. 9.

Figure 10:
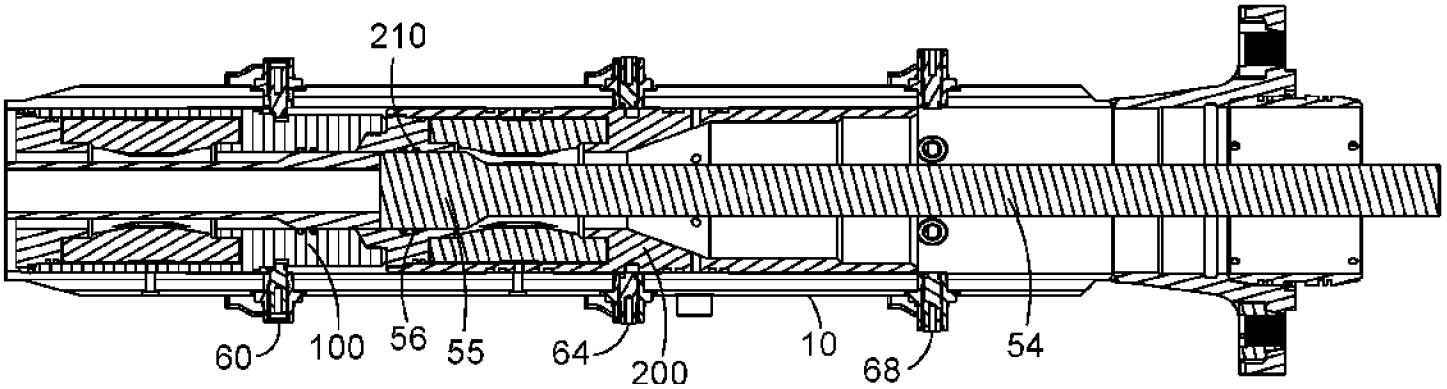
FIG. 10 shows the next stage of operation on from that of FIG. 9 of the retrieval of the upper annular packer seal, where the upper packer cartridge locking dogs have been retracted.

The operator then remotely actuates the upper packer cartridge locking dogs 68 in order to retract them from engagement with the groove 214 such that the upper packer cartridge assembly 200 is no longer locked in place within the integration joint body 10 and this stage is shown in FIG. 10. It should be noted that the unlocking of the upper packer cartridge assembly 200 can be achieved whilst maintaining full operation of the lower packer cartridge assembly 100 and the lower packer cartridge assembly 100 may be energised/de-energised during this process depending on the operational requirements of the operator.

Figure 11:
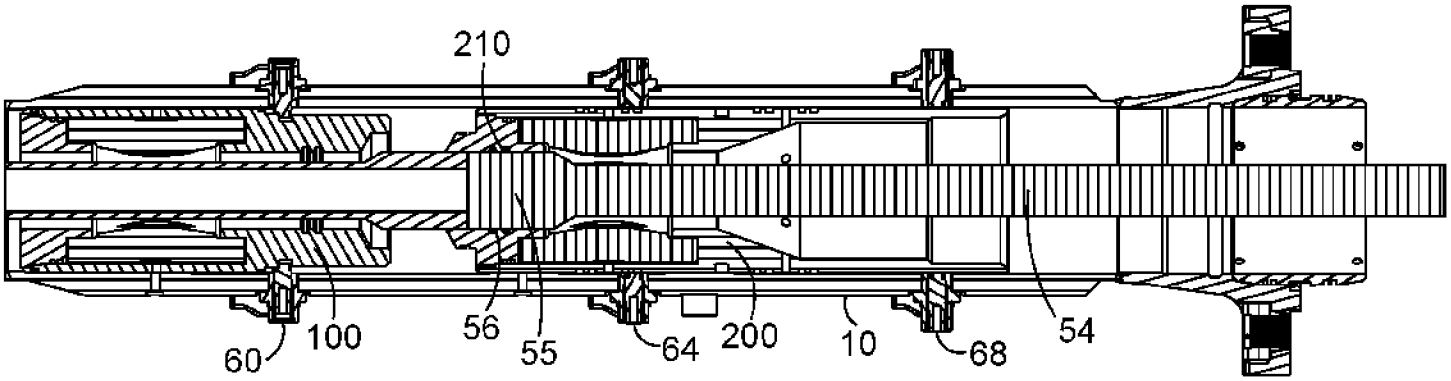
FIG. 11 shows the next stage on from that of FIG. 10 of the retrieval of the upper annular packer seal where the upper annular packer seal cartridge has been unseated and lifted from the lower annular packer seal cartridge (the latter of which remains in place and which remains energised in order to provide an annular seal)

FIG. 11 shows the next stage of the operation to remove the upper packer cartridge assembly 200, whereby the upper packer cartridge assembly 200 is unseated from the lower packer cartridge assembly 100 by pulling the drill pipe string 50 upwards to thereby lift and raise the retrieval tool 54 and thus the upper packer cartridge assembly 200 upwards.

Figure 12:
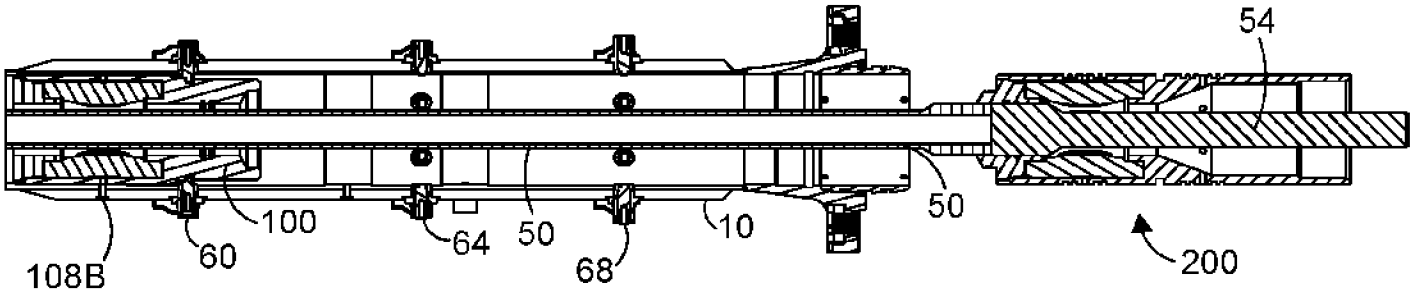
FIG. 12 shows the next stage on from that of FIG. 11 of the retrieval of the upper annular packer seal, where the upper annular packer seal has been pulled out of the through bore of the integration joint body.

FIG. 12 shows the next stage whereby the upper packer cartridge assembly 200 has been lifted up and out of the through bore 16 of the integration joint body 10 such that it will pass through the telescopic joint (not shown) and up to the drill floor of the marine vessel located above the riser string.

If the operator wishes to remove the lower packer cartridge assembly 100, the retrieval tool 54 is once again run down into the integration joint body 10 on the drill string 50 at the top thereof such that it is run through the telescopic joint (not shown) and into the integration joint body 10. The retrieval tool 54 is moved sufficiently downwards such that its retrieval profile 56 is moved into alignment with the retrieval profile 110 formed by the grooves provided on the inner surface of the through bore 105 of the lower packer cartridge body 104 until the respective profiles 56, 110 are in locking engagement with one another. It should be noted that the retrieval tool 54 and retrieval profile 56 could be the same retrieval tool 54 and retrieval profile 56 that were used to retrieve the upper packer cartridge assembly 200 although it may be that they could be different if operational requirements would find that beneficial. This point in the operation is shown in FIG. 13.

Figure 13:
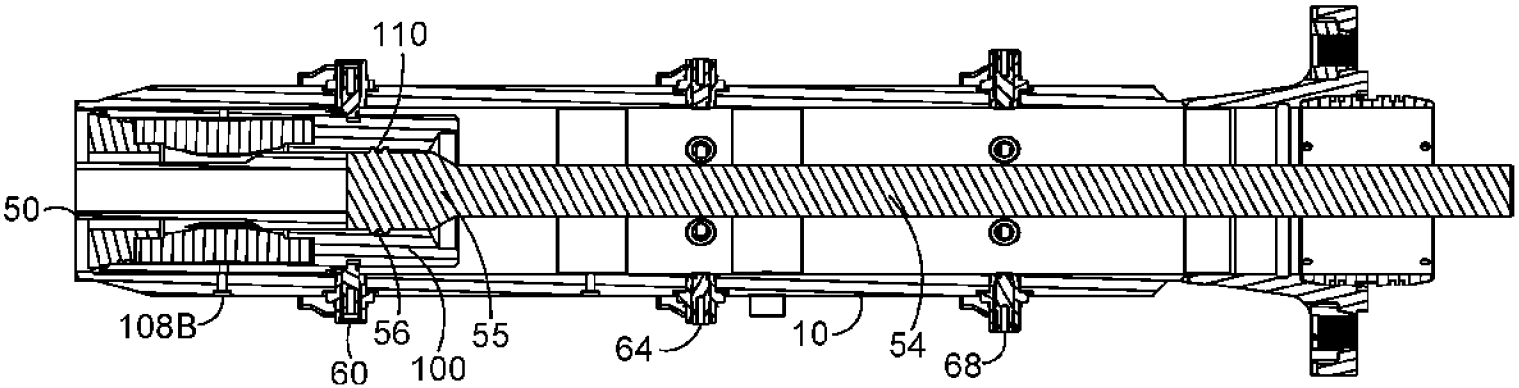
FIG. 13 shows a next stage on from that of FIG. 12 where this next stage is conducted if the lower annular packer seal requires to be replaced, in which case the retrieval tool is run into the through bore of the integration joint body again until the retrieval tool locks into the retrieval profile of the lower annular packer seal.
Figure 14:
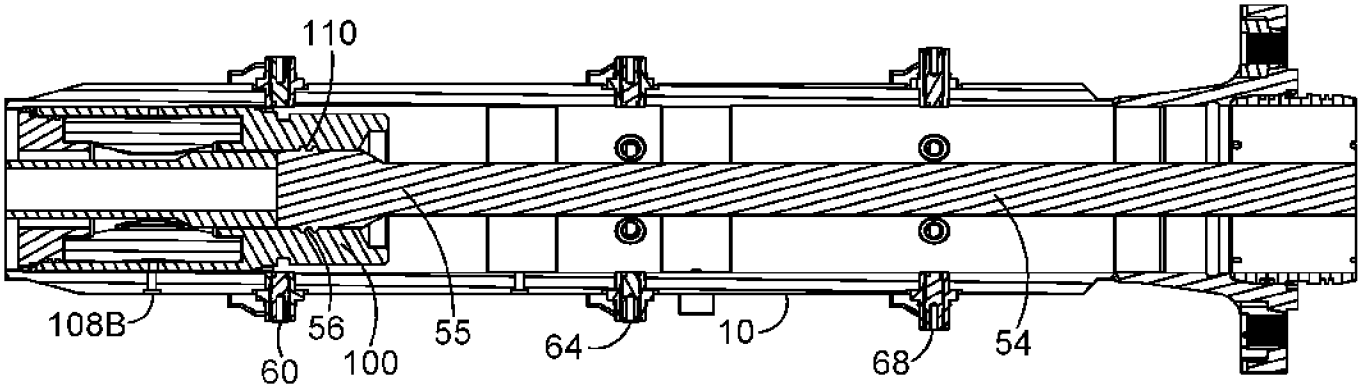
FIG. 14 shows the next stage on from that of FIG. 13 of the retrieval of the lower annular packer seal, where the lower packer cartridge locking dogs of the integration joint have been retracted such that the lower annular packer seal cartridge can now be retrieved and pulled out of the through bore of the integration joint body through bore by the retrieval tool.
Figure 15:
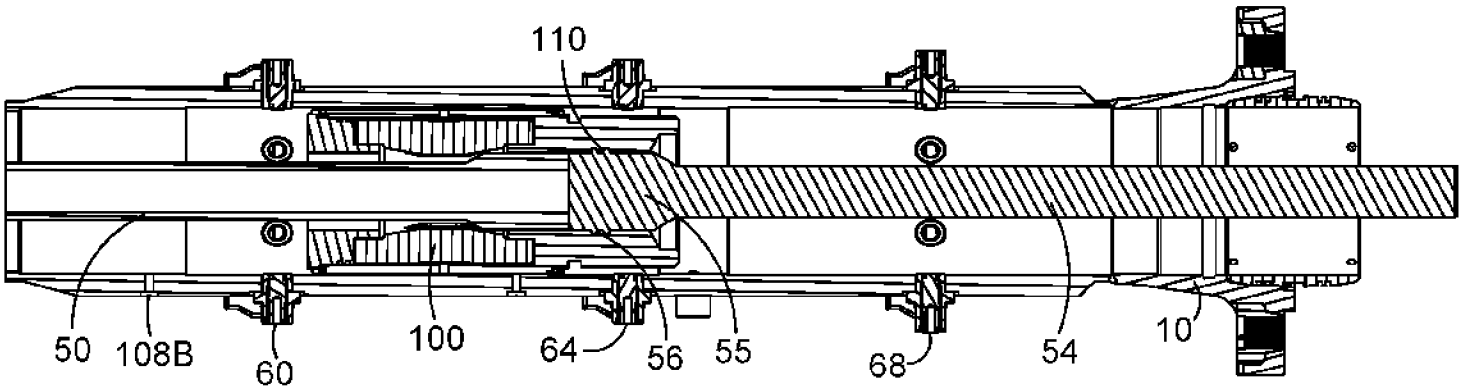
FIG. 15 shows the next stage on from that of FIG. 14 of the retrieval of the lower annular packer seal, where the retrieval tool has been lifted partly out of the through bore of the integration joint body.

FIG. 14 shows the next stage on from that of FIG. 13, whereby the lower packer cartridge locking dogs 60 have been retracted by the operator remotely actuating them to move them back through the side wall 22 of the integration joint body 10 such that they are no longer in engagement with the recess 114 provided in the lower packer cartridge body 104. Thus, the lower packer cartridge assembly 100 is no longer locked in place within the integration joint body 10 by the lower packer cartridge locking dogs 60 and thus the lower packer cartridge assembly 100 can be unseated from the integration joint body 10 by pulling the drill pipe string 50 upwards in order to pull the retrieval tool 54 upwards and this stage in the operation is shown in FIG. 15.

Figure 16:
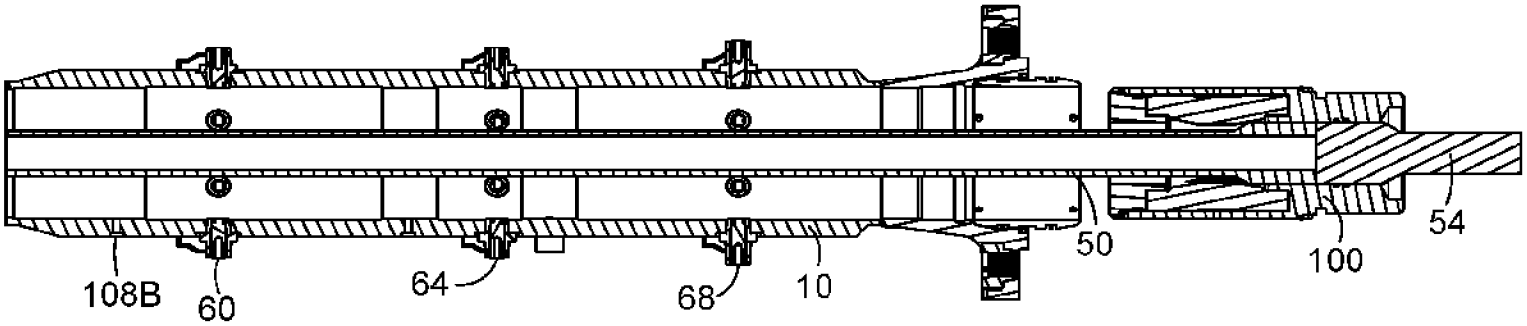
FIG. 16 shows the next stage on from that of FIG. 15 of the retrieval of the lower annular packer seal, where the lower annular packer seal has been lifted and pulled out of the through bore of the integration joint body and therefore at this stage there is no annular seal acting within the annulus of the integration joint body.

Continued lifting of the drill pipe string and retrieval tool 54 lifts the lower packer cartridge assembly 100 out of the through bore 16 of the integration joint body 10 and through the telescopic joint (not shown) to the surface. This stage in the operation is shown in FIG. 16.

Figure 17:
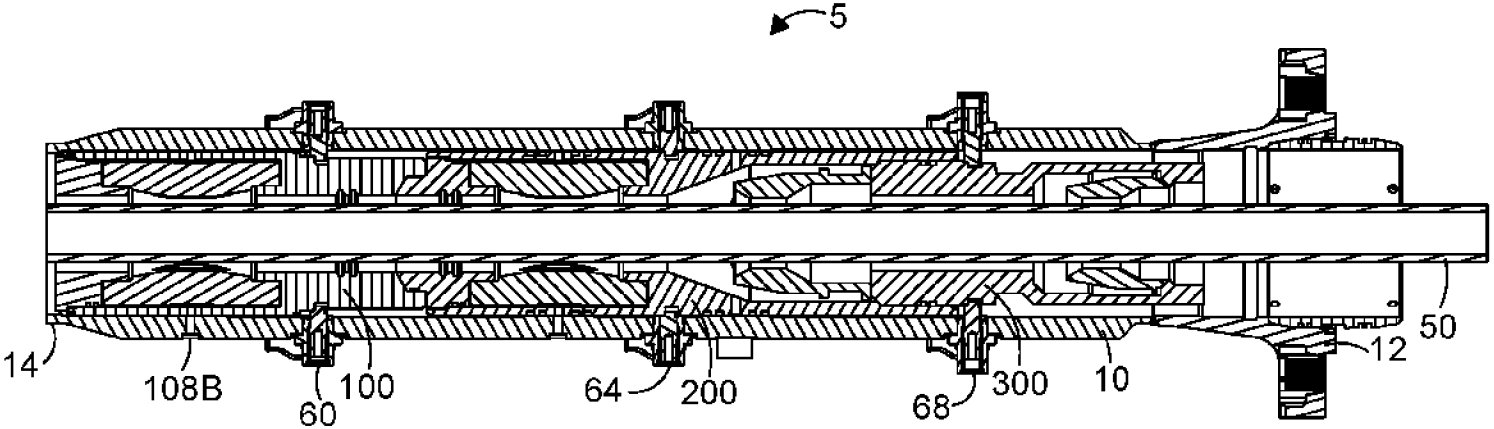
FIG. 17 shows that, following on from the stage of FIG. 16, the stages of FIG. 3 through FIG. 5 have been repeated in order to reinstall a new lower annular packer seal, upper annular packer seal and new RCD bearing assembly into the through bore of the integration joint body.

If the operator wishes, the operator can repeat the stages shown in FIGS. 3-5 in order to reinstall new upper 200 and lower 100 packer cartridge assemblies and a new RCD bearing assembly 300 in order to reinstall them into the through bore 16 of the integration joint body 10. Indeed, FIG. 17 shows the RCD bearing assembly 300, upper packer cartridge assembly 200 and lower packer cartridge assembly 100 as having been reinstalled following the steps of FIG. 3-5.

In addition, the operator has additional flexibility in that it is possible to remove different combinations of the RCD bearing assembly 300 and the upper 200 and lower 100 packer cartridge assemblies depending upon operational requirements.

For example, the operator can decide to remove the RCD bearing assembly 300 and the upper packer cartridge assembly 200 as one unit by running the retrieval tool 54 from the surface down through the telescopic joint and into the through bore 16 of the integration joint body 10. The operator can arrange the running/retrieval tool 54 to lock into the grooved recessed profile on the inner diameter surface 205 of the upper packer cartridge assembly 200 and this stage of the operation is shown in FIG. 18.

The operator will then remotely unlock the RCD assembly locking dogs 68 by retracting them through the side wall 22 and will also instruct the upper packer cartridge locking dogs 64 to retract again by withdrawing them back through the side wall 22 such that the RCD bearing assembly 300 and the upper packer cartridge assembly 200 are now unlocked with respect to the integration joint body 10. It should be noted that this unlocking can be achieved whilst fully maintaining operation of the lower packer cartridge assembly 100. Moreover, the lower packer cartridge assembly 100 may be energised or de-energised during this stage as shown in FIG. 19 depending on the operational requirements of the operator. FIG. 20 shows the next stage on from FIG. 19 where the upper packer cartridge assembly 200 and the RCD bearing assembly 300 are unseated from the lower packer cartridge assembly 100 by pulling up the retrieval tool 54 and drill string 50. FIG. 21 shows the continued pulling of the retrieval tool 54 and thus the upper packer cartridge assembly 200 and RCD bearing assembly 300 up out of the through bore 16 of the integration joint body 10 and through the telescopic joint (not shown) to the surface of the riser string such that the operator can then remove the retrieval tool 54 from the drill string 50. FIG. 22 shows a new upper packer cartridge assembly 200 and RCD bearing assembly 300 having been run into the through bore 16 of the integration joint body 10 on the running/retrieval tool 54 until the upper packer cartridge assembly 200 lands on the upper end of the lower packer cartridge assembly 100. The running/retrieval tool 54 does this by locking its profile 56 to the running/retrieval profile 210 of the upper packer cartridge assembly 200 and running both the running/retrieval tool 54 and the RCD bearing assembly 300 and upper packer cartridge assembly 200 through the through bore of the telescopic joint (not shown) into the through bore 16 of the integration joint body 10. At this point, as shown in FIG. 22, the RCD assembly locking dogs 68 and the upper packer cartridge locking dogs 64 are retracted in order not to impede the progress of the RCD bearing assembly 300 and upper packer cartridge assembly 200 into the through bore 16 of the integration joint body 10. FIG. 23 shows the next stage on from that of FIG. 22 in that the upper packer cartridge assembly 200 has landed on the upper end of the lower packer cartridge assembly 100 and the upper packer cartridge locking dogs 64 are actuated such that they extend into the recess groove 214 (such that the upper packer cartridge assembly 200 is locked in place within the through bore 16 of the integration joint body 10) and the RCD assembly locking dogs 68 are also actuated such that they extend through the side wall 22 of the integration joint body 10 and into the recessed groove 314 formed on the outer surface around the circumference of the RCD bearing body 306 such that the RCD bearing assembly 300 is locked in place within the through bore 16 of the integration joint body 10.

FIG. 24 shows the next stage on from that of FIG. 23 where the running tool 54 has been withdrawn up through the integration joint assembly 5 and further up through the telescopic joint (not shown) located immediately above the integration joint assembly 5 and back to the surface, such that the operator can now commence MPD again should they wish.

FIG. 28 shows for clarity purposes another view of the integration joint assembly 5 with the lower packer cartridge assembly 100, upper packer cartridge assembly 200 and RCD bearing assembly 300 all locked in place in the through bore 16 thereof by the respective locking dogs 60, 64, 68 but without the drill string 50 passing there through.

FIG. 29 again shows the integration joint assembly 5 with the lower 100 and upper 200 packer cartridge assemblies and also the RCD bearing assembly 300 locked in place by their respective locking dogs 60, 64, 68 but also shows the drill string 50 passing through the through bore 16 of the integration joint assembly 5 but also shows that the lower annular packer seal 102 has been energised 102*e* as has the upper annular packer seal 202*e* by having hydraulic fluid pumped into the outer surface thereof from the lower 108B and upper 208B packer hydraulic fluid extend ports which are aligned with the respective set of hydraulic ports 108A, 208A such that the lower 102*e* and upper 202*e* energised annular packer seals 102, 202 are sealing against the outer surface of the drill string 50 and therefore are providing a seal within the annulus 24 of the integration joint body 10 and thus the riser string.

Locking and Sealing of the Upper and Lower Packer Cartridge Assemblies 100, 1100, 200, 1200 and RCD Bearing Assemblies 300, 1300 Against the Through Bore 16, 1016 of the Integration Joint Body 10, 1010

In the first example, the lower packer cartridge seals 109 and upper packer cartridge seals 209 are provided on the outer diameter of the lower 100 and upper 200 packer cartridge assemblies, which respectively seal on the inner diameter of the integration joint body 10 and prevent any fluid in the riser string from leaking past the respective lower 100 and upper 200 packer cartridge assemblies.

Furthermore, the RCD bearing assembly seal 317 provided on the outer diameter of the RCD bearing assembly 300, seals on the inner diameter of the integration joint body 10.

In the first embodiment in accordance with the present invention, the integration joint body 1010 is locked and sealed with the lower packer cartridge 1100 and upper packer cartridge 1200, and the RCD bearing assembly 1300 if and when present. The method of locking and sealing the upper packer cartridge 1200 with the integration joint body 1010 using the first and second actuatable sealing mechanisms 1076, 1074 and the locking dogs 1064*a*, 1064*b* is now described with reference to FIGS. 31, 35 and 36, but the same method is used when locking and sealing the lower packer cartridge assembly 1100 and the RCD bearing assembly 1300 by using their respective actuatable sealing mechanisms 1070, 1072; 1078 and respective locking dogs 1060*a*, 1060*b*; 1068*a*, 1068*b*. Firstly, referring to FIG. 31, the operator is able to move upper packer cartridge 1200 relative to the integration joint body 1010, as the actuatable sealing mechanisms 1076, 1074 are in the unsealed and unlocked state. The latch 1410 of the locking dog 1064*a* is in the integration joint body 1010 and not protruding into the slot 1214 in the upper packer cartridge assembly 1200, and therefore not stopping the relative movement of the integration joint body 1010 and the upper packer cartridge assembly 1200.

This allows the operator to pull components out of the integration joint assembly 1005 for servicing or replacement as required. When the integration joint assembly 1005 is to be reassembled with the lower packer cartridge 1100, upper packer cartridge 1200 and, although not shown in this embodiment, the RCD bearing assembly 1300 or other components, they are run into the integration joint body 1010 until they seat in their respective positions. In this unlocked and unsealed state the seals 1209*a*, 1209*b* are not protruding into the annulus 1024 and are not sealing the annulus 1024, and furthermore the seals 1209*a*, 1209*b* are retracted into the upper packer cartridge assembly 1200 and so they are hidden from contact with any components such as the integration joint body 1010, which could damage the seals 1209*a*, 1209*b* if they are in contact with, whilst moving relative to, these components.

When the operator wishes to lock the integration joint body 1010 with the upper packer cartridge assembly 1200 and seal the annulus 1024, the upper packer cartridge 1200 is moved to the correct position, as shown in FIG. 31, with the latch 1410 of the locking dog 1064*a* aligned with the slot 1214 in the upper packer cartridge assembly 1200 and the tapered faces 1219*a*, 1219*b* of the latch 1410 aligned with the respective tapered shoulders 1213*a*, 1213*b* of the first and second actuating sleeves 1400*a*, 1400*b*. A hydraulic line (not shown) is connected to the first locking dog hydraulic fluid port 1420*a* and hydraulic fluid is pumped into the first piston reservoir 1215*a*, thus moving the latch 1410 into the annulus 1024 and towards the slot 1214 of the upper packer cartridge assembly 1200. At the same time hydraulic fluid in the second piston reservoir 1215*b* is pushed out of the second piston reservoir 1215*b* through the second locking dog hydraulic fluid port 1420*b*.

The first piston reservoir 1215*a* expands as it fills with hydraulic fluid, and the latch 1410 is pushed between the first and second actuating sleeves 1400*a*, 1400*b* and into the slot 1214 of the upper packer cartridge assembly 1200. The tapered faces 1219*a*, 1219*b* of the latch 1410 engage with the respective tapered shoulders 1213*a*, 1213*b* of the first and second actuating sleeves 1400*a*, 1400*b*. The direction of the taper of each of the tapered faces 1219*a*, 1219*b* and the tapered shoulders 1213*a*, 1213*b*, and the actuating sleeves 1400*a*, 1400*b* being configured to be moved axially, allows the latch 1410 to move radially inward into the slot 1214 and push the actuating sleeves 1400*a*, 1400*b* axially in opposite directions as it passes them.

As the tapered faces 1219*a*, 1219*b* of the latch 1410 push the actuating sleeves 1400*a*, 1400*b* axially, the first and second seals 1209*a*, 1209*b* are compressed in their axial direction by the respective actuating sleeves 1400*a*, 1400*b*. As more hydraulic fluid is pumped into the first piston reservoir 1215*a*, the latch 1410 continues to be pushed radially inward into the slot 1214 until the second dimension D2 is pushing against the actuating sleeves 1400*a*, 1400*b*. The actuatable sealing mechanisms 1076, 1074 are then in the locked and sealed state (i.e. as shown in FIG. 36).

FIG. 36 shows the actuatable sealing mechanisms 1076, 1074 in the locked and sealed state after the latch 1410 has pushed the actuating sleeves 1400*a*, 1400*b* axially. The first and second seal 1209*a*, 1209*b* have been compressed axially, which has caused radial expansion into the annulus 1024 and brought the first and second seals 1209*a*, 1209*b* into contact with the inner surface 1018 of the integration joint body 1010.

In this locked and sealed state, the upper packer cartridge 1200 cannot move axially with respect to the integration joint body 1010, as this movement is arrested by the latch 1410 which is engaged into the slot 1214 of the upper packer cartridge 1200. The annulus 1024 is sealed by the first and second seals 1209*a*, 1209*b* which have expanded radially into the annulus 1024 and contacted the inner surface 1018 of the integration joint body 1010 to make a fluid tight seal.

When the operator wishes to unlock and unseal the actuatable sealing mechanisms 1076, 1074 from the locked and sealed state shown in FIG. 36 to the unlocked and unsealed state shown in FIG. 31, the reverse of the above procedure can be performed. Firstly, the second piston reservoir 1215*b* is filled with hydraulic fluid through the second locking dog hydraulic fluid port 1420*b*. At the same time, the first piston reservoir 1215*a* is emptied of hydraulic fluid via the first locking dog hydraulic fluid port 1420*a*. This moves the latch 1410 radially outward causing the second dimension D2 to disengage from the first and second actuating sleeves 1400*a*, 1400*b*, and allowing the first and second actuating sleeves 1400*a*, 1400*b* to be free to move axially within the confines of the slot 1221 and pin 1222.

The first and second seals 1209*a*, 1209*b* are sufficiently resilient such that the first and second actuating sleeves 1400*a*, 1400*b* will be moved, by the respective seal 1209*a*, 1209*b*, axially back to the unsealed and unlocked position as the latch 1410 is moved radially outward (i.e. out of the slot 1214).

The first and second seals 1209*a*, 1209*b* disengage from the inner surface 1018 of the integration joint body 1010 and are retracted back from protruding into the annulus 1024 as they push the respective first and second actuating sleeves 1400*a*, 1400*b* back to the unsealed and unlocked position (as the seals 1209*a*, 1209*b* expand axially again).

Finally, as the latch 1410 is moved completely out of the slot 1214 and then out of the annulus 1024 and back into the position shown in FIG. 31, the upper packer cartridge assembly 1200 and integration joint body 1010 become unlocked. In this unsealed and unlocked state, the integration joint body 1010 and upper packer cartridge assembly 1200 are free to move relative to each other without causing damage to the first and second seals 1209*a*, 1209*b*.

It will be understood that the actuatable sealing mechanisms 1076, 1074 may be implemented with any or preferably all of the locking dogs 1060*a*, 1060*b*, 1064*a*, 1064*b*, 1068*a*, 1068*b*. Furthermore, the locking dogs 60, 64, 68 may be adapted to incorporate actuatable sealing mechanisms as described herein, or indeed locking dogs 60, 64, 68 may no longer be required in some designs of integration joint assemblies if locking dogs 1060*a*, 1060*b*, 1064*a*, 1064*b*, 1068*a*, 1068*b* of the first embodiment are used, as these also lock the components inside the integration joint body 1010 whilst providing the sealing function.

The skilled person will however understand that other embodiments in accordance with the first and/or third and/or fourth aspects of the present invention could use different locking means/different locking dogs/latch arrangements in order to move or activate the first and second actuating sleeves 1400*a*, 1400*b* and/or the first and second seals 1209*a*, 1209*b* such as by using the weight of the lower packer cartridge assembly 1100 and/or upper packer cartridge assembly 1200 and/or RCD bearing assembly 1300. Further alternative embodiments for activating the first and second actuating sleeves 1400*a*, 1400*b* and/or the first and second seals 1209*a*, 1209*b* could include further modifying the embodiments of the locking means currently provided by the radially moveable activating member in the form of the locking dogs 1060*a*, 1060*b*, 1064*a*, 1064*b*, 1068*a*, 1068*b* and/or modifying the arrangement of the axially moveable actuating sleeve members currently provided by the actuating sleeves 1400*a*, 1400*b*).

The skilled person will also understand that actuatable sealing mechanisms in accordance with the first aspect of the present invention as described above in relation to the integration joint assembly 1005 of FIGS. 30 to 36 can be used in other tools (ie other than integration joint assemblies or bodies) such a pipeline expansion barrel (which will be described subsequently in relation to FIGS. 41 to 43) without departing from the first aspect of the present invention.

Additional components and equipment can be added to the integration joint assembly 5 and embodiments of the integration joint assembly 1005 as required such as auxiliary lines (eg choke and kill lines) etc. without departing from the present invention.

Embodiments of the present invention have the great advantage over conventional integration joints that the integration joint assembly 1005 is much shorter in length than conventional integration joints and therefore, in use, the goose necks of the MPD flow spool will be much higher up the riser string and therefore are closer to the moon pool of the surface vessel thus allowing the operator much easier access to the drilling fluid return hoses that are connected to the goose necks of the MPD flow spool. In addition, whilst the integration joint assembly 1005 can be and is intended for managed pressure drilling, it can additionally be used for gas handling (in which case the RCD bearing assembly 1300 is not required).

It should also be noted that where the integration joint assembly 1005 is not used in a floating rig application, the integration joint assembly 1005 would not need to be located in line below the telescopic joint but for floating rig applications such as a semi-submersible or drill ship, the integration joint assembly 1005 is typically located within the riser string below the telescopic joint (not shown).

Embodiments of the present invention also have the advantage that instead of pressurised hydraulic fluid being pumped into the cavity behind each of the lower 1102 and upper 1202 annular packer seals, pressurised gas could instead be pumped into that cavity via the respective hydraulic port 1108A, 1208A from the respective lower 1108B and upper 1208B packer hydraulic fluid extend ports.

The lower 1100 and upper 1200 packer cartridge assemblies can be used for a wide range of scenarios such as, but not limited to:—

- sealing on the drill pipe string 1050 when the RCD bearing assembly 1300 seals 1302, 1304 fail;
- as a back up to the RCD bearing assembly 1300;
- for stripping drill pipe from the drill pipe string 1050 when removing/replacing the RCD bearing assembly 1300; or
- for gas handling.

Embodiments of the present invention have the further advantage that the upper 1202 and lower 1102 annular packer seals are housed within separate cartridges 1200, 1100 and these cartridges 1100, 1200 are retrievable separately or can be retrieved together from the through bore 1016. In addition, the upper packer cartridge 1200 is additionally designed to have the RCD bearing assembly 1300 landed and housed thereon and this therefore allows the RCD bearing assembly 1300 to land and seal on the upper packer cartridge assembly 1200 and this feature also allows both the upper packer cartridge assembly 1200 and RCD bearing assembly 1300 to be run/retrieved from the through bore 16 through the riser string as one unit if desired.

Embodiments of the present invention have the further advantage that the upper and lower packer cartridge assemblies 1200, 1100 provide redundancy and the ability to change the upper packer cartridge assembly 1200 whilst maintaining the lower packer assembly 1100 functionality. It would be possible however that modifications could be made to the integration joint assembly 1005 in order to have further packer seals or indeed just one packer seal such as that 1102 contained in the lower packer cartridge assembly 1100.

The RCD bearing assembly 1300 can be retrieved from the through bore 1016 whilst maintaining the functionality of both the lower 1100 and upper 1200 packer cartridge assemblies and the cartridge assemblies 1100, 1200 can remain locked in place in the through bore 1016 during removal and replacement of the RCD bearing assembly 1300.

The embodiments of the present invention have the further advantage that the upper packer cartridge 1200 can be retrieved whilst maintaining the functionality of the lower packer cartridge assembly 1100 which can remain locked in place within the through bore 1016 of the integration joint body 1010. In addition, the upper 1200 and lower 1100 packer cartridge assemblies can be retrieved collectively if desired or alternatively the upper packer cartridge assembly 1200 can be retrieved on its own by the operator.

The locking dogs 1060, 1064, 1068 are incorporated into the integration joint body 1010 to independently lock the RCD bearing assembly 1300, upper packer cartridge assembly 1200 and lower packer cartridge assembly 1100 and these locking dogs, 1060, 1064, 1068 are hydraulically driven and extend radially inwards to lock on to their respective locking grooves 1314 in the RCD bearing assembly 1300 and groove 1214 in the upper packer cartridge assembly and locking groove 1114 in the lower packer cartridge assembly 1100. Moreover, the locking dogs 1060, 1064, 1068 can function independently or in any combination thereof and thus permit independent locking and unlocking for each of the RCD bearing assembly 1300, upper packer cartridge assembly 1200 and lower packer cartridge assembly 1100.

In addition, the embodiments of the present invention have the advantage that the upper packer cartridge assembly 1200 lands on the lower packer cartridge assembly 1100 when being installed separately and the upper packer cartridge assembly 1200 comprises seals 1217 which seal against the inner surface of the socket joint 1118 once landed in the lower packer cartridge assembly 1100.

Embodiments of the present invention have the yet further and important advantage that any one, two or three of the RCD bearing assembly 1300, upper 1200 and lower 1100 packer cartridge assemblies can be replaced by running them through the through bore of the riser string from and into the through bore 1016 without having to dismantle the riser string and that advantage will provide very significant benefits to an operator.

Modifications and improvements may be made to the embodiments hereinbefore described without departing from the scope of the invention.

For example, the RCD bearing assembly 1300 could be modified to only have one of the upper 1304 or lower 1302 RCD seals (and the second embodiment of integration joint assembly shown in FIGS. 37 to 40 comprises one RCD seal 2302 as will be subsequently described) but it is much preferred to have two such seals for redundancy purposes and indeed many jurisdictions around the world require two such seals due to the potentially high pressure of the drilling fluid to be sealed and the second embodiment of integration joint assembly shown in FIGS. 37 to 40 could in turn be modified to comprise an upper RCD seal as well as the lower RCD seal 2302. In addition, the locking dogs 1060, 1064, 1068 could be replaced by any suitable locking arrangement although a remote locking arrangement would be preferred.

Referring now to FIG. 37, there is shown a second embodiment of an improved integration joint assembly 2005 in accordance with the fourth aspect of the present invention. The integration joint assembly 2005 utilises at least one and more preferably several actuatable sealing mechanisms 2030*a*, 2030*b*, 2034*a*, 2034*b*, 2038*a*, 2038*b*, in accordance with the first aspect of the present invention and which therefore utilises at least one and more preferably several elastically deformable resilient seals 2209*a* in accordance with the third aspect of the invention. This second embodiment of the integration joint assembly 2005 is broadly speaking in many respects relatively similar to the first embodiment of the integration joint assembly 1005 described above with reference to FIGS. 30 to 36 and thus similar components and features to those of the first integration joint assembly 1005 in accordance with the present invention and thus similar components and features to those of the first embodiment of an integration joint assembly 1005 are indicated with the same reference numeral but with the further addition of 1000 and unless otherwise subsequently described, operate in a similar manner and therefore may not be described again.

Referring now to FIG. 37, the second embodiment of integration joint assembly 2005 in accordance with the present invention comprises an integration joint body 2010, a lower packer cartridge assembly 2100, an upper packer cartridge assembly 2200, an RCD bearing assembly 2300 comprising a lower RCD seal 2302 and six actuatable sealing mechanisms or assemblies in accordance with the first aspect of the present invention (more actuatable sealing mechanisms can be provided around the circumference), these being 2030*a*, 2030*b*, 2034*a*, 2034*b*, 2038*a*, 2038*b*. The six sealing assemblies are arranged in three sets (1), (2), (3). There is a fourth set (4) of locking assemblies 2040*a*, 2040*b* which comprise locking dogs 2069*a*, 2069*b* but those do not have actuatable sealing mechanisms therein.

Each sealing assembly 2030*a*, 2030*b*, 2034*a*, 2034*b*, 2038*a*, 2038*b* comprises a respective radially movement activating member in the form of a locking dog 2060*a*, 2060*b*, 2064*a*, 2064*b*, 2068*a*, 2068*b* which forms part of a respective actuatable sealing mechanism 2070, 2072, 2074, 2076, 2078. It should be noted that the sealing assembly 2038*a*, 2038*b* only comprise one actuatable sealing mechanism 2078 provided on its in use lower side. Furthermore, it should be noted that the pair of locking assemblies 2040*a*, 2040*b* do not comprise an actuatable sealing mechanism in accordance with the first aspect of the present invention, but rather they are more similar to the locking dog arrangements of the first example shown in FIG. 1.

Accordingly, and as can be seen in the cross-section view of FIG. 37, locking dogs of the same set of sealing assemblies are arranged to act upon the same actuatable sealing mechanisms. In this regard, locking dogs 2060*a*, 2060*b* of the first set (1) both act upon actuatable sealing mechanisms 2070, 2072. Moreover, locking dogs 2064*a*, 2064*b* of the second set (2) both act upon actuatable sealing mechanisms 2074, 2076 and locking dogs 2068*a*, 2068*b* of the third set (3) both act upon actuatable sealing mechanism 2078. Each of the sealing assemblies 2030*a*, 2030*b*, 2034*a*, 2034*b*, 2038*a*, 2038*b* are in accordance with the first aspect of the present invention.

The sets of sealing assemblies (1), (2), (3) of the integration joint assembly 2005 are arranged in a similar manner to those of the first embodiment of integration joint assembly 1005. The additional fourth (4) set of sealing assemblies 2040*a*, 2040*b* are arranged to actuate their locking dogs 2069*a*, 2069*b* respectively into the groove or recess 2314 formed circumferentially about or around the outer surface of the RCD bearing body 2306 but are not arranged to provide a seal against the outer surface of the RCD bearing body 2306 because the RCD bearing body 2306 will be rotating with respect to the integration joint body 2010 when the lower RCD seal 2302 is sealing against the outer surface of the drill pipe string (not shown) which passes there through.

A detailed view of the part of the sealing assembly 2034*a* is shown in FIG. 38, but the skilled reader will understand that all of the other sealing assemblies 2030*a*, 2030*b*, 2034*a*, 2034*b*, 2038*a*, 2038*b* are arranged and are operated in a similar manner. The sealing assembly 2034*a* and components thereof can move between two main states of operation—1) an unlocked and unsealed state, and 2) a locked and sealed state. FIG. 38 shows the sealing assembly 2034*a* in the unlocked and unsealed state such that the upper packer cartridge assembly 2200 and the integration joint body 2010 are free to move relative to each other (ie unlocked state) and the annulus 2024 between the inner surface 2018 (ie the through bore 2016) of the integration joint body 2010 and the outer surface of the upper packer cartridge assembly 2200 is not sealed (ie unsealed state).

The first actuatable sealing mechanism 2076 shown in FIG. 38 comprises an annular ring shaped first elastomeric seal 2209*a* and an annular ring shaped first actuating sleeve 2400*a*. It should be noted however that the actuating sleeve 2400*a* differs from the actuating sleeve 1400*a* of the first embodiment (ie as shown in FIG. 31) in that the actuating sleeve 2400*a* comprises a slot 2501 formed all the way through its side wall at one (or more) particular location around its circumference, where the slot 2501 provides access for a bolt 2503 to pass there through, where the bolt 2503 is screwed into a screw threaded bore 2501 formed in the outer surface of the upper packer cartridge assembly 2200. The bolt 2503 simply acts to prevent the axially moveable actuating sleeve 2400*a* from falling out of position around the outer circumference of the upper packer cartridge assembly 2200.

The elastomeric seal 2209*a* is positioned within a seal groove or recess 2211*a* formed around the outer circumference of the upper packer cartridge assembly 2200. The seal groove 2211*a* is a radial circumferential recess formed within and around the outer surface of the upper packer cartridge assembly 2200 and is formed with two orthogonal walls. The groove 2211*a* is sized such that when the actuatable sealing assembly 2076 is in the unlocked and unsealed state, the elastomeric seal 2209*a* is housed or located entirely within the groove 2211*a* such that the elastomeric seal 2209*a* does not protrude out of the groove 2211*a* beyond the outer diameter of the upper packer cartridge assembly 2200 and thus does not protrude into the annulus 2024 nor contact the integration joint body 2010 and is thus protected within the groove 2211*a*.

The actuating sleeve 2400*a* is positioned within its actuating sleeve groove 2405*a* which is also a radial circumferential recess within and around the outer surface of the upper packer cartridge assembly 2200. The actuating sleeve groove 2405*a* is shaped and sized such that the actuating sleeve 2400*a* can move axially within the respective groove 2405*a* when the sealing assembly 2076 translates or transforms between a) the unlocked and unsealed state and b) the locked and sealed state.

When the sealing assembly 2034*a* is in the unlocked/unsealed state, a gap 2224 (as shown in FIG. 38) is formed between the actuating sleeve 2400*a* and the upper packer cartridge assembly 2200. This gap 2224 allows the actuating sleeve 2400*a* to move to impinge upon the elastomeric seal 2209*a* when the sealing assembly 2034*a* is moved toward/into the locked/sealed state. The gap 2224*a* may be filled with air or it may be filled with a lubricating fluid such as hydraulic oil.

The elastomeric seal 2209*a* is identical to the elastomeric seal 1209*a* as previously described. The locking dog 2064*a* and the hydraulically operated latch 2410 of the actuatable sealing mechanism 2034*a* are very similar if not identical to the locking dog 1064*a* and latch 1410 of the first embodiment shown in FIG. 31 and therefore do not require further detail here.

FIG. 39*a* shows that the latch 2410 of the locking dog 2064*a* has moved into the through bore 2016 of the integration joint body 2010 in the radial direction toward the central axis and in doing so has moved the actuating sleeve

2400*a* axially from the unsealed state to the sealed state. FIG. 39*a* also shows that the elastomeric seal 2209*a* has been axially compressed and that action has also caused radial expansion outwards of the elastomeric seal 2209*a* such that the elastomeric seal 2209*a* seals the annular gap 2024 between the outer surface of the upper packer cartridge assembly 2200 and the inner surface 2018 of the integration joint body 2010. The inner most end of the latch 2410 has also moved into the recess formed to accept it in the outer surface of the upper packer cartridge assembly 2200, thus axially locking the upper packer cartridge assembly 2200 with respect to the integration joint body 2010 because the inner most end of the latch 2410 forms a 90 degree load shoulder to ensure the upper packer cartridge assembly 2200 (and the lower packer cartridge assembly cartridge 2100 and the RCB bearing assembly 2300 by means of their respective latches) remain locked in the integration joint body 2010 when required.

Furthermore, in the second and preferred embodiment of actuatable sealing mechanism 2034*a*, a recess is cut into the inner diameter of the integration joint body 2010 and is then filled with a suitably hard material 2510 such as inconel or other suitable hard material and the recess 2508 and thus the hard material 2510 are located to be axially aligned with the elastomeric seal 2209*a* such that the elastomeric seal 2209*a* is arranged to seal against the hard material 2510 when it is radially expanded outwards. That has the advantage of providing an optimal sealing surface 2510 for the seal 2209*a* to seal against.

FIG. 39*b* shows the shear strain contour lines that the elastomeric seal 2209*a* experiences when in the locked and sealed state of FIG. 39*a* but there is no bore pressure acting against the elastomeric seal 2209*a*, and shows that the shape of the elastomeric seal 2209*a* has the advantage that it does not experience high levels of shear strain.

However, FIG. 40*a* shows the shape that the elastomeric seal 2209*a* adopts when a relatively high bore pressure, such as 3000 psi, acts against the upstream facing face or downward facing face (ie right hand side as shown in FIG. 40*a*) of the elastomeric seal 2209*a*. The wellbore pressure P can be seen in the annulus 2024 to the upstream side (in use downwards side which is to the right hand side of the elastomeric seal 2209*a* as shown in FIG. 40*a*).

The shear strain experienced by the elastomeric seal 2209*a* when significant bore pressure P, such as 3000 psi, is applied to the upstream side of the elastomeric seal 2209*a* in the sealed and locked state as shown in FIG. 40*a* is shown in FIG. 40*b* and the shear strain contour lines show that the elastomeric seal 2209*a* is able to withstand the significant stress and strain placed upon it by the bore pressure P, particularly due to its shape as previously described in relation to FIG. 32*c*. Thus, the elastomeric seal 2209*a* having the shape as previously described for the elastomeric seal 1209*a* provides significant advantages over conventional elastomeric seals.

Accordingly, the second embodiment of the actuatable sealing mechanism 2034*a* as hereinbefore described provides yet another embodiment of an actuatable sealing mechanism 2034*a* in accordance with the first aspect of the present invention, in which the latch 2410 of the locking dog 2064*a* can move radially inwards to cause axial movement of the actuating sleeve 2400*a* to cause compression of the elastomeric seal 2209*a* in the axial direction and which thus causes radial expansion of the seal 2209*a* in the outwards direction toward the sealing surface provided by the hard material 2510 of the integration joint body 2010. Thus, the elastomeric seal 2209*a* does not directly experience the radial inwards movement of the latch 2410 and thus will not be damaged had such movement been directly applied to it—rather, the intermediate component of the actuating sleeve 2400*a* has axially compressed the elastomeric seal 2209*a* to cause the outwards radial expansion thereof.

A yet further embodiment of an actuatable sealing mechanism for sealing a fluid channel provided between two axially arranged tubular members is shown in FIGS. 41 to 43 and which is in accordance with the first aspect of the present invention. In addition, the actuatable sealing mechanism 3007 of FIG. 41 utilises an elastomeric elastically deformable resilient seal 3015 in accordance with the third aspect of the present invention. Furthermore, FIG. 41 shows an expansion barrel assembly 3305 which provides a pipe sealing mechanism for sealing an annular fluid channel between an inner pipe 3012 and an outer pipe 3010 in accordance with the sixth aspect of the present invention.

The expansion barrel assembly 3305 is particularly suitable for use at various intervals such as every 5-10 kilometres in an offshore or onshore pipeline (not shown) for transport of hydrocarbons, particularly in cold environments where the outdoor temperature can be minus 45° C. and the hydrocarbons fluids flowing inside the pipeline can be in the region of 65° C. Such a temperature difference conventionally causes pipelines to expand and contract and therefore it is useful to have a telescopic joint in the form of an expansion barrel 3005 every 5-10 kilometres. It is however important to be able to provide a seal between the outer surface 3014 of the inner pipe 3012 and the inner surface 3011 of the outer pipe 3010 in order to seal the annular gap 3013 there between. However, such a seal needs to be able to cope with the axial relative movement that will occur between the inner and outer pipes 3010 and 3012. Conventionally, such seals are provided by, for example, O-ring seals but such conventional O-ring seals do not last a sufficient length of time (due to the axial friction acting thereon) before needing to be replaced.

It is therefore an object of the present invention to provide a seal 3015 that can be selectively actuated and de-actuated.

The expansion barrel assembly 3007 comprises an elastomeric seal 3015 which in many ways is similar to the elastomeric seal 1209*a* as previously described except that the elastomeric seal 3015 has a much larger diameter (in the region of an outer diameter of 30.875 inches) and more importantly is flipped inside out compared to that elastomeric seal 1209*a*, in that the elastomeric seal 3015 comprises its flat surface on its outer circumferential face. Otherwise, the elastomeric seal 3015 comprises the same cross-sectional shape as the elastomeric seal 1209*a*.

The elastomeric seal 3015 is however located in a groove or recess formed circumferentially around the inner surface 3011 of the outer pipe 3010 and is arranged such that the elastomeric seal 3015 has its lower end butting against the upwardly directed shoulder 3018 of the groove 3017 such that the upwardly directed shoulder 3018 prevents any further downward movement of the elastomeric seal 3015.

An axially moveable actuating sleeve member 3020 is located vertically above the elastomeric seal 3015, where the actuating sleeve member 3020 is an annular ring located around the outer surface 3014 of the inner pipe 3012 such that there is a sufficient annular gap 3013 there between. The actuating sleeve 3020 has a substantially cylindrical uniform inner surface but on its rear face 3032, the actuating sleeve 3020 comprises upper 3021*u* and lower 3021L O-ring seals located in suitably sized recesses and which act against the inner surface 3011 of the outer pipe 3010. The actuating sleeve 3020 is held captive in the inner bore 3011 of the outer pipe 3010 by a stop plate 3024 which is secured to the upper end of the outer pipe 3010 by a suitable bolt 3022. A locking dog assembly 3023 is provided at six locations around the outer circumference of the outer pipe 3010 toward the upper end thereof, where the locking dog assembly 3023 comprises a radially moveable rod 3028 which can be moved by a suitable movement mechanism such as a hydraulic assembly (not shown), where the radially inner most end of the rod 3028 is coupled to the outer end of a radially moveable activating member 3025 in the form of a latch 3025.

The outer rear face 3032 of the actuating sleeve 3020 comprises one or more tapered surfaces 3033 and which in use are arranged to, and are shaped to, co-operate with the front leading face 3030 of the latch 3025, where the front leading face 3030 comprises one or more similarly shaped and correspondingly shaped tapered surfaces 3031. The respective tapered surfaces 3031 and 3033 could be any suitable angle but are preferably in the region of 45° to the radial axis. Consequently, inwardly radial movement of the rod 3028 causes similar radially inward movement of the latch 3025 from the open position shown in FIG. 42 toward the actuating sleeve 3020, such that when the respective tapered surfaces 3031 and 3033 meet, the continued inwardly radial movement of the latch 3025 will cause axial movement of the actuating sleeve 3020 in the downwards direction, such that the actuating sleeve 3020 begins to axially compress the elastomeric seal 3015. Such axial compression of the elastomeric seal 3015 will thus cause radially inwards expansion of the elastomeric seal 3015 such that the elastomeric seal 3015 starts to protrude out of the groove 3017 and into the annular gap 3013. Continued downward movement of the actuating sleeve 3020 will cause continued axial compression of the elastomeric seal 3015 and thus cause continued inward radial expansion of the elastomeric seal 3015 until the convex sealing surface that is opposite the flat surface of the elastomeric seal 3015 makes contact with and therefore seals against the outer surface 3014 of the inner pipe 3012.

Thus, the embodiment of actuatable sealing mechanism 3007 shown in FIGS. 41*a* to 43 provides a means to convert inwards radially movement of the latch 3025 into axial movement of the actuating sleeve 3020 to axially compress the elastomeric seal 3015 in order to radially expand inwards the elastomeric seal 3015. Accordingly, the elastomeric seal 3015 can actuate from the outer pipe 3010 inwardly until it seals against the outer surface 3014 of the inner pipe 3012.

Yet further modifications and improvements may be made to the embodiments hereinbefore described without departing from the scope of the invention.

The invention claimed is:

1. An actuatable sealing mechanism for sealing a fluid channel provided between two co-axially arranged tubular members having a central longitudinal axis, the actuatable sealing mechanism comprising:

an elastomeric seal provided on one of the co-axially arranged tubular members, wherein the elastomeric seal comprises a convex sealing surface, an axially moveable actuating sleeve member; and a radially moveable activating member, wherein the activating member is configured to be moveable in a radial direction in use to translate the actuatable sealing mechanism between an unsealed state and a sealed state, whereby in the unsealed state the activating member does not move the actuating sleeve member sufficiently in a first axial direction to axially compress the elastomeric seal sufficiently to expand the elastomeric seal in a radial direction to seal the fluid channel, and in the sealed state, the activating member moves the actuating sleeve member sufficiently in the first axial direction to axially compress the elastomeric seal sufficiently to expand the elastomeric seal in the radial direction until the convex sealing surface makes contact with the other of the co-axially arranged tubular members and seals the fluid channel.

2. The actuatable sealing mechanism according to claim 1, wherein the activating member is configured to be moveable in a radial inwards direction in use to translate the actuatable sealing mechanism from the unsealed state to the sealed state, and in the unsealed state the activating member does not move the actuating sleeve member sufficiently in the first axial direction to axially compress the elastomeric seal sufficiently to expand the elastomeric seal in a first radial direction to seal the fluid channel, and in the sealed state, the activating member moves that actuating sleeve member sufficiently in the first axial direction to axially compress the elastomeric seal sufficiently to expand the elastomeric seal in the first radial direction to seal the fluid channel.

3. The actuatable sealing mechanism according to claim 2, wherein the elastomeric seal is adapted, when permitted to do so, to inherently return to its original shape of the unsealed state, and in doing so, force the actuating sleeve member to axially move back to its original position in the unsealed state, when the activating member is moved in a second radial direction to return it to the unsealed state.

4. The actuatable sealing mechanism of claim 1, wherein the fluid channel is an annulus between the two tubular members and both the elastomeric seal and the actuating sleeve member are ring-shaped, and wherein the actuating sleeve member is adapted to make contact with the elastomeric ring shaped seal at all points around its circumference, such that the elastomeric seal can provide a seal around the entire annulus.

5. The actuatable sealing mechanism according to claim 4, wherein the elastomeric ring-shaped seal and the ring-shaped axially moveable actuating sleeve member are arranged such that they share a central axis, the central axis projecting through the centre of the elastomeric ring-shaped seal and the ring-shaped axially moveable actuating sleeve member such that each is radially disposed from the central axis on substantially the same radius from the central axis.

6. The actuatable sealing mechanism of claim 4, wherein the elastomeric ring-shaped seal has one of an internal or external surface which is shaped to register with a surface of the fluid channel to be sealed, such that the elastomeric seal is configured to expand radially into the fluid channel to be sealed upon axial compression of the elastomeric seal by the axially moveable actuating sleeve member.

7. The actuatable sealing mechanism of claim 1, wherein the first axial direction is in a direction parallel to the central axis of the elastomeric seal and the actuating sleeve member, wherein the first axial direction is movement in a direction of the actuating sleeve member in an axial direction toward the seal, and a first radial direction is perpendicular to the first axial direction, radially outward from or radially inward towards the central axis.

8. The actuatable sealing mechanism of claim 1, wherein the radially moveable activating member is configured to be moved from the unsealed state to the sealed state by a movement mechanism comprising a locking means such that the radially moveable activating member is capable of being pushed from the unsealed state to the sealed state by the movement mechanism and is further capable of being locked in the sealed state by the locking means.

9. The actuatable sealing mechanism of claim 8, wherein one of the first and second tubular members comprises a first recessed portion for housing the axially moveable actuating sleeve member and the elastomeric seal, and wherein the elastomeric seal is located wholly within the first recessed portion when in the unlocked and unsealed state.

10. The actuatable sealing mechanism of claim 1, wherein the elastomeric seal is a first elastomeric seal and the axially moveable actuating sleeve member is a first axially moveable actuating sleeve member, the actuatable sealing mechanism further comprising a second elastomeric seal and a second axially moveable actuating sleeve member.

11. The actuatable sealing mechanism of claim 1, wherein the radially moveable activating member comprises a tapered face and the axially moveable actuating sleeve member also comprises a tapered face for engagement with the tapered face of the radially moveable activating member.

12. The actuatable sealing mechanism of claim 1, wherein the radially moveable activating member is moveable in one radial direction when moving the actuatable sealing mechanism from the unsealed state to the sealed state and is moveable in the other radial direction when moving the actuatable sealing mechanism from the sealed state to the unsealed state.

13. The actuatable sealing mechanism of claim 1, wherein one of the tubular members comprises a first recessed portion for housing the axially moveable actuating sleeve member and the elastomeric seal.

14. The actuatable sealing mechanism of claim 1, wherein the two tubular members comprise an inner tubular and an outer tubular, and it is the outer tubular that houses the radially moveable activating member, on its outer surface.

15. The actuatable sealing mechanism according to claim 14, wherein the outer tubular comprises both a recessed portion for housing the axially moveable actuating sleeve member and the elastomeric seal, and also houses the radially moveable activating member.

16. The actuatable sealing mechanism according to claim 14, wherein the elastomeric seal is located around an outer circumference of the inner tubular.

17. The actuatable sealing mechanism according to claim 16, wherein the radially moveable activating member is configured to be moved from the unsealed state to the sealed state by a movement mechanism comprising a locking means such that the radially moveable activating member is capable of being pushed from the unsealed state to the sealed state by the movement mechanism and is further capable of being locked in the sealed state by the locking means; wherein the locking means further comprises a first part of a latch mechanism being provided in association with the radially moveable activating member, and a second part of a latch mechanism being provided in association with the inner tubular, wherein the first and second parts can be engaged to provide a lock therebetween to prevent axial movement occurring between the inner tubular and the outer tubular, such that the actuatable sealing mechanism provides both a locking and sealing function.

18. A method of sealing a fluid channel provided between two co-axially arranged tubular members comprising the steps of:

providing the actuatable sealing mechanism of claim 1; and moving the radially moveable activating member radially towards a central longitudinal axis of the tubular members, which said radial movement results in axial movement of at least one moveable actuating sleeve member, and which said axial movement results in compression of the elastomeric seal in an axial direction, and which said axial movement results in expansion of the elastomeric seal in a radial direction such that the actuatable sealing mechanism is translated from the unsealed state to a sealed state to seal the fluid channel.

19. An integration joint assembly for use in drilling operations, the integration joint assembly comprising:

an integration joint body comprising:

a through bore;

an upper end adapted for connection with an upper portion of a riser system; and a lower end adapted for connection with a lower portion of a riser system;

the integration joint assembly being adapted to permit a tubular work string to pass there through such that there is an annulus created between an inner surface of the through bore of the integration joint body and the outer surface of the tubular work string;

wherein the integration joint assembly further comprises at least one sealing device adapted in use to provide a seal within the said annulus; and wherein the at least one sealing device and the integration joint body are adapted such that the at least one sealing device is capable of being located within the through bore of the integration joint body such that there is a fluid channel located between the inner surface of the through bore of the integration joint body and the outer surface of the at least one sealing device; and at least one actuatable sealing mechanism of claim 1 and being arranged to selectively seal said fluid channel.

20. A method of drilling comprising the step of:

installing the integration joint body of claim 19 in a riser string and running a tubular work string through the through bore thereof.

21. A pipe sealing mechanism for sealing an annular fluid channel between an inner pipe and an outer pipe, the pipe sealing mechanism comprising:

an actuatable sealing mechanism of claim 1 and being arranged to selectively seal said fluid channel.

22. A pipe sealing mechanism according to claim 21, wherein the two tubular members comprise an inner tubular and an outer tubular, and it is the outer tubular that houses the radially moveable activating member, on its outer surface, the outer tubular comprises both a recessed portion for housing the axially moveable actuating sleeve member and the elastomeric seal, and also houses the radially moveable activating member, and the actuatable sealing mechanism is arranged such that inwards radial movement of the activating member firstly axially moves the actuating sleeve member to axially compress and thereby radially expand the elastomeric seal inwards towards the inner tubular until the elastomeric seal seals against the outer circumference of the inner tubular.

23. A method of sealing an annular fluid channel between an inner pipe and an outer pipe, the method comprising the steps of:

providing the pipe sealing mechanism of claim 21; and actuating the pipe sealing mechanism to seal the annular fluid channel.

* * * * *